US007857591B2

(12) United States Patent
Gajewski et al.

(10) Patent No.: US 7,857,591 B2
(45) Date of Patent: Dec. 28, 2010

(54) FAN WITH POWER DEPLOYED FAN BLADE

(75) Inventors: Mark Gajewski, Avila Beach, CA (US); William Patrick Conley, Camarillo, CA (US); Rodger Dale Thomason, Santa Monica, CA (US)

(73) Assignee: Swiss Module Group, LLC, Avila Beach, CA (US)

( * ) Notice: Subject to any disclaimer, the term of this patent is extended or adjusted under 35 U.S.C. 154(b) by 182 days.

(21) Appl. No.: 12/123,392

(22) Filed: May 19, 2008

(65) Prior Publication Data

US 2008/0286103 A1 Nov. 20, 2008

Related U.S. Application Data

(60) Provisional application No. 60/930,667, filed on May 18, 2007, provisional application No. 60/930,641, filed on May 18, 2007, provisional application No. 60/930,642, filed on May 18, 2007, provisional application No. 61/021,088, filed on Jan. 15, 2008, provisional application No. 61/021,232, filed on Jan. 15, 2008, provisional application No. 61/021,265, filed on Jan. 15, 2008.

(51) Int. Cl.
*F04D 29/36* (2006.01)

(52) U.S. Cl. ..... 416/143; 415/129

(58) Field of Classification Search ..... 415/130, 415/131, 133, 129; 416/143
See application file for complete search history.

(56) References Cited

U.S. PATENT DOCUMENTS

| | | | | |
|---|---|---|---|---|
| 1,361,785 | A * | 12/1920 | Tucker | 416/142 |
| 1,445,402 | A * | 2/1923 | Le Velle | 416/87 |
| 1,458,348 | A * | 6/1923 | Le Velle | 416/87 |
| 2,079,942 | A * | 5/1937 | Le Velle | 416/87 |
| 3,692,427 | A * | 9/1972 | Risse | 416/143 |
| 4,640,668 | A | 2/1987 | Yang | |
| 4,884,947 | A | 12/1989 | Rezek | |
| 6,592,328 | B1 | 7/2003 | Cahill | |
| 6,932,578 | B2 | 8/2005 | Pearce | |
| 7,153,100 | B2 | 12/2006 | Frampton et al. | |

FOREIGN PATENT DOCUMENTS

| | | | |
|---|---|---|---|
| JP | 59167985 | U | 11/1984 |
| JP | 59197747 | A | 11/1984 |
| JP | 62180693 | U | 11/1987 |
| JP | 08121379 | A | 5/1996 |

OTHER PUBLICATIONS

*International Search Report and Written Opinion of the International Searching Authority* for PCTUS2008064023 mailed Nov. 21, 2008.
Gajewski,"12123398".
Gajewski, "12123402".
Int'l Searching Authority, *International Search Report and Written Opinion of the International Searching Authority* mailed Nov. 25, 2008.
Int'l Searching Authority, *International Search Report and Written Opinion of the International Searching Authority* for PCTUS2008064024 mailed Sep. 25, 2008.

* cited by examiner

*Primary Examiner*—Ninh H Nguyen
(74) *Attorney, Agent, or Firm*—Cislo & Thomas, LLP

(57) ABSTRACT

A fan comprising: a housing unit; a retractable fan blade; and a means for driving the retractable fan blade from a retracted position within the housing unit to an extended position exterior to the housing unit.

8 Claims, 56 Drawing Sheets

FAN WITH POWER DEPLOYED FAN BLADE

This application claims priority under 35 U.S.C. 119(e) to the following United States provisional patent applications:

60/930,641, filed May 18, 2007 of Gajewski et al., for MOVABLE DECORATIVE HOUSING ELEMENTS FOR CEILING FANS;

60/930,642 filed May 18, 2007 of Gajewski et al., for POWERED BLADE DEPLOYMENT AND RETRACTION OF CEILING FANS;

60/930,667 filed May 18, 2007 of Gajewski et al., for POWERED BLADE PITCH ADJUSTMENT FOR CEILING FANS;

61/021,088 filed Jan. 15, 2008, of Gajewski et al., for BLADE CONCEALMENT METHODS FOR CEILING FANS;

61/021,232 filed Jan. 15, 2008 of Gajewski et al., for DEPLOYABLE BLADE CEILING FAN WITH STACKED MODULES; and 61/021,265 filed Jan. 15, 2008 of Gajewski et al., for INDEPENDENTLY POWERED BLADE DEPLOYMENT MECHANISM FOR CEILING FANS.

This application is also a continuation of the following international applications:

Patent Cooperation Treaty Application No. PCT/US08/64022 filed May 17, 2008, of Mark Gajewski et al., for FAN WITH POWER ADJUSTABLE HOUSING;

Patent Cooperation Treaty Application No. PCT/US08/64023 filed May 17, 2008, of Mark Gajewski et al., for FAN WITH POWER DEPLOYED FAN BLADE; and Patent Cooperation Treaty Application No. PCT/US08/64024 filed May 17, 2008, of Gajewski et al., for FAN WITH ADJUSTABLE FAN BLADE PITCH.

All of these above-identified applications are expressly incorporated herein by reference as if set forth in their entirety.

This application relates to fans described in the following applications filed concurrently herewith. The related applications, all of which are incorporated herein by reference, are: U.S. patent application Ser. No. 12/123,398, to Gajewski et al., entitled Fan with Power Adjustable Fan Blade Pitch; and U.S. patent application Ser. No. 12/123,402, to Gajewski et al., entitled Fan with Power Adjustable Housing Unit.

BACKGROUND OF THE INVENTION

1. Field of the Invention

The present invention relates generally to fans, and more specifically to active (e.g., directly powered) deployment of the blades of a fan. More particularly, the present invention relates generally to active, non centrifugal deployment of air moving blades for fans from a stowed (or stored) position to a deployed (or use) position.

While this application focuses on fans (e.g. ceiling fans), the present invention is not limited to fans as it can be applied to countless other devices and systems, such as plane or boat propulsion systems, portable blowers, pump systems, and airplane emergency landing systems.

2. Discussion of the Related Art

Electric ceiling fans are commonly utilized to assist heating and air conditioning systems, or in lieu of heating and air conditioning systems, by providing an additional degree of air circulation within the confines of a room. Most modern ceiling fans consist of an electric motor suspended by a shaft from a ceiling, with a plurality of blades mounted to either the top or bottom surface of the motor. Conventional ceiling fans typically incorporate one or more electrical switches for controlling the speed and rotational direction of the motor, with the switches encased within a switch housing disposed beneath the motor, or in an electrical box located in or on an adjacent wall.

In the case of ceiling fans having blades mounted to the bottom surface of the motor, blade irons to which the blades are secured are typically rigidly attached to the motor by means of a plurality of screws. While blade irons can be quite ornate and decorative, the multiplicity of screws utilized to secure blade irons to the blades and the motor are unsightly. In addition, even decorative blade irons may not yield an aesthetically pleasing structure when the ceiling fans are not in use.

U.S. Pat. No. 4,884,947 issued Dec. 5, 1989, entitled "CEILING FAN ASSEMBLY" demonstrates one effort to create an aesthetically pleasing ceiling fan, wherein the blade irons and associated screws are hidden from view.

There is a need in the art for a fan having a simplified, with an uncluttered appearance suitable for use in most applications.

SUMMARY OF THE INVENTION

In one embodiment, the invention can be characterized as a fan comprising: a housing unit; a retractable fan blade; and a motive unit operably coupled to the retractable fan blade, wherein the motive unit is configured to drive the retractable fan blade from a retracted position within the housing unit to an extended position exterior to the housing unit.

In another embodiment, the invention can be characterized as a fan comprising: a housing unit; a retractable fan blade; and a means for driving the retractable fan blade from a retracted position within the housing unit to an extended position exterior to the housing unit.

In a further embodiment, the invention may be characterized as a method for adjusting a position of a fan blade, comprising the steps of: providing a signal to a motive unit, wherein the motive unit is operably coupled to a retractable fan blade; driving the retractable fan blade from a position within a housing unit to a position exterior to the housing unit; and fixating the retractable fan blade in the position exterior to the housing unit.

BRIEF DESCRIPTION OF THE DRAWINGS

The above and other aspects, features and advantages of several embodiments of the present invention will be more apparent from the following more particular description thereof, presented in conjunction with the following drawings.

The above and other aspects, features and advantages of several embodiments of the present invention will be more apparent from the following more particular description thereof, presented in conjunction with the following drawings.

Figure 1:
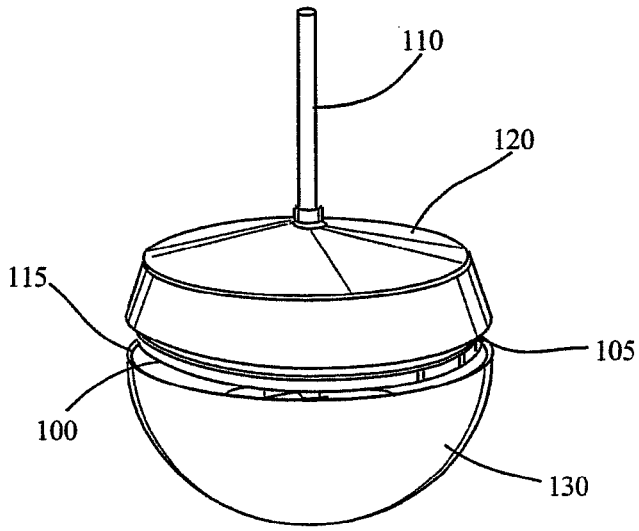
FIG. 1 is a perspective view of a ceiling fan in accordance with one embodiment of the present invention showing a plurality of actively deployable fan blades in a stowed (or stored) position.

Corresponding reference numerals indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Ceiling fan designs have been proposed to minimize the visual impact of the blades when not in use. One approach to minimizing the visual impact of the blades is to employ blades that deploy from a stored position, that is substantially close to a housing unit, to a deployed position (use position or operating position), that is away from the housing unit, for the purpose of moving air. Such a ceiling fan may at least partially hide the blades, allowing the blades to be less exposed when not in operation. Deployable blade ceiling fans heretofore however have not been able to completely hide the folded blades from view. For example, U.S. Pat. No. 7,153,100 shows an example of a deployable blade ceiling fan. As shown, the blades are nested on top of the housing when not in use, however the blades remain a strong visual element of the entire ceiling fan structure. Unfortunately for the design of the '100 patent, there is a considerable advantage for a ceiling fan design that features deployable and retractable blades if the blades are rendered substantially invisible (i.e., concealed) when in the stowed position (stored position or retracted position) while not in use. Some advantages may be that the blades will be less subject to dust and dirt accumulation, safety, and visual appeal. Thus, it is desirable to provide a means for substantially concealing the blades of a ceiling fan when the blades are not in use. It is also be desirable to provide concealing means for the blades for a ceiling fan that operate automatically in coordination with the means of deployment and retraction of the fan blades. A control system for controlling deployment of the blades is described more fully below herein in reference to FIGS. 58 through 61. It would also be desirable that the means of concealing the blades of a ceiling fan be such that an average observer of the ceiling fan does not observe the blades, and thus leads the observer to conclude that the ceiling fan is not a ceiling fan, but rather merely a lighting fixture. Thus when the ceiling fan is operated the observer would enjoy a visually pleasing transformation of the fixture, for example, from a lighting fixture into a ceiling fan.

When a typical ceiling fan is not operating (i.e., the blades are not moving air) the exposed resting blades can create an unsightly design feature. It is difficult to harmonize the long and flat shape of the blades with the fan body, and the surrounding architectural space as well. This problem is even more acute if the fan is mounted in a small space.

The blades may also collect dust, necessitating periodic cleaning. Such cleanings may require specialized cleaning brushes to accommodate both the awkward, flat elongate shape of the blades, and the potentially significant heights at which such ceiling fans are often mounted. It would be thus desirable to minimize the visual impact of the blades of the ceiling fan when the ceiling fan is not in operation, as well as to protect the blades of the ceiling fan from the environment outside the fixture, e.g., dust, sunlight or rain, by storing them inside an enclosed housing.

The '100 patent's design has been proposed to address the exposed blade issue. The blades are mounted on a pivot and are fitted with spring elements that urge the blades into a folded position substantially close to the housing. In normal fan operation the centrifugal force on the blades deploy the blades outward into a deployed position (or operating position).

There are several disadvantages to using this centrifugal force as a means of controlling deployment and storage of the fan blades. First, it can be difficult to control the blade deployment for different operating speeds and directions of the ceiling fan. Often the blades will not deploy in a coordinated manner, creating an imbalance during the transition from the blade storage position to the deployed position. The '100 patent attempts to address the problem of coordinated blade deployment by fitting complicated mechanical linkages and damping elements to the blades. This adds additional complexity, cost and weight to the ceiling fan.

Another disadvantage to the centrifugal force deployment method is that the blades may not fully deploy during low speed operation. This limits the range of permissible operating speeds of the ceiling fan and may still cause balance problems in operation. The blade mount locations and blade shape are limited by the need to have acceptable centrifugal force acting on them in the stored position. This imposes significant constraints on the design of the fan and can compromise the air moving capacity of the fan. This centrifugal force deployment is also referred to herein as passive deployment, as there is no direct or active control, of when or how quickly the blades deploy or retract.

Therefore, it is desirable to provide a more easy and controllable means of actively deploying and actively retracting ceiling fan blades independent of fan operating speed or direction, as imparted by a main drive motor. It is also desirable to positively position the blades in both the storage and operating positions, as opposed to the blades potentially being positioned at a point at which equilibrium is reached between spring force resultant, when a spring element exerts a spring force, and the centrifugal force resultant from the inertia of the blades being acted upon by the main drive motor. Alternatively, in accordance with the present embodiment, positive positioning of the blades may be achieved by, for example, deploying the blades to the deployed position using the deployment mechanism, and the deployment motor, and returning the blades to the retracted (or stowed position) by the use of a spring, that tensions as the blade is deployed, and relaxes as the blades are retracted. Further alternatively, positive positioning may be achieved by, for example, deploying the blades to the deployed position by the use of a spring that tensions as the blade is retracted, and relaxes as the blade is deployed, and retracting the blade to the retracted position using the deployment mechanism, and the deployment motor. Furthermore, in accordance with further embodiments, the deployment of the blades may be achieved using a single deployment motor (as opposed to a deployment motor for each blade) or any number of deployment motors less than the number of blades, in combination with one or more gears or other direct linkages that transfer rotational movement imparted by the deployment motor(s) to two or more deployment mechanisms associated with two or more blades. Additionally, in accordance with yet further embodiments, the deployment of the blades may be achieved by using one or more gears or other direct linkages to transfer rotational movement imparted by the main drive motor to two or more deployment mechanisms associated with two or more blades.

In operation, the positive, active deployment of the blades, as opposed to the deployment of the blades by the opposition of a spring force with a centrifugal force induced as a response to the rotation of the blades about an axis defined by rotation of the main motor about the main drive shaft in order to move air, ensures optimal balance of the ceiling fan and optimal air moving capacity. As stated above, it is also desirable to allow more flexibility in blade shape and mounting to improve aesthetics and air moving performance. It is also desirable to provide a pleasing visual experience to the user by deploying and retracting the fan blades, such that the fan blades are rendered substantially invisible (i.e., concealed) when in the stowed position (stored position or retracted position) while the fan is at rest. The mechanism that deploys and retracts the fan blades should have minimal impact to the aesthetic design of the fan. It is advantageous to provide a deployment mechanism that has as many common parts as possible, over a wide variety of sizes and styles of fans. (Various mechanical power transmitting means may be incorporated into the deployment mechanism, such as gears, belts, or cables to transmit motion from the motive power source to each blade.) This confers significant economies of scale in the production of precision mechanical components for the deployment mechanism. One area of particular interest and advantage is the use of a motive power source (e.g., electric motor, solenoid, hydraulic or pneumatic cylinder, or the like) coupled to the deployment mechanism. If a central power source (single motive power source) is employed, means are necessary to transmit the power to each individual blade's deployment mechanism. This can involve gears, belts, or shafts that would have to be unique for each fan design. Balance of the overall assembly, an important design feature of ceiling fans, can be complicated by this approach as well.

It is advantageous to provide a blade deployment mechanism with each blade having its own standalone motive power source. Thus the deployment mechanism and its cooperative motive power source can be common across all fan designs, creating significant economies of scale. Having a closed deployment mechanism with its own motive power source also simplifies the balancing of the overall ceiling fan assembly.

A ceiling fan featuring deployable and retractable blades confers many advantages over a fixed-blade ceiling fan. Retracting the blades while not in use enhances visual appeal, reduces dust accumulation on the blades, reduces fading of the blades' ornamental surface, and potentially water damage to the blades. In such a ceiling fan with deployable and retractable blades, it is desirable to store the retracted blades in the minimum possible space. For simple blades of maximum size for a given housing size, the optimum storage configuration is flat (zero pitch relative to the axis of rotation of the ceiling fan) and coplanar with one another.

While numerous references are made herein to and examples described of ceiling fans, one of ordinary skill in the art will recognize that the principles, processes, and structures described herein are applicable to numerous types of fans for air movement. For example, the principles and structures described herein can be employed in wall fans, floor fans, box fans, table fans, or the like.

A module can thus be described where a plurality of retractable blades are configured essentially on the same plane. Due to storage space constraints in the fan housing, the number of retractable blades in a module may be limited. Some fan designs may require more air movement capability than a single module can provide. Aesthetic considerations may also dictate an increased number of blades in the ceiling fan design.

It is desirable to provide more blades on a retractable blade ceiling fan than the number available from a single module. It is also desirable to increase the air moving capacity of a retractable blade ceiling fan. The ability to provide various numbers of blades to different ceiling fan designs with many common parts would also provide substantial benefits.

In some embodiments, the present invention provides a movable element of a fan housing or blade mounting system to completely hide the blades when not in use. Alternatively one or more elements of the deployable blades, e.g., an upper surface of the blades, or an outer edge of the blades, may be shaped to blend aesthetically into the fan housing while in the blades are in the stowed position (stored position or retracted position). Thus the ceiling fan can be transformed into an attractive lighting fixture or an inconspicuous element of an architectural space when the ceiling fan is not operating to move air. In the case of movable blade concealing elements, movement of the blade concealing elements can be accomplished by an independent motive power source, or by the motive power sources for blade deployment (deployment motors) or overall fan rotation (main drive motor) could be used in a coordinated manner. The independent motive power source could be for example an electric motor, or a hydraulic or pneumatic cylinder. Various mechanical power transmitting means may be provided, such as gears, belts, or cables to transmit motion from the motive power source to each movable concealing element. It is also possible to have a separate motive power source each movable concealing element. For the case of blades that blend into the housing while stowed, trim features may be incorporated into the blades to match visual trim elements of the housing, or the entire blade may be shaped to substantially match the profile of the housing.

It will become apparent that providing active blade concealment will confer a number of advantages. The blades can be substantially hidden from view when not in use. This frees a ceiling fan designer from having to compromise for example between designing a lighting fixture and designing a ceiling fan. The design could be a visually pleasing light fixture with the unexpected ability to move air when needed.

The present invention, in accordance with some embodiments, provides an active deployment mechanism to deploy the blade of the ceiling fan to a fully open position (deployed position) and pitched position. The deployment mechanism is also capable of moving the blade of the ceiling fan to a flat (parallel) stowed position inside the housing. The mechanism is integrated with its own motive power source (deployment motor), which may be an electric motor or solenoid, pneumatic or hydraulic cylinder, or the like. There can as many deployment motors and deployment mechanisms as there are blades on the ceiling fan to be deployed.

It will become apparent that providing a separate deployment motor for each deployment mechanism will confer a number of advantages. For example, economies of scale will be greatly increased while simplifying overall assembly and balancing of the ceiling fan.

The present invention, in accordance with some embodiments, is a powered means of blade deployment and/or retraction. A motive power source is provided to drive the articulation of blades of a ceiling fan independent of fan operating speed or direction. The motive power source could be for example an electric motor or solenoid, or a hydraulic or pneumatic cylinder. The blades could, for example, be mounted on pivots, on linkages or on sliding means, or could employ a telescoping or folding structure whereby the blades are deployed by extending their length or folding either along a hinge across their width (like a clamshell) or across themselves (like a pocket knife). Various mechanical power transmitting means may be provided, such as gears, belts, or cables to transmit motion from the motive power source to each blade. It is also possible to have a separate motive power source for deploying or retracting each blade.

It will become apparent that providing independent powered means for deployment and retraction of ceiling fan blades will confer a number of advantages. This makes it possible to perform the deployment and retraction of the blades while the fan is at rest, i.e., not rotating and/or not moving air. This would result in a visually appealing ceiling fan. An additional advantage is positive (active) positioning of the blades under all operating conditions, thus assuring correct balance and air moving performance. In addition there are a number of advantages in potential blade mounting configurations and storage configurations that are not possible without active blade deployment.

The present invention, in some embodiments, provides a method of employing stacked retractable blade modules in a ceiling fan. Each module defines a substantially planar arrangement of blades. The module may have one or more motive power sources on board for blade deployment and retraction. In another configuration, an external motive power source may provide blade deployment and retraction for one or more of the stacked modules.

It will become apparent that providing stacked compact planar deployable blade modules will confer a number of advantages. An arbitrary number of blades may be incorporated into a retractable blade ceiling fan design with minimal package space. This provides the designer with optimum flexibility. The use of modules with many common parts and stacking them to vary the number of blades can provide substantial economies of scale in the production of different ceiling fan designs. The advantages of the present invention in various embodiments include, without limitation, improved means for concealing the blades of a deployable blade ceiling fan when not in use. One or more elements of the fan housing may be moved into position to obscure the blades or the blade support structure may be moved to obscure the blades relative to the fan housing. Alternatively certain decorative elements of the fan blades may be designed to match elements of the housing while the blades are in a stored position. The shape of the fan blades may also be configured to substantially match the shape of one or more housing elements. Thus the fan may be designed as an attractive architectural element or lighting fixture for a space without compromising the functions of having exposed fan blades. An additional advantage of the invention is the ability to provide a pleasing visual metamorphosis for the user as, for example, the lighting fixture transforms itself into a fan and moves air.

In broad embodiment, the present invention is a means of utilizing movable elements of a ceiling fan housing or blade support structure to hide the blades when they are folded to a storage position. The motive power source for the movable housing elements may be independent of the main motive power source that rotates the fan assembly in operation or the motive power source that deploys and retracts the blades. Alternatively elements of the movable blades may be designed to blend or match elements of the fan housings to conceal the blades while in a storage position. The blade elements may be decorative or the blade shape may be configured to substantially match the shape of one or more housing elements.

Referring to FIG. 1, a perspective view is shown of a ceiling fan in accordance with one embodiment of the present invention showing a plurality of actively deployable fan blades 100 and 105 in a stowed (or stored position). Shown is a support pole (or rod) 110, an upper housing 120, a light cover 130, a first blade shown in a stowed position 100, and a second blade 105 in the stowed position.

The support pole (or rod) 110, made of a material such as steel, aluminum, wood, plastic, composite materials (such as composites contacting polyester, vinyl ester, epoxy, phenolic, polyimide, polyamide, polypropylene, PEEK, metals, and/or others, with fibrous materials or ground minerals, wood, paper, textiles, and/or others), is coupled at a distal end to a mounting surface, such as a ceiling of a room (not shown). The support pole (or rod) 110 is coupled at a proximal end to the upper housing. The upper housing 120 encloses a main drive shaft (not shown), a main drive motor (not shown), and a deck (not shown) made from, e.g., aluminum, zinc or steel (i.e., metal castings or stampings), plastic, composites, wood, such as polycarbonate, which is turned about a main axis defined by the support pole (or downrod) 110, the main drive shaft and the main drive motor in response to actuation of the main drive motor, such as by the application of power to the main drive motor by the activation of a wall switch or control (or, alternatively, wired or wireless remote control) (not shown), such as is known in the art.

In lieu of the support pole, or downrod, alternative mounting mechanisms may be used. For example, Some fans mount using a "ball-and-socket" system. With this system, there is a metal or plastic hemisphere mounted on the end of the downrod; this hemisphere rests in a ceiling-mounted metal bracket and allows the fan to move freely (which is very useful on vaulted ceilings, for example). Other Some fans mount using a "J-hook" (also known as a "claw-hook") system. In accordance with the "J-hook" system, a metal hook secures to a ceiling-mounted metal bolt. Generally, a rubber bushing is inserted between the hook and the bolt to reduce noise. Yet other fans can be mounted using a Low-Ceiling Adapter, a special kit that eliminates the need for a support pole, or downrod, and is therefore useful in rooms with low ceiling clearance. Finally, canopy (ceiling cover piece) can optionally be screwed directly into the top of the motor housing; then the whole fan can be secured directly onto the ceiling mounting bracket. This is known as a "close-to-ceiling" mount.

The deployment mechanism and the deployment motor must be smooth, quiet, durable, and reliable. If one blade fails to deploy it can cause serious imbalance problems when the main drive motor starts up. Thus it is imperative to specify a high quality motor for the deployment motors described herein.

The type most suitable for the described embodiments is a DC gearmotor. This type of deployment motor is very powerful and durable, and can be made acceptably quiet with careful design of the mechanism and mounting. The low voltage DC power required by the DC gearmotor is made safe in many environments, including high humidity and outdoors. The life of the motor is equivalent to many years of service in a fan at high reliability.

Alternatively, the AC synchronous gearmotor is suitable as well. These tend to be lower in torque than the DC gearmotors, but they are absolutely silent in operation. The silence can be advantageous, but the durability tends to be less than the DC motor, and the full 120V AC current used to supply the AC synchronous gearmotor can be less safe in certain wet or humid environments. The AC synchronous gearmotors tend to be short and wide, whereas the DC gearmotors tend to be thin and long. The thin, long form factor provides a more advantageous package in a wider variety of fan designs than a short, wide form factor.

For the above reasons, the DC gearmotor is preferred in the embodiments described in this specification.

It should be clear that the deployment motor is preferably a substantial, industrial quality motor. The fan blades can be quite heavy and the mechanism (with its motor) must be able to resist large loads, such as a blade colliding with something during operation, or a user bumping into a blade or twisting a blade when it is deployed. In addition, the mechanism and motor must resist substantial aerodynamic and centrifugal loads that may occur when the fan is, for example, running at high speeds. The motor and mechanism must maintain precise blade position to ensure balance and optimal air moving performance.

As the deck is turned (or rotated) a pair of blades 100 and 105, made from, e.g., MDF, plywood, aluminum, steel, plastic, composite materials (such as those listed above), wicker, fabric wrapped metal, wooden or plastic frames, or the like affixed thereto is likewise rotated. Note that, as shown the main drive shaft does not rotate relative to the support pole 110 (or the room or space in which the ceiling fan is utilized). Instead the main drive motor rotates about the main drive shaft, and thus rotates relative to the support pole 110, and the room or space in which the ceiling fan is utilized. The main drive motor is fixed in position, in accordance with the present embodiment, relative to the deck, and thus, the rotation of the main drive motor relative to the main drive shaft results in rotation of the deck (and the blades affixed thereto) relative to the main drive shaft, and the room, or space in which the ceiling fan is utilized.

Prior to rotation of the deck (not shown), the blades 100 and 105 may be are deployed into a position so as to facilitate the movement of air in response to the rotation of the blades 100 and 105. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. In accordance with the present embodiment, a light, such as an incandescent light bulb or an light emitting diode array, are positioned below the deck and affixed to a main shaft, made from, for example steel or the like, that is coaxial with the support pole 110, so as to fix the light below the deck, and such that the light does not rotate in response to the turning of the main drive motor. The light cover encloses the light, providing a measure of protection from, for example, dust, weather, or the like, and providing safety and aesthetically pleasing structure for the ceiling fan.

Alternatively, a lower fan housing element (which may be made from, e.g., glass, steel, aluminum, alabaster, fiberglass, carbon fiber, plastics, ceramics, clays) may be used in lieu of the light cover 130, in the event, in accordance with other embodiments, the light is not utilized. In such alternative embodiment the ceiling fan serves the single function of air movement, and does not serve as a light fixture.

A gap 115 is defined between the upper housing 120 and the light cover 130 (or lower housing) (which may be made from, e.g., glass, steel, aluminum, alabaster, fiberglass, carbon fiber, plastics, ceramics, clays) through which the blades 100 and 105 are deployed, for example, upon actuation. The gap 115 should be no wider than necessary to accommodate passage of the blades 100 and 105 into their deployed position while co-planar and parallel to one another. In a variation, the gap 115 may be closed once the blades 100 and 105 reach a retracted position (in response to deactivation of the ceiling fan). Such closing of the gap may be achieved by moving the light cover 130 (or lower housing), relative to the upper housing 120, so as to close the gap 115. This may be, for example, expected by the movement of the light cover 130 in a generally upward direction (toward the ceiling) under the influence of a motive device, such as a motor, solenoid, a hydraulic cylinder, a pneumatic cylinder, or the like.

Figure 2:
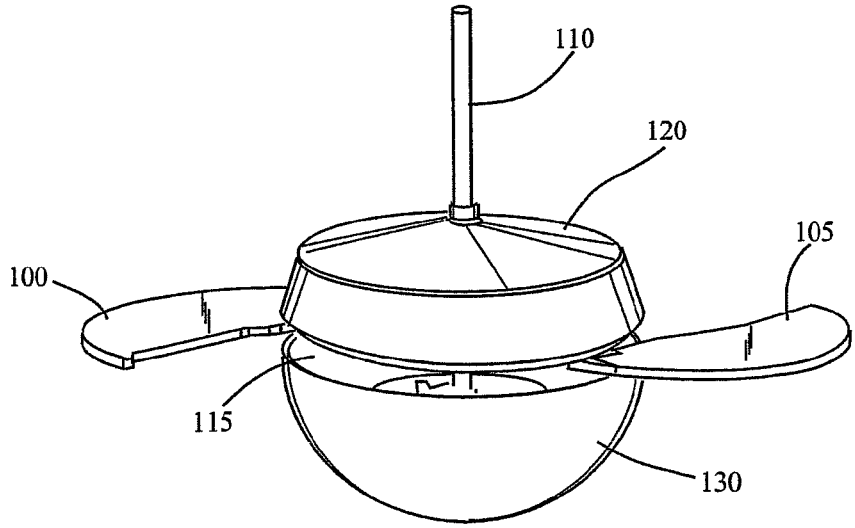
FIG. 2 is a perspective view of the ceiling fan in accordance with the embodiment of FIG. 1 showing the plurality of actively deployable fan blades in a deployed (or use) position.

Referring to FIG. 2, a perspective view is shown of the ceiling fan in accordance with the embodiment of FIG. 1 showing the plurality of actively deployable fan blades 100 and 105 in a partially deployed (or use position). Shown is the support pole 110, the upper housing 120, the light cover 130, the first blade 100 shown in a partially deployed position, and the second blade 105 showed in a partially deployed position.

The support pole (or rod) 110 is coupled at a distal end to the mounting surface, such as a ceiling of a room (not shown). The support pole (or rod) 110 is coupled at a proximal end to the upper housing 120. The upper housing 120 encloses a main drive shaft (not shown), a main drive motor (not shown), and a deck (not shown), which is turned about a main axis defined by the support pole, the main drive shaft and the main drive motor in response to actuation of the main drive motor, such as by the application of power to the main drive motor by the activation of a wall switch (not shown), such as is known in the art. As the deck is turned (or rotated) the pair of blades 100 and 105 affixed thereto is likewise rotated.

Prior to rotation of the deck, the blades 100 and 105 may be deployed into a position so as to facilitate the movement of air in response to the rotation of the blades 100 and 105. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. This deployment includes both rotation of the blades 100 and 105 about an axis parallel to the main axis (but not coaxial therewith), so as to move the blades 100 and 105 from a stowed position to a deployed position, and the rotation of the blades 100 and 105 about an axis substantially perpendicular (or otherwise not parallel (or otherwise off parallel, i.e., otherwise rotated to a position in a plane that is off perpendicular to the axis of rotation of the blades as they are rotated by the main drive motor about the main drive shaft) to the main axis, so as to alter the pitch of the blades 100, e.g., from 10 degrees to 30 degrees and 105 in order to facilitate movement of air by the blades 100 and 105 upon rotation of the blades 100 and 105 about the main axis.

Advantageously, in accordance with the teachings herein the pitch of the blades 100 may be reversed in response to a control signal, such as from a wall control, or a wired or wireless remote control, so as to control the deployment motors to reverse the pitch of the blades, e.g., from, for example, +10 degrees to +30 degrees relative to horizontal, to from, for example, −10 degrees to −30 degrees. In this way, the direction of air movement caused in response to the turning of the main drive motor can be reversed without changing the direction of rotation of the main drive motor.

In accordance with the present embodiment, a light, such as an incandescent light bulb or a light emitting diode array, is positioned below the deck and affixed to the drive shaft, which is coaxial with the support pole 110, so as to fix the light below the deck such that the light does not rotate in response to the turning of the main drive motor. The light cover 130 encloses the light, providing a measure of protection from, for example, dust, weather, or the like, and providing safety and aesthetically pleasing structures for the ceiling fan.

Alternatively, a lower fan housing element (not shown) may be used in lieu of the light cover 130, in the event, in accordance with other embodiments, the light is not utilized. In accordance with this embodiment, in order provide lighting, an uptight may be used at the base of the upper fan housing element, or an external (outside of the lower housing) light may be used at the base of the lower housing, or, in the event no lighting is incorporated in the to the ceiling fan, a light may not be used at all.

A gap 115 is defined between the upper housing 120 and the light cover 130 (or lower housing) through which the blades 100 and 105 are deployed, for example, upon actuation. In accordance with one embodiment, this deployment is initiated and completed before the application of power to the main drive motor. The gap 115 should be no wider than necessary to accommodate passage of the blades 100 and 105 into their deployed position while co-planar and parallel to one another. (Preferably the alteration of the pitch of the blades 100 and 105 occurs during deployment of the blades 100 and 105, after the blades 100 and 105 have passed through the gap 115 to a position outside the upper housing 120, and the light cover 130.)

In a variation, the gap 115 may be closed once the blades 100 and 105 reach a retracted position (in response to deactivation of the ceiling fan, with preferably such retraction being initiated upon the ceasing of movement of the deck about the main drive shaft). Such closing of the gap 115 may be achieved by moving the light cover 130 (or lower housing), relative to the upper housing 120, so as to close the gap 115. This may be, for example, be effected by the movement of the light cover 130 (or lower housing) in a generally upward direction (toward the ceiling) under the influence of a motive device, such as a motor, solenoid, a hydraulic cylinder, a pneumatic cylinder, or the like. In a further alternative embodiment, the upper housing 120 moves away from the ceiling, so as to close the gap 115, or a combination of movement of the upper housing 120 away from the ceiling, and movement of the light cover 130 (or lower housing) toward the ceiling may be employed to achieve closure of the gap 115.

Figure 3:
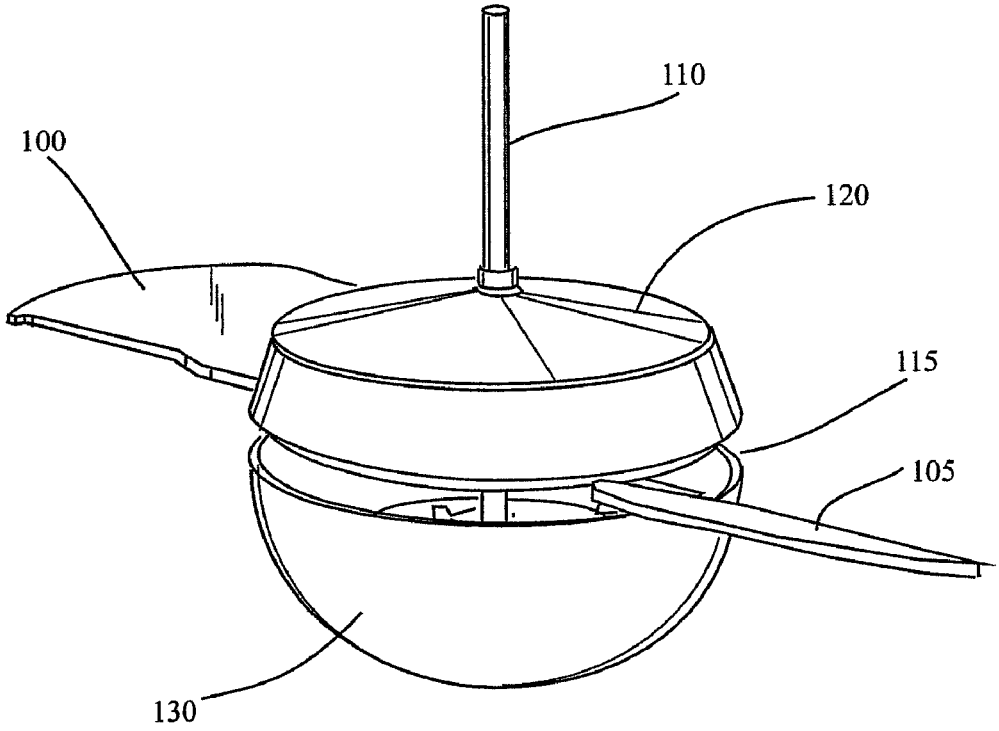
FIG. 3 is a perspective view of the ceiling fan in accordance with the embodiment of FIGS. 1 and 2 showing the plurality of actively deployable fan blades in a deployed (or use) position, and having their pitch altered for air movement.

Referring to FIG. 3, a perspective view is shown of the ceiling fan in accordance with the embodiment of FIGS. 1 and 2 showing the plurality of actively deployable fan blades 100 and 105 in a deployed (or use) position, and having their pitch altered for air movement. Shown is the support pole (or rod) 110, the upper housing 120, the light cover 130, the first blade shown 100 in a deployed position, and the second blade 105 showed in a deployed position.

The support pole (or rod) 110 is coupled at a distal end to the mounting surface, such as a ceiling of a room (not shown). The support pole (or rod) 110 is coupled at a proximal end to the upper housing 120. The upper housing 120 encloses a main drive shaft (not shown), a main drive motor (not shown), and a deck (not shown), which is turned about a main axis defined by the support pole (or rod) 110, the main drive shaft and the main drive motor in response to actuation of the main drive motor, such as by the application of power to the main drive motor by the activation of a wall switch (not shown), such as is known in the art. As the deck is turned (or rotated) the pair of blades 100 and 105 affixed thereto is likewise rotated.

Prior to rotation of the deck, the blades 100 and 105 may be deployed into a position so as to facilitate the movement of air in response to the rotation of the blades 100 and 105 Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. This deployment includes both rotation of the blades 100 and 105 about an axis parallel to the main axis (but not coaxial therewith), so as to move the blades from a stowed position to a deployed position, and the rotation of the blades about an axis substantially perpendicular (or otherwise not parallel (or otherwise off parallel, i.e., otherwise rotated to a position in a plane that is off perpendicular to the axis of rotation of the blades as they are rotated by the main drive motor about the main drive shaft) to the main axis (such as normal to the main axis), so as to alter the pitch of the blades 100 and 105 in order to facilitate movement of air by the blades 100 and 105 upon rotation of the blades 100 and 105 about the main axis. Alternatively, the blades 100 and 105 may slide radially (relative to the main axis) along a linear path into the deployed position, may slide radially and tangentially (relative to the main axis) along a linear path into the deployed position, or may move along a path defined by radial, tangential, and rotational paths, e.g., a non-linear path.

In any case, the blades 100 and 105 are preferably rotated about an axis substantially perpendicular (or otherwise off parallel, i.e., otherwise rotated to a position in a plane that is off perpendicular to the axis of rotation of the blades as they are rotated by the main drive motor about the main drive shaft) to the main axis, so as to alter the pitch of the blades 100 and 105 in order to facilitate movement of air by the blades 100 and 105 upon rotation of the blades 100 and 105 about the main axis. The path is selected in accordance with the optimal placement of the blades 100 and 105 for air movement, the shape of the blades 100 and 105, and the shape and size of the housing, as well as aesthetic factors. In accordance with the present embodiment, a light, such as an incandescent light bulb or a light emitting diode array, is positioned below the deck and affixed to the drive shaft, which is coaxial with the support pole (or rod) 110, so as to fix the light below the deck such that the light does not rotate in response to the turning of the main drive motor. The light cover 130 encloses the light, providing a measure of protection from, for example, dust, weather, or the like, and providing safety and aesthetically pleasing structures for the ceiling fan.

Alternatively, a lower housing element may be used in lieu of the light cover 130, in the event, in accordance with other embodiments, the light is not utilized. In such alternative embodiment the ceiling fan serves the single function of air movement, and does not serve as a light fixture.

A gap 115 is defined between the upper housing 120 and the light cover 130 (or lower housing) through which the blades 100 and 105 are deployed, for example, upon actuation. In accordance with one embodiment, this deployment is initiated and completed before the application of power to the main drive motor. The gap 115 should be no wider than necessary to accommodate passage of the blades 100 and 105 into their deployed position while co-planar and parallel to one another. (Preferably the alteration of the pitch of the blades 100 and 105 occurs during deployment of the blades 100 and 105, after the blades 100 and 105 have passed through the gap 115 to a position outside the upper housing 120, and the light cover 130.)

In an alternative, the pitch of the blades 100 and 105 may be fixed, with the gap 115 and the path being selected to permit deployment of the pre-pitched blades 100 and 105 into their deployed position.

In a variation, the gap 115 may be closed once the blades 100 and 105 reach a retracted position (in response to deactivation of the ceiling fan, with preferably such retraction being initiated upon the ceasing of movement of the deck about the main drive shaft). Such closing of the gap 115 may be achieved by moving the light cover 130, relative to the upper housing 120, so as to close the gap 115. This may be, for example, be effected by the movement of the light cover 130 in a generally upward direction (toward the ceiling) under the influence of a motive device, such as a motor, solenoid, a hydraulic cylinder, a pneumatic cylinder, or the like.

In a further alternative embodiment, the upper housing 120 moves away from the ceiling, so as to close the gap 115, or a combination of movement of the upper housing 120 away from the ceiling, and movement of the light cover 130 toward the ceiling may be employed to achieve closure of the gap 115.

Retraction of the blades 100 and 105 from the deployed position to the stowed position is effected by adjusting the pitch of the blades 100 and 105 so as to be co-planar and parallel to one another (assuming variable pitch), rotating (or otherwise moving the blades 100 and 105 along a reverse path of the path used to deploy the blades 100 and 105, so as to move the blades 100 and 105 through the gap 115 into the stowed position, and, optionally, closing the gap 115 by moving the upper housing 120 and/or the light cover 130 relative to one another, so as to close the gap 115.

Preferably the blades 100 and 105 are even in number, for example, two or four, however, there could be other numbers of blades in other embodiments of the invention, such as odd numbers of, e.g. 3 or 5.

Figure 4:
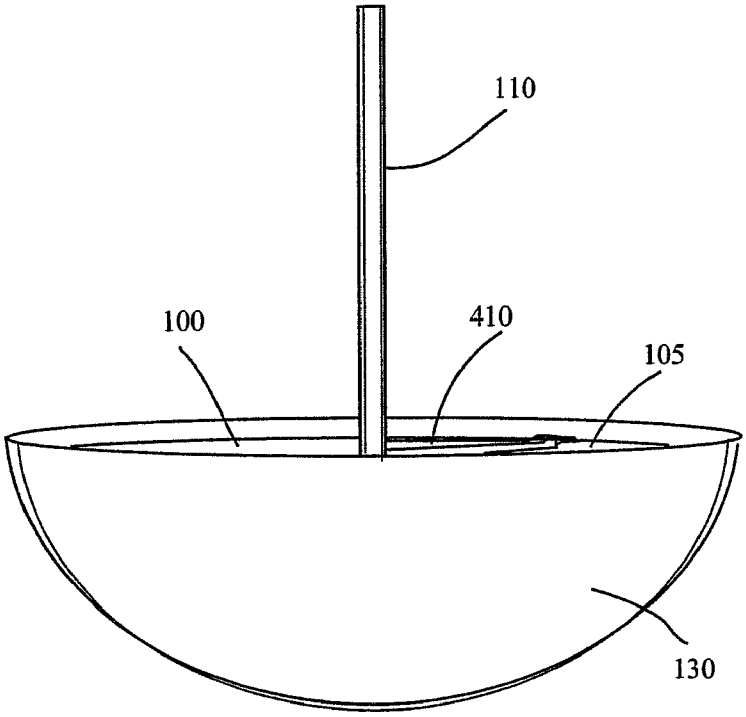
FIG. 4 is a perspective view of a ceiling fan in accordance with the present invention, varying from the embodiment shown in FIG. 1, showing the plurality of actively deployable fan blades in a stowed (or stored) position, and a light cover in a stowed (or stored) position.

Referring to FIG. 4, a perspective view is shown of a ceiling fan in accordance with the present invention, varying from the embodiment shown in FIG. 1, showing the plurality of actively deployable fan blades 100 and 105 in a stowed (or stored) position, and a light cover 130 in a stowed (or stored) position. Shown is a support pole (or rod) 110, a light cover 130, and a deck 410. The light cover 130 is shown in a stowed position, i.e., a raised position, whereby the deck 410 is concealed below an upper edge of the light cover 130. As can be seen, aesthetic appeal of the fixture is achieved by the concealment of the deck 410 below the upper edge of the light cover 130 when blades 100 and 105 of the ceiling fan, which are coupled to the deck 410, are in a stored position, when the fixture is viewed from a position generally below the upper edge of the light cover 130, as would typically be the case in most installations of the fixture.

The support pole (or rod) 110 is fixed at a distal end to a ceiling (not shown), and at a proximal end to a main drive shaft (not shown) concealed behind the light cover 130.

Figure 5:
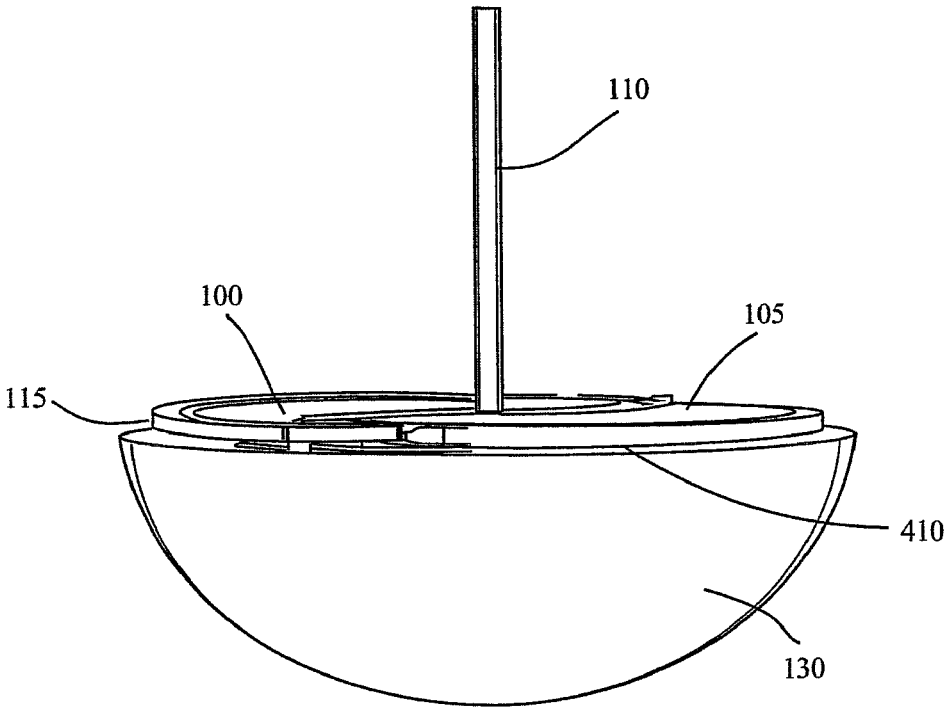
FIG. 5 is a perspective view of the ceiling fan in accordance with the embodiment of FIG. 4, showing the plurality of actively deployable fan blades in a stowed (or stored) position, and the light cover in a deployed (or use) position.

Referring to FIG. 5, a perspective view is shown of a ceiling fan in accordance with the embodiment of FIG. 4, showing the plurality of actively deployable fan blades 100 and 105 in a stowed (or stored) position, and the light cover 130 in a deployed (or use) position. Shown are the support pole (or rod) 110, the light cover 130, and the deck 410. The light cover 130 is shown in a lowered position, i.e., a deployed position, whereby the deck 410 is exposed above the upper edge of the light cover 130 sufficient to allow the deployment of the blades 100 and 105 from the deck 410. Preferably, the lowering of the light cover 130 is only to the degree necessary to facilitate deployment of the blades 100 and 105, whereby maximum aesthetic appeal is maintained during and after deployment of the blades 100 and 105.

This support pole (or rod) 110 is fixed at a distal end to a ceiling (not shown), and at a proximal end to a main drive shaft concealed behind the light cover 130. Upon actuation of the fixture (the ceiling fan), a motor is actuated, such as an electric motor, a solenoid, a hydraulic cylinder, a pneumatic cylinder, or the like, so as to lower the light cover 130 sufficient to allow deployment of the blades 100 and 105 from the deck 410 over the upper edge of the light cover 130.

Figure 6:
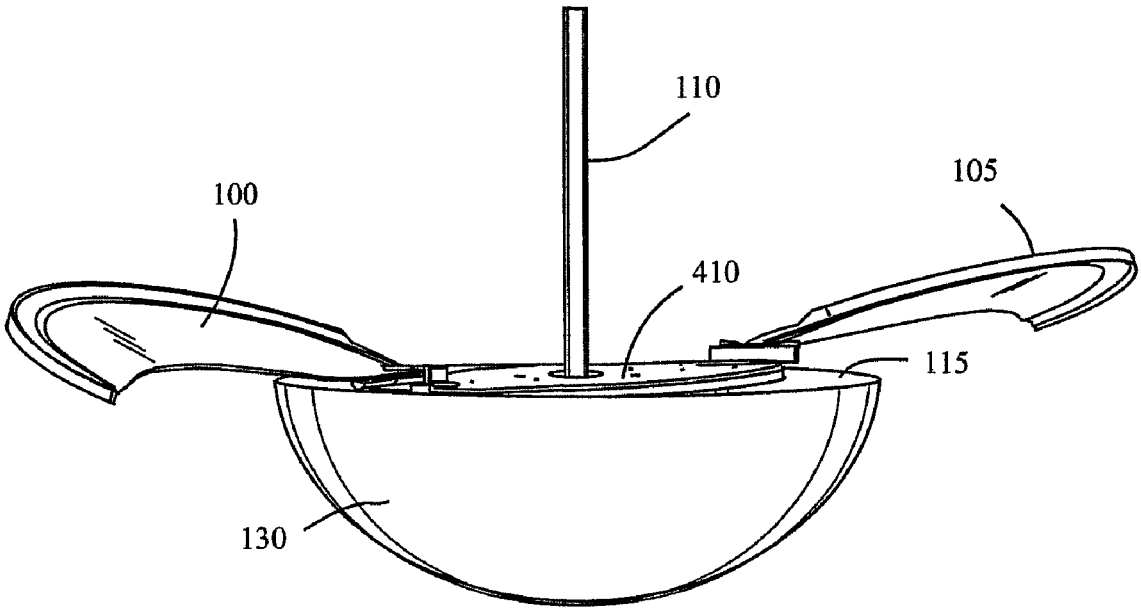
FIG. 6 is a perspective view of the ceiling fan in accordance with the embodiment of FIGS. 4 and 5 showing the plurality of actively deployable fan blades in a deployed (or use) position, and having their pitch altered for air movement.

Referring to FIG. 6, a perspective view is shown of a ceiling fan in accordance with the embodiment of FIGS. 4 and 5 showing the plurality of actively deployable fan blades 100 and 105 in a deployed (or use) position, and having their pitch altered for air movement. Shown is the support pole (or rod) 110, a light cover 130, and a deck 410. A light cover 130 is shown in the lowered position, i.e., a deployed position, whereby the deck 410 is exposed above the upper edge of the light cover 130 sufficient to allow the deployment of the blades 100 and 105 from the deck 410. Preferably, the lowering of the light cover 130 is only to the degree necessary to facilitate deployment of the blades 100 and 105, whereby maximum aesthetic appeal is maintained during and after deployment of the blades 100 and 105.

As can be seen, the blades 100 and 105 are each rotated away from the deck 410 along a respective axis (a separate deployment axis for each blade) substantially parallel to but not coaxial with a main axis of the ceiling fan, as defined by the support pole (or rod) 110, and a main drive shaft of the ceiling fan (not shown). In addition, the blades 100 and 105 are each further rotated into a pitched position along an axis (a separate pitching axis for each blade 100 and 105) that is substantially normal to the main axis of the ceiling fan (and the deployment axis of the blade). This positions the blades 100 and 105 for movement of air upon rotation of the blades 100 and 105 about the main axis (all blades 100 and 105 are simultaneously rotated about the main axis as the deck 410 is rotated about the main axis under the influence of the main drive motor affixed thereto) under the influence of a main drive motor (not shown). The main drive motor imparts a relative rotational movement about the main axis between the deck 410 and the blades 100 and 105 affixed thereto by deployment mechanisms and the main drive shaft to which the support pole, and the light cover 130 are affixed, Preferably, deployment of the blades 100 and 105 occurs before the blades 100 and 105 are rotated about the main axis under the influence of the main drive motor, including rotation of the blades 100 and 105 about their respective pitching axes.

Retraction of the blades 100 and 105 from the deployed position to the stowed position is effected by adjusting the pitch of the blades 100 and 105 so as to be co-planar and parallel to one another (assuming variable pitch), rotating (or otherwise moving the blades 100 and 105 along a reverse path of the path used to deploy the blades 100 and 105, so as to move the blades 100 and 105 through the gap 115 into the stowed position, and, optionally, closing the gap 115 by moving the upper housing and/or the light cover 130 relative to one another, so as to close the gap 115.

Alternatively, the blades 100 and 105 may slide radially (relative to the main axis) along a linear path into the deployed position, or may slide radially and tangentially (relative to the main axis) along a linear path into the deployed position, or may move along a path defined by radial, tangential, and rotational paths, e.g., a non-linear path. In any case, the blades 100 and 105 are preferably rotated about an axis substantially perpendicular to the main axis, so as to alter the pitch of the blades 100 and 105 in order to facilitate movement of air by the blades 100 and 105 upon rotation of the blades 100 and 105 about the main axis. The path is selected in accordance with the optimal placement of the blades 100 and 105 for air movement, the shape of the blades 100 and 105, and the shape and size of the housing, as well as aesthetic factors.

In accordance with the present embodiment, a light, such as an incandescent light bulb or a light emitting diode array, are positioned below the deck 410 and affixed to a main shaft (not shown), that is coaxial with the support pole (or rod) 110, so as to fix the light below the deck 410 such that the light does not rotate in response to the turning of the main drive motor. The light cover 130 encloses the light, providing a measure of protection from, for example, dust, weather, or the like, and providing safety and aesthetically pleasing structures for the ceiling fan. Alternatively, a lower fan housing element may be used in lieu of the light cover 130, in the event, in accordance with other embodiments, the light is not utilized. In such alternative embodiment the ceiling fan serves the single function of air movement, and does not serve as a light fixture.

In variations of the present embodiment, the blade support structure or housing elements need not move in order to conceal the blades 100 and 105. The blades 100 and 105 themselves are designed to blend into the housing while in the stowed position.

Figure 7:
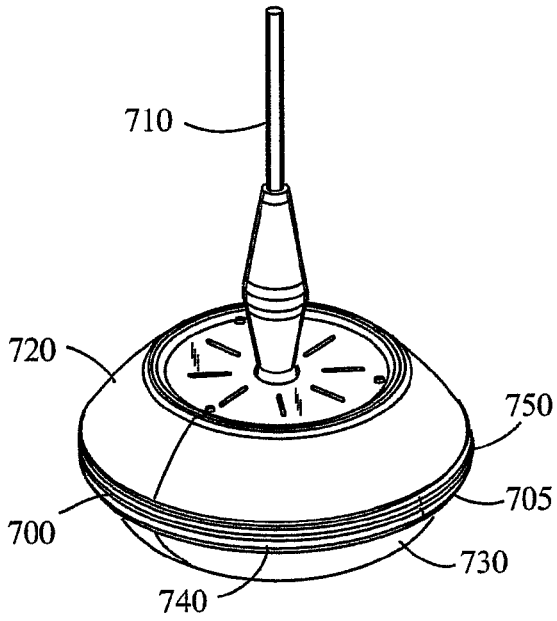
FIG. 7 is a perspective view of a ceiling fan in accordance with the present invention, varying further from the embodiment shown in FIG. 1, showing the plurality of actively deployable fan blades in a stowed (or stored) position.

Referring to FIG. 7, a perspective view is shown of a ceiling fan in accordance with the present invention, varying further from the embodiment shown in FIG. 1, showing the plurality of actively deployable fan blades 700 and 705 in a stowed (or stored) position. Shown are a support pole (or rod) 710, an upper housing 720, a light cover 730, and a trim piece 740.

The support pole (or rod) 710 is coupled at a distal end to a mounting surface, such as a ceiling of a room (not shown). The support pole (or rod) 710 is coupled at a proximal end to the upper housing 720. The upper housing 720 encloses a main drive shaft, a main drive motor, and a deck, which is turned about a main axis defined by the support pole (or rod) 710, the main drive shaft and the main drive motor in response to actuation of the main drive motor, such as by the application of power to the main drive motor by the activation of a wall switch, such as is known in the art. As the deck is turned (or rotated) a pair of blades 700 and 705 affixed thereto is likewise rotated.

Prior to rotation of the deck, the blades 700 and 705 may be deployed into a position so as to facilitate the movement of air in response to the rotation of the blades 700 and 705. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. In accordance with the present embodiment, a light, such as an incandescent light bulb or a light emitting diode array, are positioned below the deck and affixed to a main shaft, that is coaxial with the support pole (or rod) 710, so as to fix the light below the deck such that the light does not rotate in response to the turning of the main drive motor. The light cover 730 encloses the light, providing a measure of protection from, for example, dust, weather, or the like, and providing safety and aesthetically pleasing structure for the ceiling fan.

Alternatively, a lower housing element may be used in lieu of the light cover 730, in the event, in accordance with other embodiments, the light is not utilized. In such alternative embodiment the ceiling fan serves the single function of air movement, and does not serve as a light fixture.

A gap 750 is defined between the upper housing 720 and the light cover 730 (or lower fan housing) through which the blades 700 and 705 are deployed, for example, upon actuation. The gap 750 should be no wider than necessary to accommodate passage of the blades 700 and 705 into their deployed position while co-planar and parallel to one another.

As shown, a decorative trim piece 740 covers the gap 750 when the blades 700 and 705 are in the stowed position, so as to create a consistent and aesthetically pleasing appearance for an exterior of the ceiling fan when the blades 700 and 705 are in the stowed position. Optimally, in accordance with one variation of the present embodiment, the ceiling fan should have an outward appearance to an ordinary observer of being merely a lighting fixture, and not, in particular, a ceiling fan. The trim piece 740 creates a generally continuous and aesthetically pleasing appearance, in part because it visually couples the upper housing 720 to the light cover 730 (or lower housing) when the blades 700 and 705 are in the stowed position.

Advantageously, the trim piece 740 is divided into a number of sections, for example, two, equal to the number of blades 700 and 705 that are concealed immediately behind the trim piece 740. In accordance with one variation, the trim piece 740 sections are not mechanically coupled to the upper housing 720 or to the light cover 730 (or lower housing). Instead, the trim piece 740 sections are coupled to respective leading edges of the blades 700 and 705, so that as the blades 700 and 705 move from the stowed position (or retracted position) to the deployed position, the trim piece 740 sections are moved from their positions spanning the gap 750 (between the upper housing 720 and the light cover 730) so as to expose the gap 750, and allow deployment of the blades 700 and 705. The trim piece 740 sections are selected so as not to interfere substantially with effective movement of air by the blades 700 and 705 when the blades 700 and 705 are in the deployed position, including the pitching of the blades 700 and 705, and are rotated by the main drive motor about the main drive axis, as the main drive motor rotates the deck within the upper housing 720 and the light cover 730.

Figure 8:
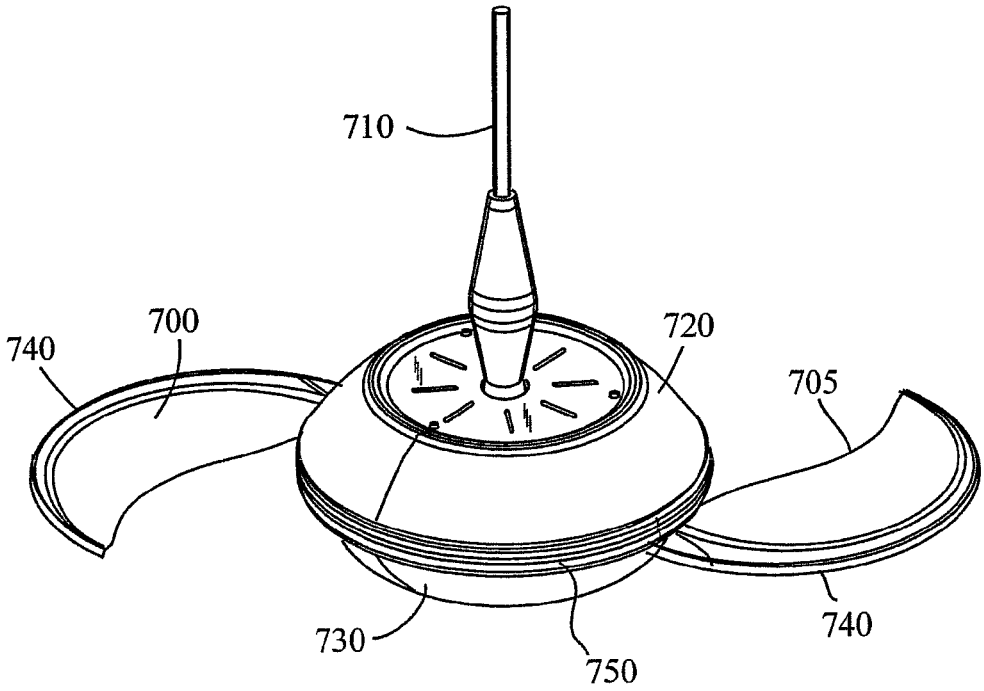
FIG. 8 is a perspective view of the ceiling fan in accordance with the embodiment of FIG. 7 showing the plurality of actively deployable fan blades in a deployed (or use) position.

Referring to FIG. 8, a perspective view is shown of the ceiling fan in accordance with the embodiment of FIG. 7 showing the plurality of actively deployable blades 700 and 705 in a deployed (or use) position.

The support pole (or rod) 710 is coupled at a distal end to the mounting surface, such as a ceiling of a room (not shown).

The support pole (or rod) 710 is coupled at a proximal end to the upper housing 720. The upper housing 720 encloses a main drive shaft, a main drive motor, and a deck, which is turned about a main axis defined by the support pole (or rod) 710, the main drive shaft and the main drive motor in response to actuation of the main drive motor, such as by the application of power to the main drive motor by the activation of a wall switch, such as is known in the art. As the deck is turned (or rotated) a pair of blades 700 and 705 affixed thereto is likewise rotated.

Prior to rotation of the deck, the blades 700 and 705 may be deployed into a position so as to facilitate the movement of air in response to the rotation of the blades 700 and 705. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. This deployment includes both rotation of the blades 700 and 705 about an axis parallel to the main axis (but not coaxial therewith), so as to move the blades 700 and 705 from a stowed position to a deployed position, and the rotation of the blades 700 and 705 about an axis substantially perpendicular (or otherwise not parallel (or otherwise off parallel, i.e., otherwise rotated to a position in a plane that is off perpendicular to the axis of rotation of the blades as they are rotated by the main drive motor about the main drive shaft) to the main axis, so as to alter the pitch of the blades 700 and 705 in order to facilitate movement of air by the blades 700 and 705 upon rotation of the blades 700 and 705 about the main axis.

In accordance with the present embodiment, a light, such as an incandescent light bulb or a light emitting diode array, is positioned below the deck and affixed to the drive shaft, which is coaxial with the support pole (or rod) 710, so as to fix the light below the deck such that the light does not rotate in response to the turning of the main drive motor. The light cover 730 encloses the light, providing a measure of protection from, for example, dust, weather, or the like, and providing and aesthetically pleasing structure for the ceiling fan.

Alternatively, a lower fan housing element may be used in lieu of the light cover 730, in the event and in accordance with other embodiments, the light is not utilized. In such alternative embodiment the ceiling fan serves the single function of air movement, and does not serve as a light fixture.

A gap 750 is defined between the upper housing 720 and the light cover 730 (or lower fan housing) through which the blades 700 and 705 are deployed, for example, upon actuation. In accordance with one embodiment, this deployment is initiated and completed before the application of power to the main drive motor. The gap 750 should be no wider than necessary to accommodate passage of the blades 700 and 705 into their deployed position while co-planar and parallel to one another. (Preferably the alteration of the pitch of the blades 700 and 705 occurs during deployment of the blades 700 and 705, after the blades 700 and 705 have passed through the gap 750 to a position outside the upper housing 720, and the light cover 730.)

As shown, a decorative trim piece 740 that covers the gap 750 when the blades 700 and 705 are in the stowed position, so as to create a consistent, and aesthetically pleasing appearance for an exterior of the ceiling fan when the blades 700 and 705 are in the stowed position, is shown in two sections deployed along leading edges of the blades 700 and 705. Optimally, in accordance with one variation of the present embodiment, the ceiling fan should have (when the blades 700 and 705 are in the stowed position) an outward appearance to an ordinary observer of being merely a lighting fixture, and not, in particular, a ceiling fan. When the blades 700 and 705 are in the stowed position, the trim piece 740 creates a generally continuous and aesthetically pleasing appearance, in part because it visually couples the upper housing 720 to the light cover 730 (or lower housing) when the blades 700 and 705 are in the stowed position.

Advantageously, the trim piece 740 is divided into a number of sections, for example, two, equal to the number of blades 700 and 705 that are concealed immediately behind the trim piece 740. In accordance with one variation, the trim piece 740 sections are not mechanically coupled to the upper housing 720 or to the light cover 730 (or lower housing). Instead, the trim piece 740 sections are coupled to respective leading edges of the blades 700 and 705, so that as the blades 700 and 705 move from the stowed position (or retracted position) to the deployed position, the trim piece 740 sections are moved from their positions spanning the gap 750 (between the upper housing 720 and the light cover 730) so as to expose the gap 750, and allow deployment of the blades 700 and 705. The trim piece 740 sections are selected so as not to interfere substantially with effective movement of air by the blades 700 and 705 when the blades 700 and 705 are in the deployed position, including the pitching of the blades 700 and 705, and are rotated by the main drive motor about the main drive axis, as the main drive motor rotates the deck within the upper housing 720 and the light cover 730.

In a variation, the gap 750 may be partially closed (if, for example, the trim piece 740 do not complete span the gap 750 between the upper housing 720 and the light cover 730 when the blades 700 and 705 are in a stowed position) once the blades 700 and 705 reach a stowed position (in response to deactivation of the ceiling fan, with preferably such retraction being initiated upon the ceasing of movement of the deck about the main drive shaft). Such partial closing of the gap 750 may be achieved by moving the upper housing 720, relative to the light cover 730, so as to close the gap 750. This may be, for example, be effected by the movement of the light cover 730 in a generally upward direction (toward the ceiling) under the influence of a motive device, such as a motor, solenoid, a hydraulic cylinder, a pneumatic cylinder, or the like.

In a further alternative embodiment, the upper housing 720 is moved away from the ceiling, so as to partially close the gap 750, or a combination of movement of the upper housing 720 away from the ceiling, and movement of the light cover 730 toward the ceiling may be employed to achieve closure of the gap 750.

Figure 9:
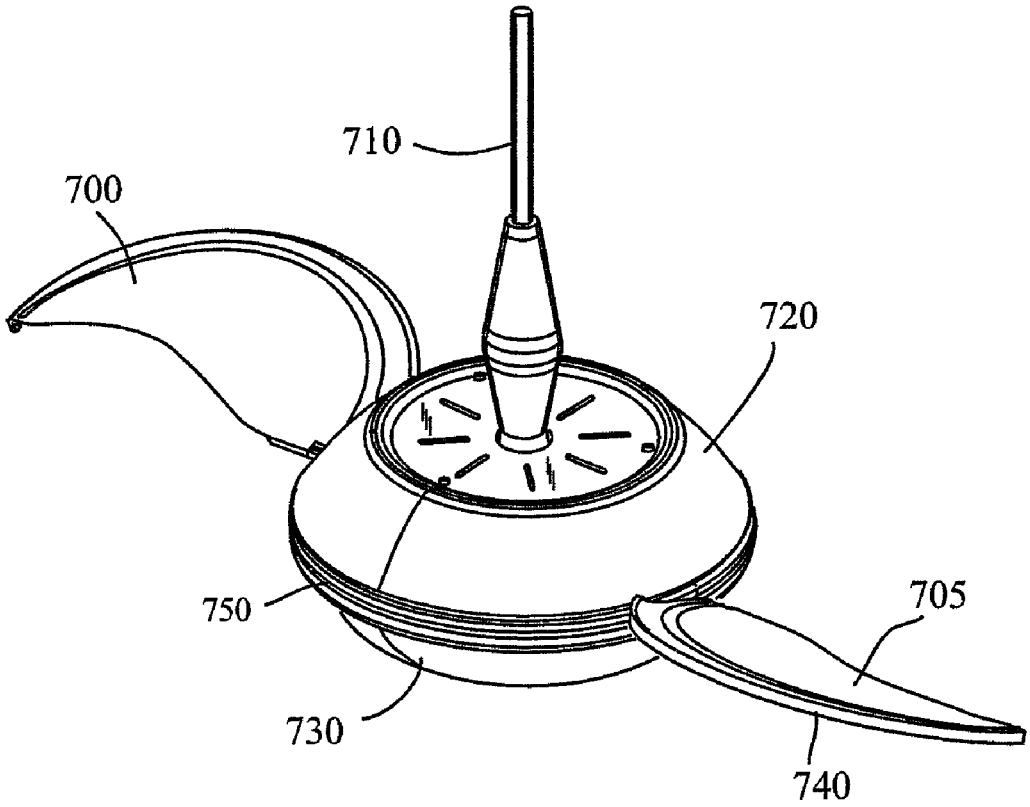
FIG. 9 is a perspective view of the ceiling fan in accordance with the embodiment of FIG. 8 showing the plurality of actively deployable fan blades in the deployed (or use) position, and having their pitch altered for air movement.

Referring to FIG. 9, a perspective view is shown of the ceiling fan in accordance with the embodiment of FIG. 8 showing the plurality of actively deployable fan blades 700 and 705 in the deployed (or use) position, and having their pitch altered for air movement.

The support pole (or rod) 710 is coupled at a distal end to the mounting surface, such as a ceiling of a room (not shown). The support pole (or rod) 710 is coupled at a proximal end to the upper housing 720. The upper housing 720 encloses a main drive shaft, a main drive motor, and a deck, which is turned about a main axis defined by the support pole (or rod) 710, the main drive shaft and the main drive motor in response to actuation of the main drive motor, such as by the application of power to the main drive motor by the activation of a wall switch, such as is known in the art. As the deck is turned (or rotated) a pair of blades 700 and 705 affixed thereto is likewise rotated.

Prior to rotation of the deck, the blades 700 and 705 may be deployed into a position so as to facilitate the movement of air in response to the rotation of the blades 700 and 705. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. This deployment includes both rotation of the blades 700 and 705 about an axis parallel to the main axis (but not coaxial therewith), so as to move the blades 700 and 705 from a stowed position to a deployed position, and the rotation of the blades 700 and 705 about an axis substantially perpendicular (or otherwise not parallel (or otherwise off parallel, i.e., otherwise rotated to a position in a plane that is off perpendicular to the axis of rotation of the blades as they are rotated by the main drive motor about the main drive shaft) to the main axis (such as normal to the main axis), so as to alter the pitch of the blades 700 and 705 in order to facilitate movement of air by the blades 700 and 705 upon rotation of the blades 700 and 705 about the main axis. Alternatively, the blades 700 and 705 may slide radially (relative to the main axis) along a linear path into the deployed position, may slide radially and tangentially (relative to the main axis) along a linear path into the deployed position, or may move along a path defined by radial, tangential, and rotational paths, e.g., a non-linear path.

In any case, the blades 700 and 705 are preferably rotated about an axis substantially perpendicular to the main axis, so as to alter the pitch of the blades 700 and 705 in order to facilitate movement of air by the blades 700 and 705 upon rotation of the blades 700 and 705 about the main axis. The path is selected in accordance with the optimal placement of the blades 700 and 705 for air movement, the shape of the blades 700 and 705, and the shape and size of the housing, as well as aesthetic factors. In accordance with the present embodiment, a light, such as an incandescent light bulb, or light emitting diode array is positioned below the deck and affixed to the drive shaft, which is coaxial with the support pole (or rod) 710, so as to fix the light below the deck such that the light does not rotate in response to the turning of the main drive motor. The light cover 730 encloses the light, providing a measure of protection from, for example, dust, weather, or the like, and providing and aesthetically pleasing structure for the ceiling fan.

Alternatively, a lower fan housing element may be used in lieu of the light cover 730, in the event, in accordance with other embodiments, the light is not utilized. In such alternative embodiment the ceiling fan serves the single function of air movement, and does not serve as a light fixture.

A gap 750 is defined between the upper housing and the light cover 730 (or lower housing) through which the blades 700 and 705 are deployed, for example, upon actuation. In accordance with one embodiment, this deployment is initiated and completed before the application of power to the main drive motor. The gap 750 should be no wider than necessary to accommodate passage of the blades 700 and 705 into their deployed position while co-planar and parallel to one another. (Preferably the alteration of the pitch of the blades 700 and 705 occurs during deployment of the blades 700 and 705, after the blades 700 and 705 have passed through the gap 750 to a position outside the upper housing, and the light cover 730.)

Preferably, in accordance with the present variation of the present embodiment, the gap 750 should be no wider than necessary to accommodate passage of the blades 700 and 705 into their deployed position while, for example, co-planar and parallel to one another. (Preferably the alteration of the pitch of the blades 700 and 705 occurs during deployment of the blades 700 and 705, after the blades 700 and 705 have passed through the gap 750 to a position outside the upper housing 720, and the light cover 730.) As shown, a decorative trim piece 740 that covers the gap 750 when the blades 700 and 705 are in the stowed position, so as to create a consistent, and aesthetically pleasing appearance for an exterior of the ceiling fan when the blades 700 and 705 are in the stowed position, is shown in two sections deployed along leading edges of the blades 700 and 705. Optimally, in accordance with one variation of the present embodiment, the ceiling fan should have (when the blades 700 and 705 are in the stowed position) an outward appearance to an ordinary observer of being merely a lighting fixture, and not, in particular, a ceiling fan. When the blades 700 and 705 are in the stowed position, the trim piece 740 creates a generally continuous and aesthetically pleasing appearance, in part because it visually couples the upper housing 720 to the light cover 730 (or lower housing) when the blades 700 and 705 are in the stowed position.

Advantageously, the trim piece 740 is divided into a number of sections, for example, two, equal to the number of blades 700 and 705 that are concealed immediately behind the trim piece 740. In accordance with one variation, the trim piece 740 sections are not mechanically coupled to the upper housing 720 or to the light cover 730 (or lower housing). Instead, the trim piece 740 sections are coupled to respective leading edges of the blades 700 and 705, so that as the blades 700 and 705 move from the stowed position (or retracted position) to the deployed position, the trim piece 740 sections are moved from their positions spanning the gap 750 (between the upper housing 720 an the light cover 730) so as to expose the gap 750, and allow deployment of the blades 700 and 705. The trim piece 740 sections are selected so as not to interfere substantially with effective movement of air by the blades 700 and 705 when the blades 700 and 705 are in the deployed position, including the pitching of the blades 700 and 705, and are rotated by the main drive motor about the main drive axis, as the main drive motor rotates the deck within the upper housing 720 and the light cover 730.

In a variation, the gap 750 may be partially closed (if, for example, the trim piece 740 do not complete span the gap 750 between the upper housing 720 and the light cover 730 when the blades 700 and 705 are in a stowed position) once the blades 700 and 705 reach a stowed position (in response to deactivation of the ceiling fan, with preferably such retraction being initiated upon the ceasing of movement of the deck about the main drive shaft). Such partial closing of the gap 750 may be achieved by moving the upper housing 720, relative to the light cover 730, so as to close the gap 750. This may be, for example, be effected by the movement of the light cover 730 in a generally upward direction (toward the ceiling) under the influence of a motive device, such as a motor, solenoid, a hydraulic cylinder, a pneumatic cylinder, or the like.

In a further alternative embodiment, the upper housing 720 is moved away from the ceiling, so as to partially close the gap 750, or a combination of movement of the upper housing 720 away from the ceiling, and movement of the light cover 730 toward the ceiling may be employed to achieve closure of the gap 750.

In an alternative, the pitch of the blades 700 and 705 may be fixed, with the gap 750 and the path being selected to permit deployment of the pre-pitched blades 700 and 705 into their deployed position. In accordance with this alternative, the trim piece 740 is selected to have a width that spans the entire gap 750, which may be substantially wider than when the pitch of the blades 700 and 705 can be varied.

Retraction of the blades 700 and 705 from the deployed position to the stowed position is effected by adjusting the pitch of the blades 700 and 705 so as to be co-planar and parallel to one another (assuming variable pitch), rotating (or otherwise moving the blades 700 and 705 along a reverse path of the path used to deploy the blades 700 and 705, so as to move the blades 700 and 705 through the gap 750 into the stowed position, and, optionally, closing the gap 750 by moving the upper housing 720 and/or the light cover 730 relative to one another, so as to close the gap 750.

Preferably the blades 700 and 705 are even in number, for example, two or four; however, there could be other numbers of blades 700 and 705 in other embodiments of the invention, such as odd numbers of blades 700 and 705, e.g., 3 or 5.

The present embodiment shows one way in which edge details of the blades 700 and 705 (trim piece 740 on the leading edges of the blades 700 and 705 of the ceiling fan) may be designed to match decorative details of the fan housing. In another embodiment of the invention, a larger part of the blade shape may be configured to match the fan housing, and in an extreme example of this, one entire surface of the fan blade may be selected to span a gap 750 between, for example, the upper housing 720 and the light cover 730 when in a retracted position, or may form the upper housing 720 when in the retracted position.

Figure 10:
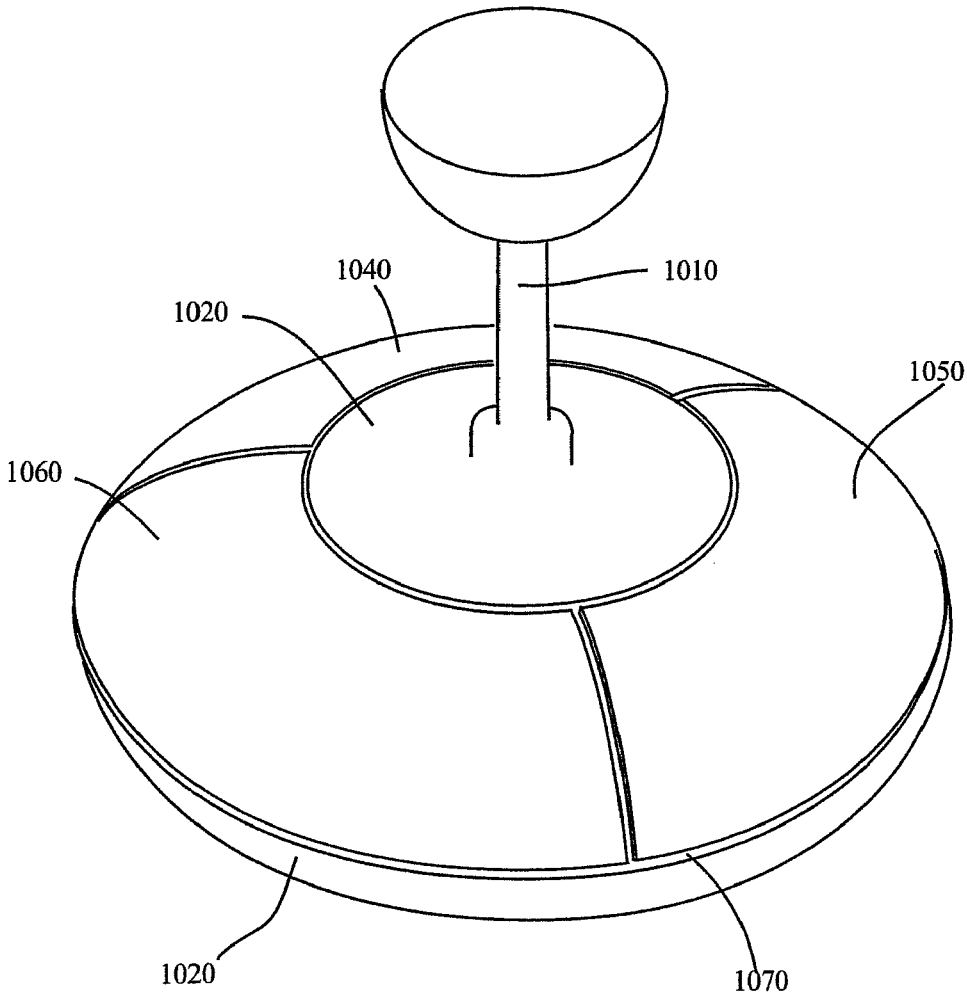
FIG. 10 is a perspective view of a ceiling fan in accordance with the present invention, varying yet further from the embodiment shown in FIG. 1, showing the plurality of actively deployable fan blades in a stowed (or storage) position.

Referring to FIG. 10, a perspective view is shown of the ceiling fan in accordance with the present invention, varying yet further from the embodiment shown in FIG. 1, showing the plurality of actively deployable fan blades 1040, 1050, and 1060 in a stowed (or storage) position. Shown are a support pole (or rod) 1010, an upper housing 1020, a light cover 1030, a first blade 1040, a second blade 1050 and a third blade 1060.

The support pole (or rod) 1010 is coupled at a distal end to a mounting surface, such as a ceiling of a room (not shown). The support pole (or rod) 1010 is coupled at a proximal end to the upper housing 1020. The upper housing 1020 encloses a main drive shaft (not shown), a main drive motor (not shown), and a deck (not shown), which is turned about a main axis defined by the support pole (or rod) 1010, the main drive shaft and the main drive motor in response to actuation of the main drive motor, such as by the application of power to the main drive motor by the activation of a wall switch, such as is known in the art. As the deck is turned (or rotated) the first blade 1040, the second blade 1050 and the third blade 1060 affixed thereto are likewise rotated.

Prior to rotation of the deck, the blades 1040, 1050, and 1060 may be deployed into a position so as to facilitate the movement of air in response to the rotation of the blades 1040, 1050, and 1060. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. In accordance with the present embodiment, a light, such as an incandescent light bulb, or light emitting diode array are positioned below the deck and affixed to a main shaft, that is coaxial with the support pole (or rod) 1010, so as to fix the light below the deck such that the light does not rotate in response to the turning of the main drive motor. The light cover 1030 encloses the light, providing a measure of protection from, for example, dust, weather, or the like, and providing an aesthetically pleasing structure for the ceiling fan.

Alternatively, a lower fan housing element may be used in lieu of the light cover 1030, in the event, in accordance with other embodiments, the light is not utilized. In such alternative embodiment the ceiling fan serves the single function of air movement, and does not serve as a light fixture.

A gap 1070 is defined between the upper housing 1020 and the light cover 1030 (or lower fan housing) from which the blades 1040, 1050, and 1060 are deployed, for example, upon actuation. The gap 1070, in accordance with the present embodiment is defined by the width of the blades 1040, 1050, and 1060 and vice versa.

As shown, a decorative upper surface of the blades 1040, 1050, and 1060 covers the gap 1070 when the blades 1040, 1050, and 1060 are in the stowed position, so as to create a consistent and aesthetically pleasing appearance for an exterior of the ceiling fan when the blades 1040, 1050, and 1060 are in the stowed position. (The present embodiment may be referred to herein as a "beetle wing" design, due to the resemblance between the blades 1040, 1050, and 1060, when nested across the gap 1070, and adjacent to one another so as to form a continuous upper surface of the ceiling fan fixture when the blades 1040, 1050, and 1060 are in the stowed position (or retracted position). Optimally, in accordance with one variation of the present embodiment, the ceiling fan should have an outward appearance to an ordinary observer of being merely a lighting fixture, and not, in particular, a ceiling fan. The decorative upper surfaces of the blades 1040, 1050, and 1060 create a generally continuous and aesthetically pleasing appearance, in part because they visually couple the upper housing 1020 to the light cover 1030 (or lower housing) when the blades 1040, 1050, and 1060 are in the stowed position.

Advantageously, the upper surfaces of the blades 1040, 1050, and 1060 define a number of sections of the continuous upper surface of the ceiling fan, for example, three, equal to the number of blades 1040, 1050, and 1060.

Figure 11:
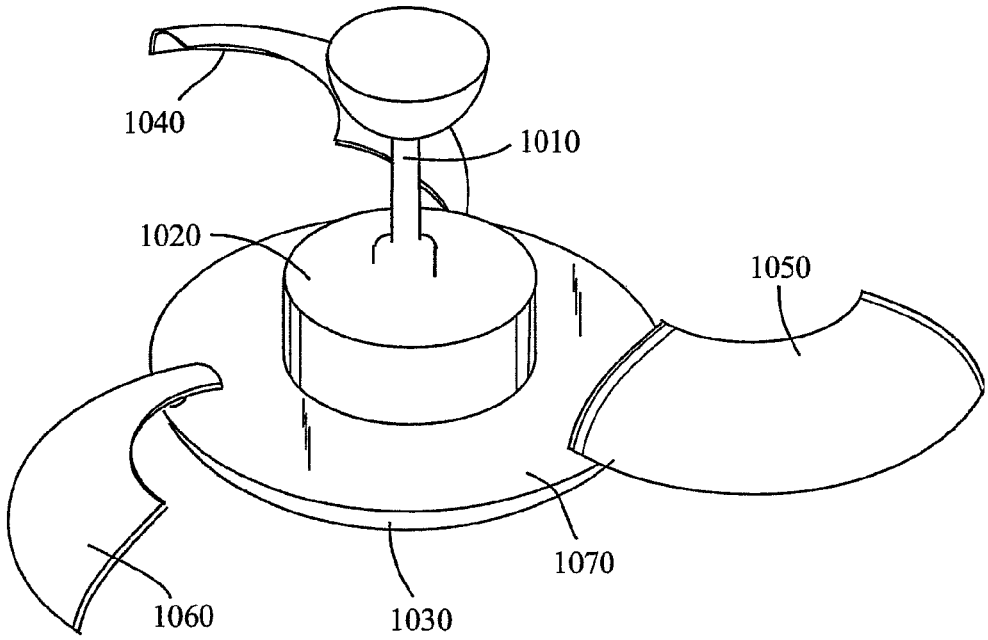
FIG. 11 is a perspective view of the ceiling fan in accordance with the embodiment of FIG. 10 showing the plurality of actively deployable fan blades in the deployed (or use) position, and having their pitch altered for air movement.

Referring to FIG. 11, a perspective view is shown of the ceiling fan in accordance with the embodiment of FIG. 10 showing the plurality of actively deployable blades 1040, 1050, and 1060 in the deployed (or use) position.

The support pole (or rod) 1010 is coupled at a distal end to the mounting surface, such as a ceiling of a room (not shown). The support pole (or rod) 1010 is coupled at a proximal end to the upper housing 1020. The upper housing 1020 encloses a main drive shaft, a main drive motor, and a deck, which is turned about a main axis defined by the support pole (or rod) 1010, the main drive shaft and the main drive motor in response to actuation of the main drive motor, such as by the application of power to the main drive motor by the activation of a wall switch (not shown), such as is known in the art. As the deck is turned (or rotated) a plurality of blades 1040, 1050, and 1060 affixed thereto is likewise rotated.

Prior to rotation of the deck, the blades 1040, 1050, and 1060 may be deployed into a position so as to facilitate the movement of air in response to the rotation of the blades 1040, 1050, and 1060. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. This deployment includes rotation of the blades 1040, 1050, and 1060 about an axis parallel to the main axis (but not coaxial therewith), so as to move the blades 1040, 1050, and 1060 from a stowed position to a deployed position.

In accordance with the present embodiment, a light, such as an incandescent light bulb or a light emitting diode array, is positioned below the deck and affixed to the drive shaft, which is coaxial with the support pole (or rod) 1010, so as to fix the light below the deck such that the light does not rotate in response to the turning of the main drive motor. The light cover 1030 encloses the light, providing a measure of protection from, for example, dust, weather, or the like, and providing an aesthetically pleasing structure for the ceiling fan.

Alternatively, a lower fan housing element may be used in lieu of the light cover 1030, in the event, in accordance with other embodiments, the light is not utilized. In such alternative embodiment the ceiling fan serves the single function of air movement, and does not serve as a light fixture.

A gap 1070 is defined between the upper housing 1020 and the light cover 1030 (or lower fan housing) from which the blades 1040, 1050, and 1060 are deployed, for example, upon actuation. In accordance with one embodiment, this deployment is initiated and completed before the application of power to the main drive motor.

As shown, a decorative upper surface of the blades 1040, 1050, and 1060 covers the gap 1070 when the blades 1040, 1050, and 1060 are in the stowed position, so as to create a consistent and aesthetically pleasing appearance for an exterior of the ceiling fan when the blades 1040, 1050, and 1060 are in the stowed position. (The present embodiment may be referred to herein as a "beetle wing" design, due to the resemblance between the blades 1040, 1050, and 1060, when nested across the gap 1070, and adjacent to one another so as to form a continuous upper surface of the ceiling fan fixture when the blades 1040, 1050, and 1060 are in the stowed position (or retracted position). Optimally, in accordance with one variation of the present embodiment, the ceiling fan should have an outward appearance to an ordinary observer of being merely a lighting fixture, and not, in particular, a ceiling fan. The decorative upper surfaces of the blades 1040, 1050, and 1060 create a generally continuous and aesthetically pleasing appearance, in part because they visually couple the upper housing 1020 to the light cover 1030 (or lower housing) when the blades 1040, 1050, and 1060 are in the stowed position.

Advantageously, the upper surfaces of the blades 1040, 1050, and 1060 define a number of sections of the continuous upper surface of the ceiling fan, for example, three, equal to the number of blades 1040, 1050, and 1060.

In a variation, the gap 1070 may be partially closed (if, for example, the blades 1040, 1050, and 1060 do not completely span the gap 1070 between the upper housing 1020 and the light cover 1030 when the blades 1040, 1050, and 1060 are in a stowed position) once the blades 1040, 1050, and 1060 reach a stowed position (in response to deactivation of the ceiling fan, with preferably such retraction being initiated upon the ceasing of movement of the deck about the main drive shaft). Such partial closing of the gap 1070 may be achieved by moving the upper housing 1020, relative to the light cover 1030, so as to close the gap 1070. This may be, for example, be effected by the movement of the light cover 1030 in a generally upward direction (toward the ceiling) under the influence of a motive device, such as a motor, solenoid, a hydraulic cylinder, a pneumatic cylinder, or the like.

In a further alternative embodiment, the upper housing 1020 is moves away from the ceiling, so as to partially close the gap 1070, or a combination of movement of the upper housing 1020 away from the ceiling, and movement of the light cover 1030 toward the ceiling may be employed to achieve closure of the gap 1070.

Figure 12:
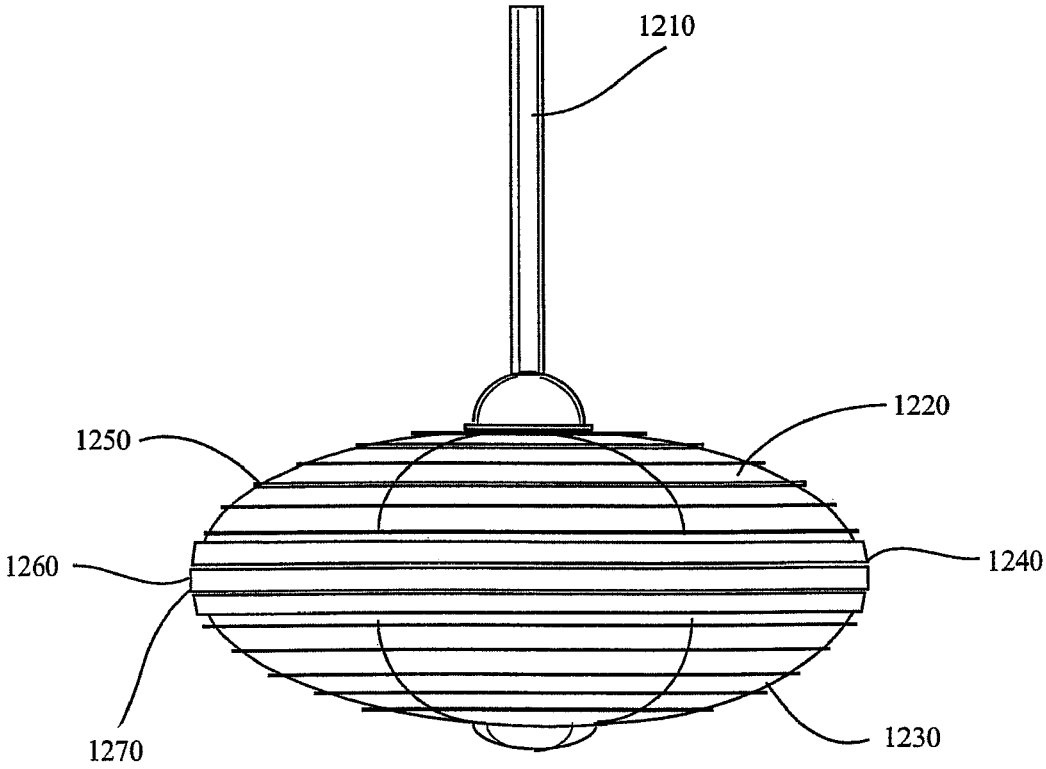
FIG. 12 is a side view of a variation of the ceiling fan of the embodiment of FIGS. 1 and 2 showing the plurality of actively deployable fan blades in the stowed (or stored position).

Referring to FIG. 12, a side view is shown of a variation of the ceiling fan of the embodiment of FIGS. 1 and 2 showing the plurality of actively deployable blades 1240 in the stowed (or stored position). Shown are a support pole (or rod) 1210, an upper housing 1220, a light cover 1230, and a trim piece 1270.

The support pole (or rod) 1210 is coupled at a distal end to the mounting surface, such as the ceiling of a room (not shown). The support pole (or rod) 1210 is coupled at a proximal end to the upper housing 1220. The upper housing 1220 encloses a main drive shaft (not shown), a main drive motor (not shown), and a deck (not shown), which is turned about a main axis defined by the support pole (or rod) 1210, the main drive shaft and the main drive motor in response to actuation of the main drive motor, such as by the application of power to the main drive motor by the activation of a wall switch (not shown), such as is known in the art. As the deck is turned (or rotated) the pair of blades 1240 affixed thereto is likewise rotated.

Prior to rotation of the deck, the blades 1240 may be deployed into a position so as to facilitate the movement of air in response to the rotation of the blades 1240. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed.

In accordance with the present embodiment, a light, such as an incandescent light bulb or a light emitting diode array, are positioned below the deck and affixed to a main drive shaft, that is coaxial with the support pole (or rod) 1210, so as to fix the light below the deck such that the light does not rotate in response to the turning of the main drive motor. The light cover encloses the light, providing a measure of protection from, for example, dust, weather, or the like, and providing safety and an aesthetically pleasing structure for the ceiling fan.

Alternatively, a lower housing element may be used in lieu of the light cover, in the event, in accordance with other embodiments, the light is not utilized. In such alternative embodiment the ceiling fan serves the single function of air movement, and does not serve as a light fixture.

Further, alternatively, an upper light cover may be used in lieu of the upper housing 1220, in which case a second light, such as a second incandescent light bulb, or second light emitting diode array are positioned above the deck and affixed to the main drive shaft, so as to fix the second light above the deck such that the light does not rotate in response to the turning of the main drive motor. The second light cover 1230 encloses the second light, providing a measure of protection from, for example, dust, weather, or the like, and providing safety and an aesthetically pleasing structure for the ceiling fan.

As shown, another feature that may be incorporated into the present embodiment is a decorative wire cage 1250 enveloping the light cover 1230 (or lower housing), and the second light cover 1230 (or upper housing 1220). In addition to providing a decorative element, the wire cage 1250 can provide a further measure of protection for the light cover 1230 (or lower housing) and the second light cover 1230 (or upper housing 1220).

A gap 1260 is defined between the upper housing 1220 (or second light cover 1230) and the light cover 1230 (or lower fan housing) through which the blades 1240 are deployed, for example, upon actuation. The gap 1260 is further defined by a lower edge of an upper half of the wire cage 1250, and an upper edge of a lower half of the wire cage 1250, such that the wire cage 1250 does not span the gap 1260. (The wire cage 1250 may be affixed to the support pole (or rod) 1210, or the main drive shaft at its upper end, and likewise to the main drive shaft at its lower end, so that the upper half of the wire cage 1250 and the lower half of the wire cage 1250 are separated by the gap 1260, and held in position relative to one another by the main drive shaft. The gap 1260 should be no wider than necessary to accommodate passage of the blades 1240 into their deployed position while co-planar and parallel to one another.

As shown, a trim piece 1270 covers the gap 1260 when the blades 1240 are in the stowed position, so as to create a consistent and aesthetically pleasing appearance for an exterior of the ceiling fan when the blades 1240 are in the stowed position. Optimally, in accordance with one variation of the present embodiment, the ceiling fan should have an outward appearance to an ordinary observer of being merely a lighting fixture, and not, in particular, a ceiling fan. The trim piece 1270 creates a generally continuous and aesthetically pleasing appearance, in part because it visually couples the upper housing 1220 to the light cover 1230 (or lower housing) when the blades 1240 are in the stowed position.

Advantageously, the trim piece 1270 is divided into a number of sections, for example, two, equal to the number of blades 1240 that are concealed immediately behind the trim piece 1270. In accordance with one variation, the trim piece 1270 sections are not mechanically coupled to the upper housing 1220 or to the light cover 1230 (or lower housing). Instead, the trim piece 1270 sections are coupled to respective leading edges of the blades 1240, so that as the blades 1240 move from the stowed position (or retracted position) to the deployed position, the trim piece 1270 sections are moved from their positions spanning the gap 1260 (between the upper housing 1220 and the light cover 1230) so as to expose the gap 1260, and allow deployment of the blades 1240. The trim piece 1270 sections are selected so as not to interfere substantially with effective movement of air by the blades 1240 when the blades 1240 are in the deployed position, including the pitching of the blades 1240, and are rotated by the main drive motor about the main drive axis, as the main drive motor rotates the deck within the upper housing 1220 and the light cover 1230.

Figure 13:
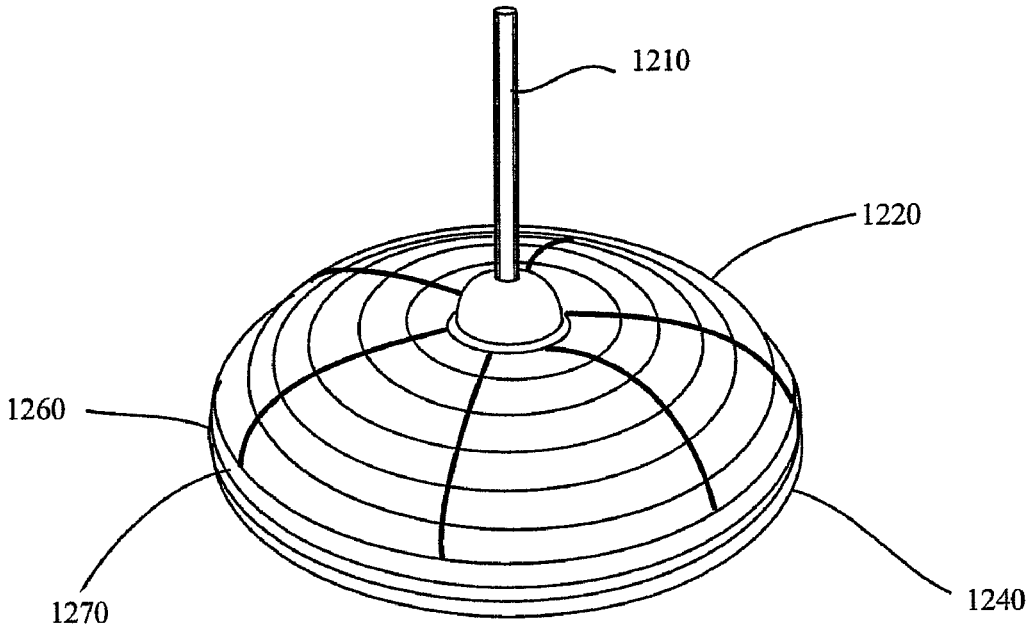
FIG. 13 is a top perspective view of the ceiling fan of FIG. 12 showing the plurality of actively deployable fan blades in the stowed (or stored position).

Referring to FIG. 13, a top perspective view is shown of the variation of the ceiling fan of FIG. 12 showing the plurality of actively deployable blades 1240 in the stowed (or stored position). Shown are a support pole (or rod) 1210, an upper housing 1220, a light cover 1230, and a trim piece 1270.

For a description of what is shown in FIG. 13, reference should be made to the detailed description made above in reference to FIG. 12.

Figure 14:
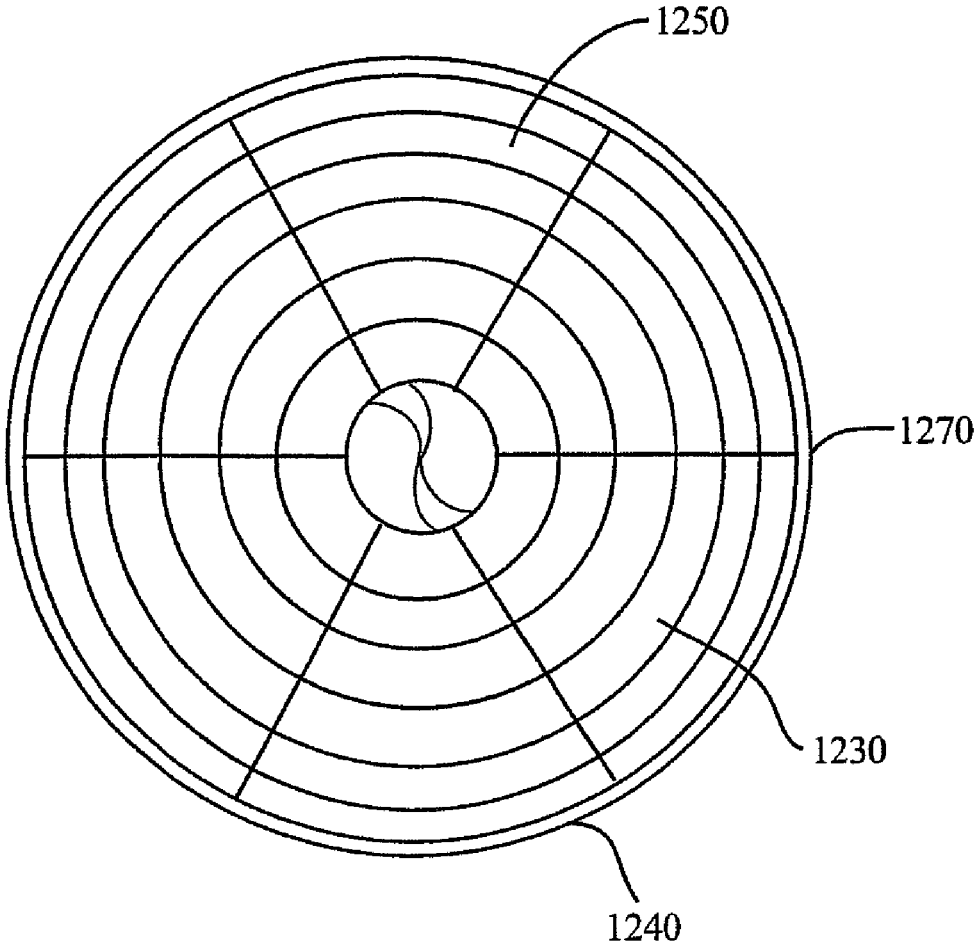
FIG. 14 is a bottom view of the ceiling fan of FIGS. 12 & 13 showing the plurality of actively deployable fan blades in the stowed (or stored position).

Referring to FIG. 14, a bottom view is shown of the variation of the ceiling fan of FIGS. 12 & 13 showing the plurality of actively deployable blades 1240 in the stowed (or stored position). Shown are a light cover 1230, a lower half of a wire cage 1250 and a trim piece 1270.

Except as otherwise noted below, for a description of what is shown in FIG. 13, reference should be made to the detailed description made above in reference to FIG. 2.

As shown, another feature that may be incorporated into the present embodiment is a decorative wire cage 1250 enveloping the light cover 1230 (or lower housing), and the second light cover 1230 (or upper housing 1220). In addition to providing a decorative element, the wire cage 1250 can provide a further measure of protection for the light cover 1230 (or lower housing) and the second light cover 1230 (or upper housing 1220).

The lower half of the wire cage 1250 may be affixed to the main drive shaft at its lower end. As shown, a decorative fastener may be used to secure the lower half of the wire cage 1250 to the lower end of the main drive shaft.

Figure 15:
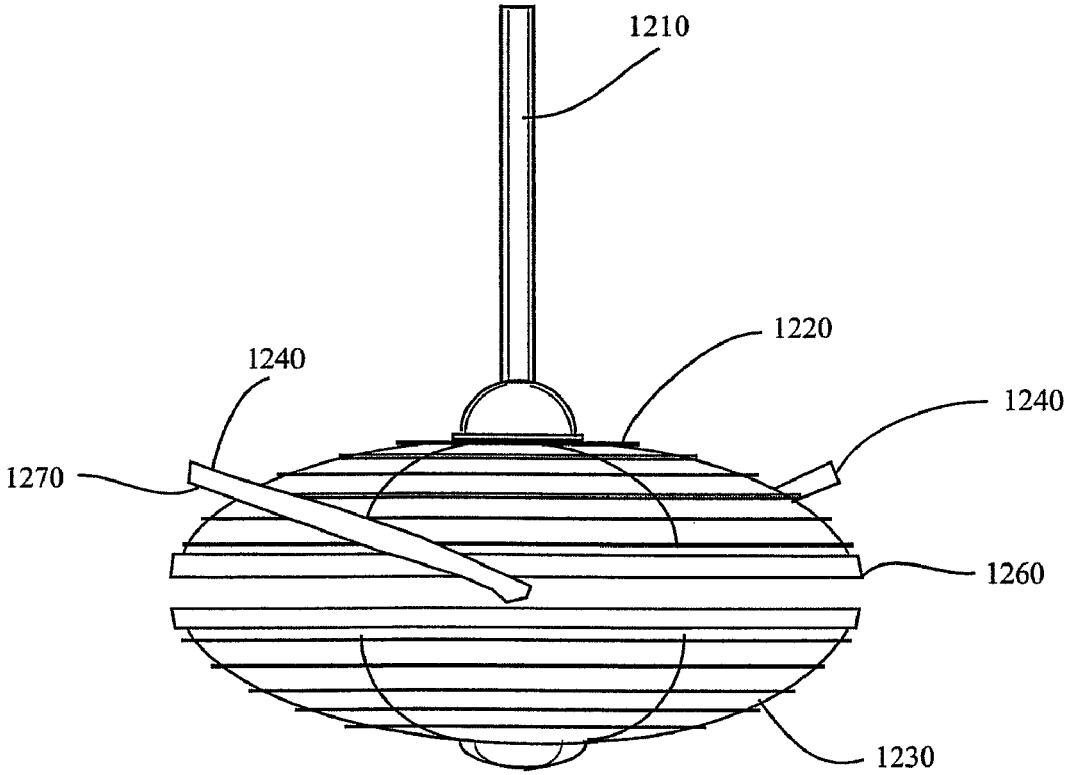
FIG. 15 is a side view of the ceiling fan of FIGS. 12-14 showing the plurality of actively deployable fan blades in the deployed (or use position), and having had their pitch altered for air movement.

Referring to FIG. 15, a side view is shown of the variation of the ceiling fan of FIGS. 12-14 showing the plurality of actively deployable blades 1240 in the deployed (or use position), and having had their pitch altered for air movement. Shown are a support pole (or rod) 1210, an upper housing 1220, a light cover 1230, and a trim piece 1270, a first blade, and a second blade.

The support pole (or rod) 1210 is coupled at a distal end to the mounting surface, such as the ceiling of a room (not shown). The support pole (or rod) 1210 is coupled at a proximal end to the upper housing 1220. The upper housing 1220 encloses the main drive shaft, the main drive motor, and the deck, which is turned about a main axis defined by the support pole (or rod) 1210, the main drive shaft and the main drive motor in response to actuation of the main drive motor, such as by the application of power to the main drive motor by the activation of a wall switch, such as is known in the art. As the deck is turned (or rotated) the pair of blades 1240 affixed thereto is likewise rotated.

Prior to rotation of the deck, the blades 1240 may be deployed into a position so as to facilitate the movement of air in response to the rotation of the blades 1240. Preferably however, the blades 100 and 105 may be deployed as the rotation of the deck begins, so as to create a smooth, aesthetic appearance, and to assist in the stabilization of the blades as the blades are deployed, i.e., to assist with the elimination of "wobble" in the blades as they are deployed. As shown, the first blade and the second blade are in a deployed position, and are pitched for movement of air in response to the turning of the blades 1240, and the deck in response to the main drive motor. This deployment includes both rotation of the blades 1240 about an axis parallel to the main axis (but not coaxial therewith), so as to move the blades 1240 from a stowed position to a deployed position, and the rotation of the blades 1240 about an axis substantially perpendicular (or otherwise off parallel, i.e., otherwise rotated to a position in a plane that is off perpendicular to the axis of rotation of the blades as they are rotated by the main drive motor about the main drive shaft) to the main axis (such as normal to the main axis), so as to alter the pitch of the blades 1240 in order to facilitate movement of air by the blades 1240 upon rotation of the blades 1240 about the main axis. Alternatively, the blades 1240 may slide radially (relative to the main axis) along a linear path into the deployed position, may slide radially and tangentially (relative to the main axis) along a linear path into the deployed position, or may move along a path defined by radial, tangential, and rotational paths, e.g., a non-linear path.

In any case, the blades 1240 are preferably rotated about an axis substantially perpendicular to the main axis, so as to alter the pitch of the blades 1240 in order to facilitate movement of air by the blades 1240 upon rotation of the blades 1240 about the main axis. The path is selected in accordance with the optimal placement of the blades 1240 for air movement, the shape of the blades 1240, and the shape and size of the housing, as well as aesthetic factors. In accordance with the present embodiment, a light, such as an incandescent light bulb, or light emitting diode array is positioned below the deck and affixed to the drive shaft, which is coaxial with the support pole (or rod) 1210, so as to fix the light below the deck such that the light does not rotate in response to the turning of the main drive motor. The light cover 1230 encloses the light, providing a measure of protection from, for example, dust, weather, or the like, and providing an aesthetically pleasing structure for the ceiling fan.

In accordance with the present embodiment, a light, such as an incandescent light bulb, or light emitting diode array are positioned below the deck and affixed to a main drive shaft, that is coaxial with the support pole (or rod) 1210, so as to fix the light below the deck such that the light does not rotate in response to the turning of the main drive motor. The light cover 1230 encloses the light, providing a measure of protection from, for example, dust, weather, or the like, and providing and an aesthetically pleasing structure for the ceiling fan.

Alternatively, a lower fan housing element may be used in lieu of the light cover 1230, in the event, in accordance with other embodiments, the light is not utilized. In such alternative embodiment the ceiling fan serves the single function of air movement, and does not serve as a light fixture.

Further, alternatively, an upper light cover 1230 may be used in lieu of the upper housing 1220, in which case a second light, such as a second incandescent light bulb, or second light emitting diode array are positioned above the deck and affixed to the main drive shaft, so as to fix the second light above the deck such that the light does not rotate in response to the turning of the main drive motor. The second light cover 1230 encloses the second light, providing a measure of protection from, for example, dust, weather, or the like, and providing an aesthetically pleasing structure for the ceiling fan.

As shown, another feature that may be incorporated into the present embodiment is a decorative wire cage 1250 enveloping the light cover 1230 (or lower housing), and the second light cover 1230 (or upper housing 1220). In addition to providing a decorative element, the wire cage 1250 can provide a further measure of protection for the light cover 1230 (or lower housing) and the second light cover 1230 (or upper housing 1220).

A gap 1260 is defined between the upper housing 1220 (or second light cover 1230) and the light cover 1230 (or lower fan housing) through which the blades 1240 are deployed, for example, upon actuation. The gap 1260 is further defined by a lower edge of an upper half of the wire cage 1250, and an upper edge of a lower half of the wire cage 1250, such that the wire cage 1250 does not span the gap 1260. (The wire cage 1250 may be affixed to the support pole (or rod) 1210, or the main drive shaft at its upper end, and likewise to the main drive shaft at its lower end, so that the upper half of the wire cage 1250 and the lower half of the wire cage 1250 are separated by the gap 1260, and held in position relative to one another by the main drive shaft. The gap 1260 should be no wider than necessary to accommodate passage of the blades 1240 into their deployed position while co-planar and parallel to one another.

As shown, a decorative trim piece 1270 covers the gap 1260 when the blades 1240 are in the stowed position, so as to create a consistent and aesthetically pleasing appearance for an exterior of the ceiling fan when the blades 1240 are in the stowed position. Optimally, in accordance with one variation of the present embodiment, the ceiling fan should have an outward appearance to an ordinary observer of being merely a lighting fixture, and not, in particular, a ceiling fan. The trim piece 1270 creates a generally continuous and aesthetically pleasing appearance, in part because it visually couples the upper housing 1220 to the light cover 1230 (or lower housing) when the blades 1240 are in the stowed position.

Advantageously, the trim piece 1270 is divided into a number of sections, for example, two, equal to the number of blades 1240 that are concealed immediately behind the trim piece 1270. In accordance with one variation, the trim piece 1270 sections are not mechanically coupled to the upper housing 1220 or to the light cover 1230 (or lower housing). Instead, the trim piece 1270 sections are coupled to respective leading edges of the blades 1240, so that as the blades 1240 move from the stowed position (or retracted position) to the deployed position, the trim piece 1270 sections are moved from their positions spanning the gap 1260 (between the upper housing 1220 and the light cover 1230) so as to expose the gap 1260, and allow deployment of the blades 1240. The trim piece 1270 sections are selected so as not to interfere substantially with effective movement of air by the blades 1240 when the blades 1240 are in the deployed position, including the pitching of the blades 1240, and are rotated by the main drive motor about the main drive axis, as the main drive motor rotates the deck within the upper housing 1220 and the light cover 1230.

Figure 16:
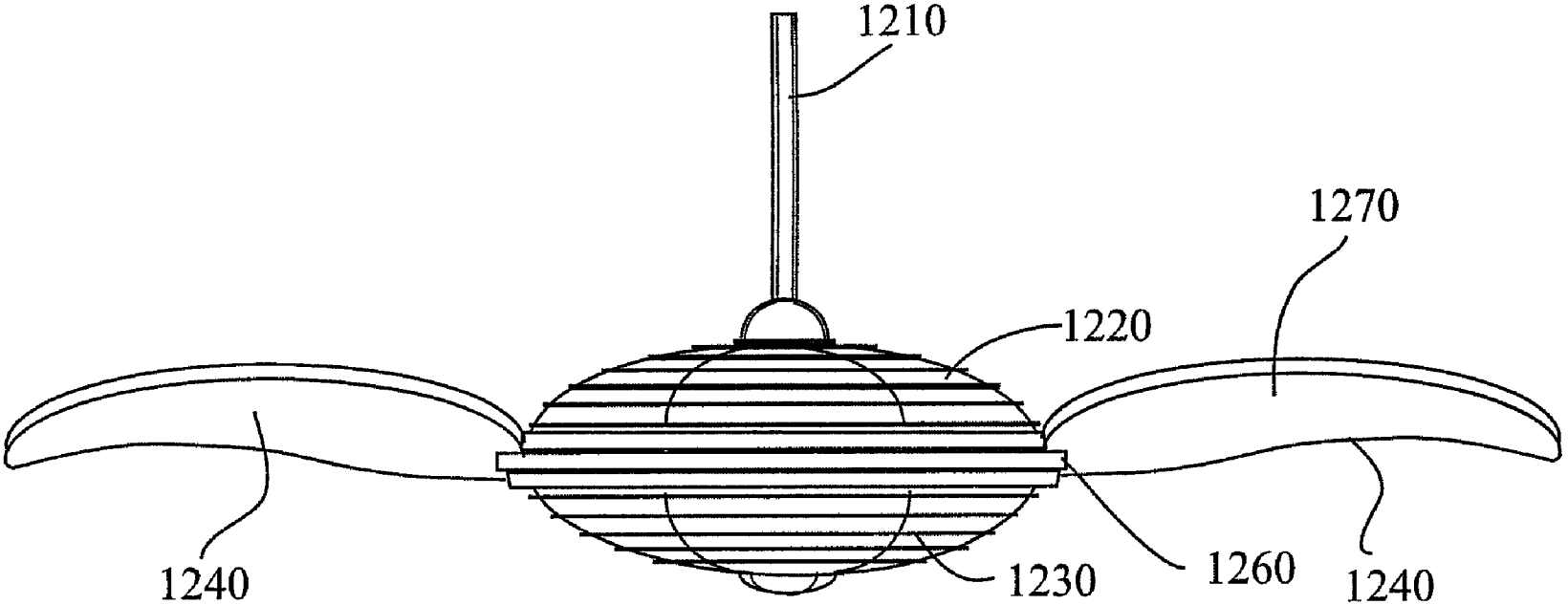
FIG. 16 is a side view, viewed from a position 90° from that of FIG. 15, about an axis of rotation of the ceiling fan, of the ceiling fan of FIGS. 12-15 showing the plurality of actively deployable fan blades in the deployed (or use position), and having had their pitch altered for air movement.

Referring to FIG. 16, a side view is shown, viewed from a position 90° from that of FIG. 15, about an axis of rotation of the ceiling fan, of the variation of the ceiling fan of FIGS. 12-15 showing the plurality of actively deployable blades 1240 in the deployed (or use position), and having had their pitch altered for air movement.

For a description of what is shown in FIG. 16, reference should be made to the detailed description made above in reference to FIG. 15.

Figure 17:
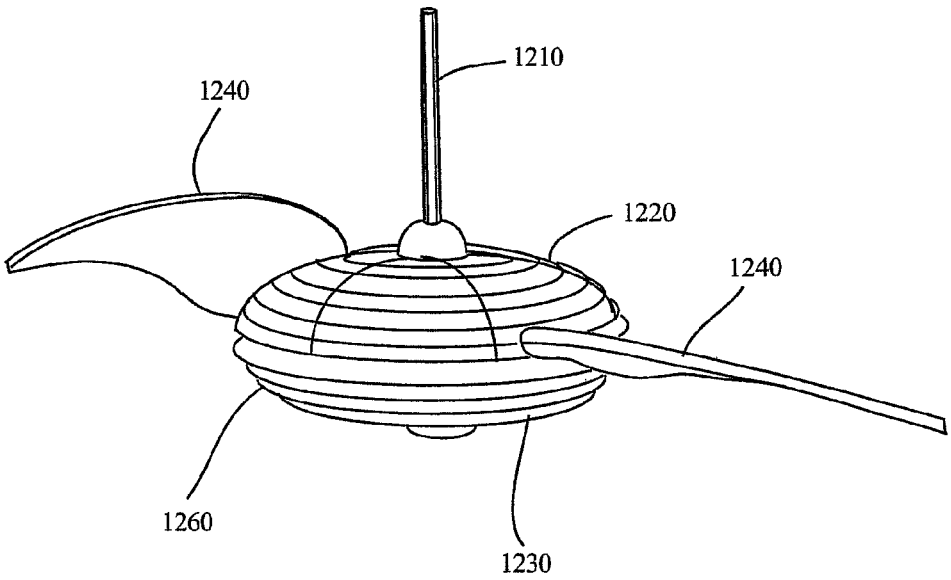
FIG. 17 is a perspective view of the ceiling fan of FIGS. 12-16 showing the plurality of actively deployable fan blades in the deployed (or use position), and having had their pitch altered for air movement.

Referring to FIG. 17, a perspective view is shown of the variation of the ceiling fan of FIGS. 12-16 showing the plurality of actively deployable blades 1240 in the deployed (or use position), and having had their pitch altered for air movement.

For a description of what is shown in FIG. 17, reference should be made to the detailed description made above in reference to FIG. 15.

Figure 18:
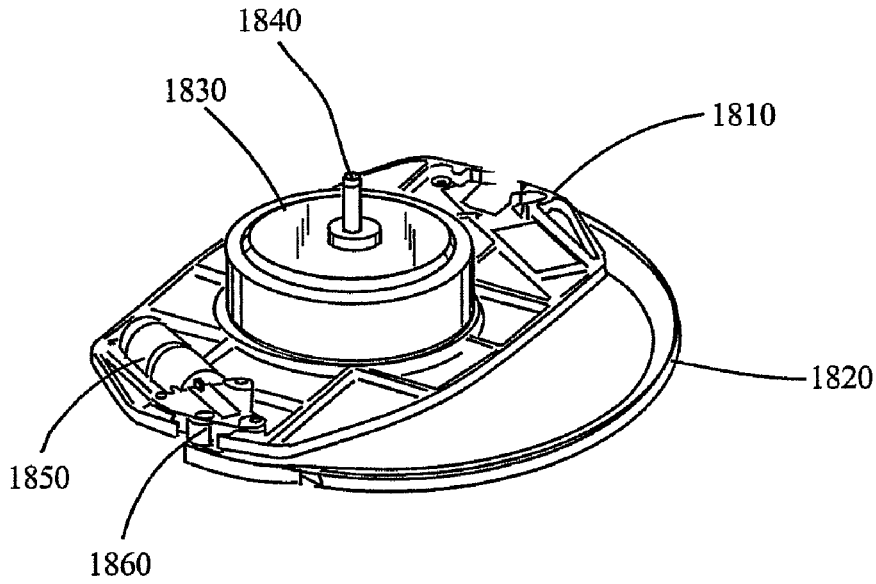
FIG. 18 is a top perspective view of a deck assembly of the ceiling fan of FIGS. 12-17 showing a deck, a blade, a main drive motor, a main drive shaft, a deployment motor, and a deployment mechanism, with the blade being in the stowed (or storage) position.

Referring to FIG. 18, a top perspective view is shown of a ceiling fan deck assembly of the variation of the ceiling fan of FIGS. 12-17 showing a deck 1810, a blade 1820, a main drive motor 1830, a main drive shaft 1840, a deployment motor 1850, and a deployment mechanism 1860, with the blade 1820 being in the stowed (or storage) position.

There is shown a deck 1810 (or general chassis) of a ceiling fan with deployable and retractable blades. An essentially planar deployment module consists of a deck 1810 and a plurality of blade deployment mechanisms. In the embodiment shown, each blade deployment mechanism 1860 is powered by an individual deployment motor 1850. The overall module 10 is mounted to a main drive motor 1830 and turned relative to a main drive shaft 1840 by the main drive motor 1830 when the ceiling fan is in operation.

For illustration purposes only a single blade 1820 is depicted in FIG. 18. In practice, according to the present embodiment, a first blade and a second blade are positioned opposite one another against the deck 1810, and deployed in opposite directions.

Figure 19:
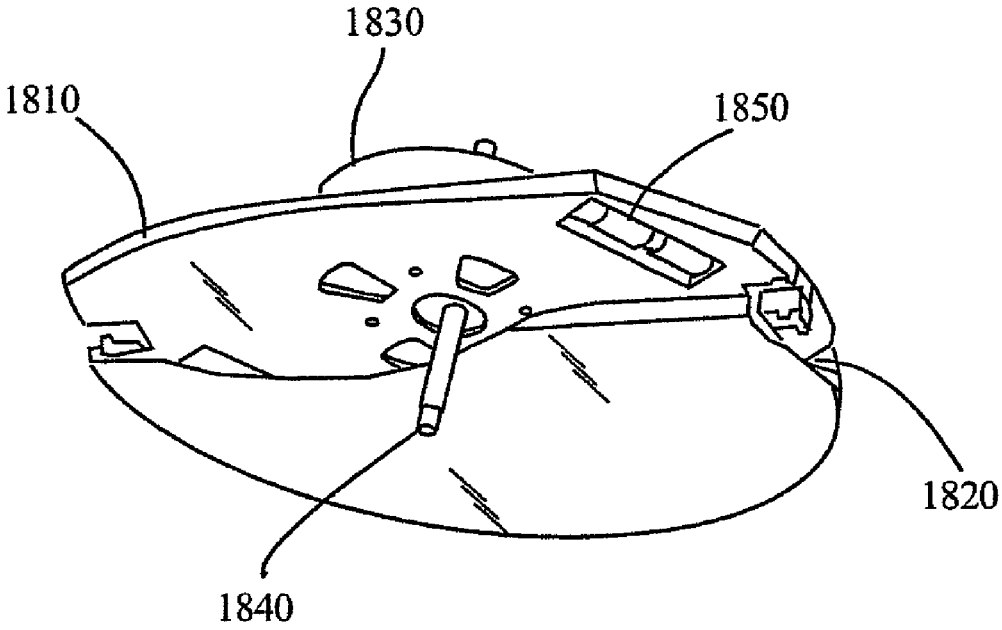
FIG. 19 is a bottom perspective view of the deck assembly of FIG. 18 showing the deck, the blade, the main drive shaft, the deployment motor, and the deployment mechanism, with the blade being in the stowed (or storage) position.

Referring to FIG. 19, a bottom perspective view is shown of the ceiling fan deck assembly of FIG. 18 showing the deck 1810, the blade 1820, the main drive shaft 1840, the deployment motor 1850, and the deployment mechanism 1860, with the blade 1820 being in the stowed (or storage) position. Shown is the deck 1810 of a ceiling fan with the deployable and retractable blade 1820. As shown, an essentially planar deployment module consists of a deck 1810 and a plurality of blade deployment mechanisms. In the embodiment shown each blade deployment mechanism 1860 is powered by an individual deployment motor 1850. The overall deployment module is mounted to a main drive motor 1830 and is turned relative to a main drive shaft 1840 by the main drive motor 1830 when the ceiling fan is in operation.

Again, for illustration purposes only a single blade 1820 is depicted in FIG. 19. In practice, according to the present embodiment, a first blade and a second blade are positioned opposite one another against the deck 1810, and deploy in opposite directions. As can be seen in FIG. 19, the blade 1820 slides beneath the deck 1810 to a position adjacent to the main drive shaft 1840 when the blade 1820 is in this stowed position, as depicted. Upon deployment, the blade 1820 moves in a direction about an axis parallel to the main drive axis (through the main drive shaft 1840), but not coaxial there with, until it is fully extended, at which time the blade 1820 then rotates about an axis substantially normal to the main drive axis in order to pitch the blade 1820 for performance of its function in moving air.

Figure 20:
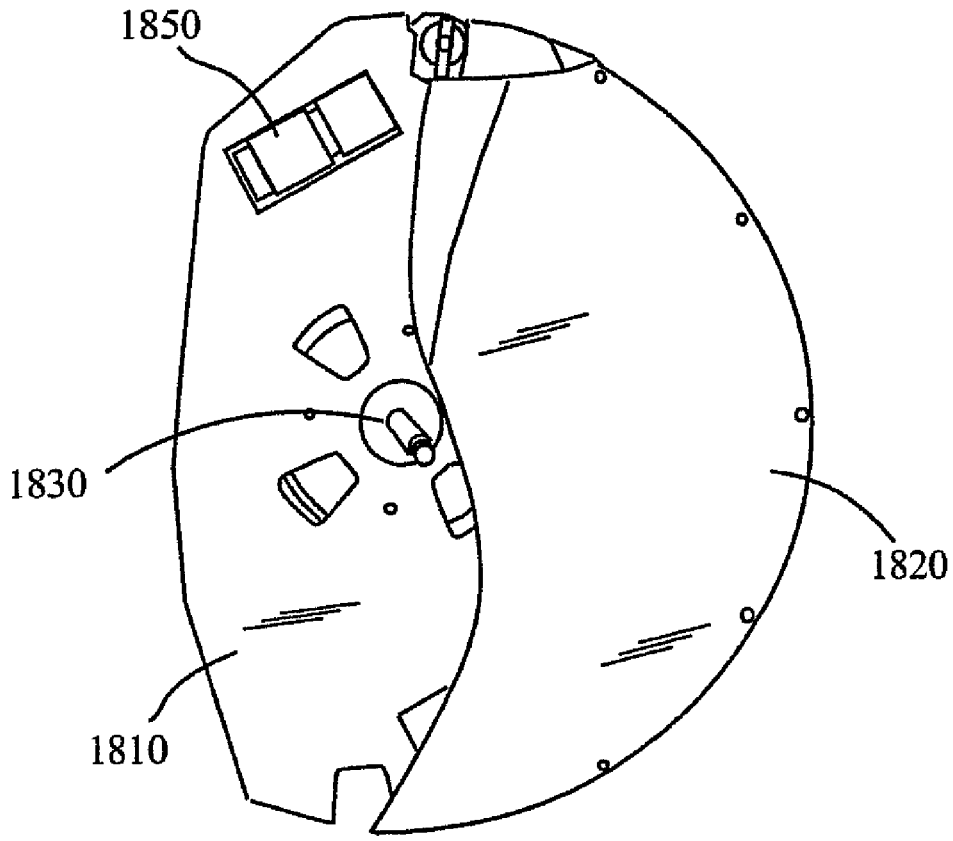
FIG. 20 is a bottom view of the deck assembly of FIG. 18 showing the deck, the blade, the main drive shaft, the deployment motor, and the deployment mechanism, with the blade being in the stowed (or storage) position.
Figure 21:
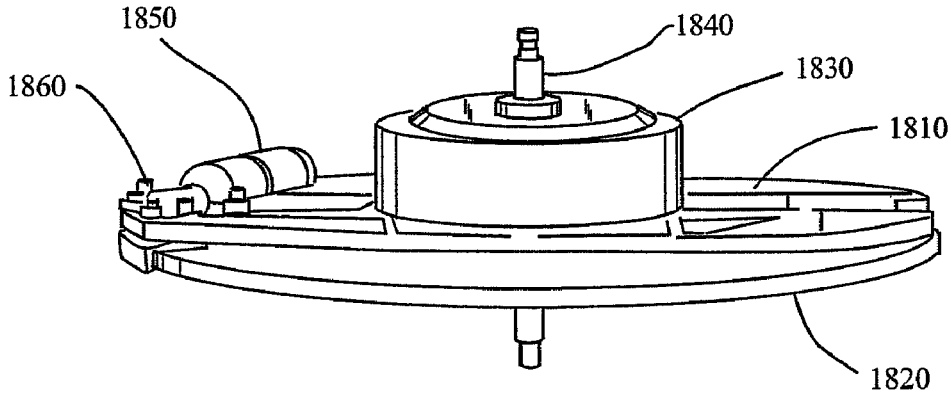
FIG. 21 is a further top perspective view of the deck assembly of FIG. 18 showing the deck, the blade, the main drive motor, the main drive shaft, the deployment motor, and the deployment mechanism, with the blade being in the stowed (or storage) position.

Referring to FIG. 20, a bottom view is shown, of the ceiling fan deck assembly of FIG. 18 showing the deck 1810, the blade 1820, the main drive shaft 1840, the deployment motor 1850, and the deployment mechanism 1860, with the blade 1820 being in the stowed (or storage) position. Shown is the deck 1810 of a ceiling fan with the deployable and retractable blade 1820. As shown, an essentially planar deployment module consists of a deck 1810 and a plurality of blade deployment mechanisms. This structure is described in reference to FIG. 19 above. Referring to FIG. 21, a further top perspective view is shown of the deck 1810 assembly of FIG. 18 showing the deck 1810, the blade 1820, the main drive motor 1830, the main drive shaft 1840, the deployment motor 1850, and the deployment mechanism 1860, with the blade 1820 being in the stowed (or storage) position. Shown are a main drive shaft 1840, the main drive motor 1830, a deck 1810, a deployment mechanism 1860, a deployment motor 1850, and the blade 1820.

The main drive motor 1830 is situated about the main drive shaft 1840, so as to be coaxial there with, and rotate their about. Rotation of the main drive motor 1830 about the main drive shaft 1840 occurs upon energizing of the main drive motor 1830. The main drive motor 1830 is affixed to the deck 1810, to which the deployment mechanism 1860 and the deployment motor 1850 are also affixed. The blade 1820 is affixed to the deployment mechanism 1860, thereby making the blade 1820 responsive to movements introduced by the deployment mechanism 1860 under the power of the deployment motor 1850. These movements are described herein above with reference to FIG. 19, for example.

Figure 22:
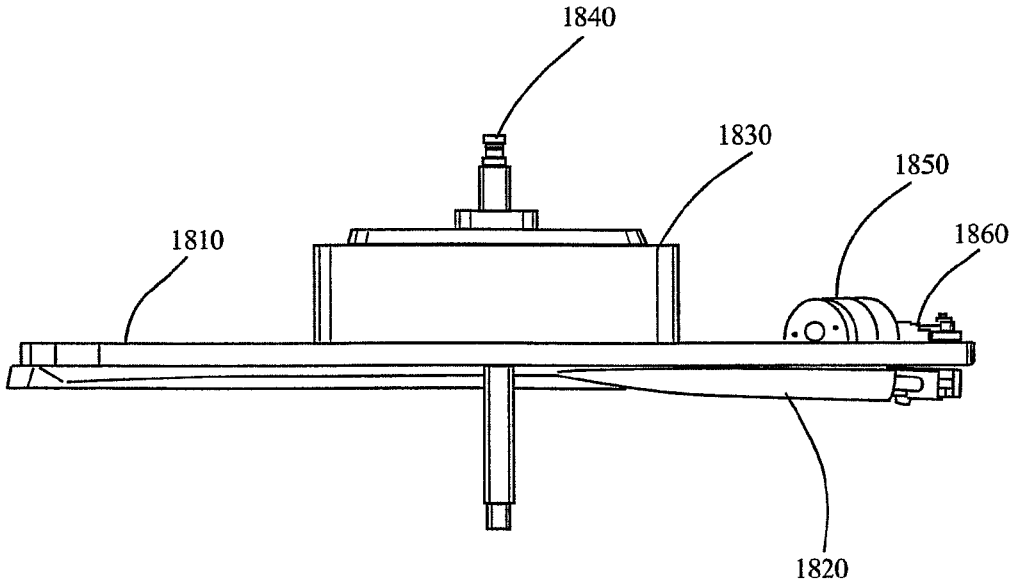
FIG. 22 is a side view of the deck assembly of FIG. 18 showing the deck, the blade, the main drive motor, the main drive shaft, the deployment motor, and the deployment mechanism, with the blade being in the stowed (or storage) position.

Referring to FIG. 22, a side view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the stowed (or storage) position. Shown are a main drive shaft 1840, the main drive motor 1830, a deck 1810, a deployment mechanism 1860, a deployment motor 1850, and the blade 1820.

These structures are described above in reference to FIG. 21.

Figure 23:
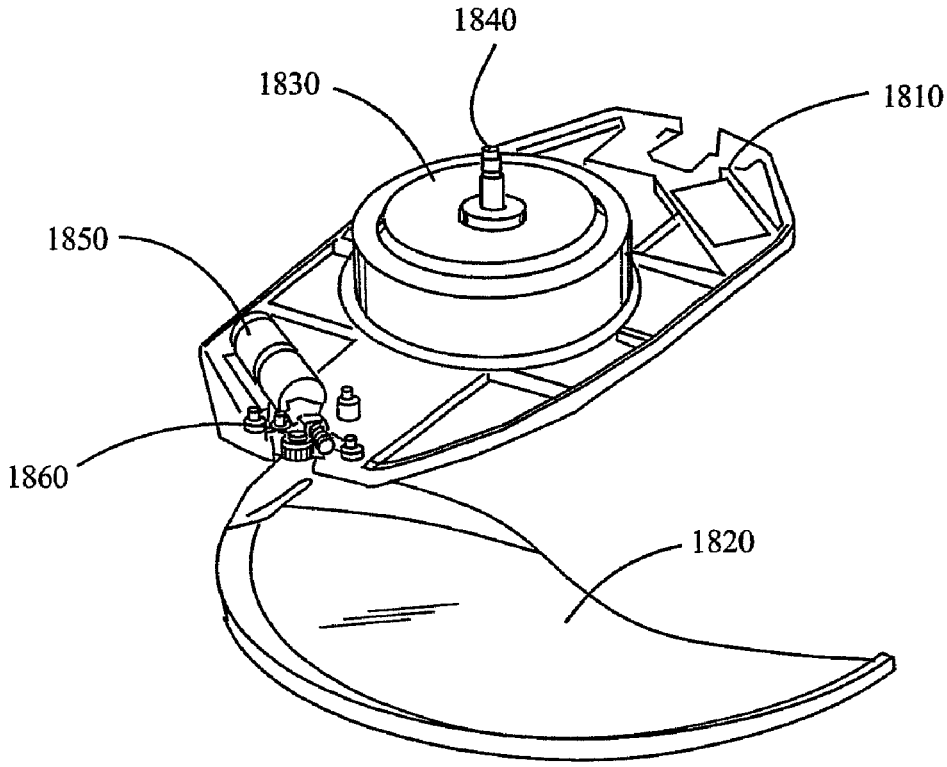
FIG. 23 is a top perspective view of the deck assembly of FIG. 18 showing the deck, the blade, the main drive motor, the main drive shaft, the deployment motor, and the deployment mechanism, with the blade being in the partially deployed position.

Referring to FIG. 23, a top perspective view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the partially deployed position. Shown is the same ceiling fan deck assembly as described above in reference to FIG. 21 with a blade 1820 in a partially deployed position relative to deck 1810 (or deck). Deployment motor 1850 provides power to the mechanisms to rotate the blade 1820 out of the stowed position relative to deck 1810.

These structures are described in further detail above in reference to FIG. 21, wherein it is noted that for sake of illustration only a single blade 1820 is shown, however, in accordance with a preferred embodiment, to blades, disposed in a complementary, opposite, fashion are utilized.

Figure 24:
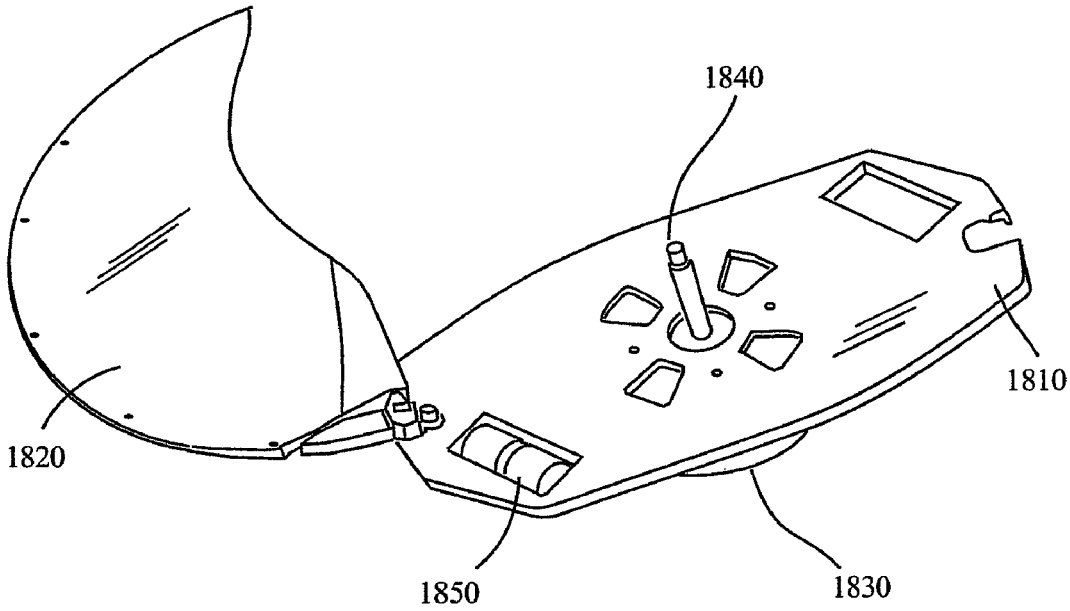
FIG. 24 is a bottom perspective view of the deck assembly of FIG. 18 showing the deck, the blade, the main drive shaft, the deployment motor, and the deployment mechanism, with the blade being in the partially deployed position.

Referring to FIG. 24, a bottom perspective view is shown of the ceiling fan deck assembly of FIG. 18 showing the deck 1810, the blade 1820, the main drive shaft 1840, the deployment motor 1850, and the deployment mechanism 1860, with the blade 1820 being in the partially deployed position. Shown is the same ceiling fan deck assembly as described above in reference to FIG. 21, however with the blade 1820 in a partially deployed position relative to a deck 1810 (or deck 1810).

These structures are described in further detail above in reference to FIG. 21.

Figure 25:
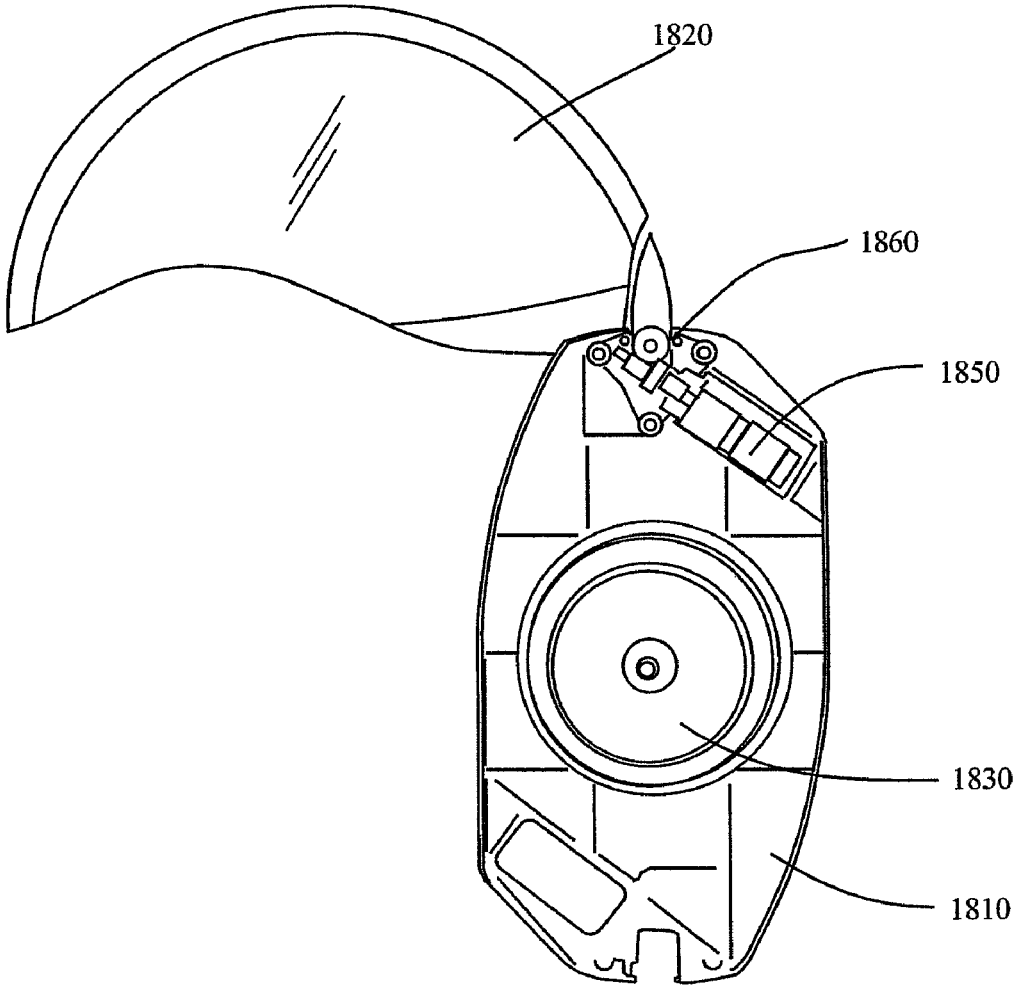
FIG. 25 is a top view of the deck assembly of FIG. 18 showing the deck, the blade, the main drive motor, the main drive shaft, the deployment motor, and the deployment mechanism, with the blade being in the partially deployed position.

Referring to FIG. 25, a top view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the partially deployed position. Shown is the same ceiling fan deck as described above in reference to FIG. 21, however with the blade 1820 in a partially deployed position relative to a deck 1810 (or deck).

These structures are described in further detail hereinabove in reference to FIG. 21.

Figure 26:
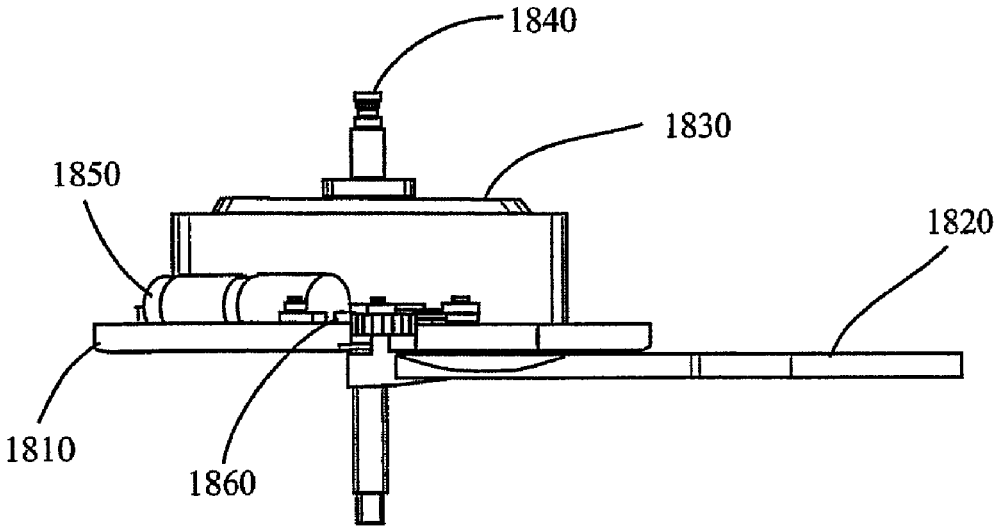
FIG. 26 is a side view of the deck assembly of FIG. 18 showing the deck, the blade, the main drive motor, the main drive shaft, the deployment motor, and the deployment mechanism, with the blade being in the partially deployed position.

Referring to FIG. 26, a side view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the partially deployed position. Shown is the main drive shaft 1840, the main drive motor 1830, the deployment motor 1850, the deployment mechanism 1860 and the blade 1820.

These structures are described in further detail hereinabove in reference to FIG. 21. Of note, the blade 1820 of FIG. 26 is in a partially deployed position.

Figure 27:
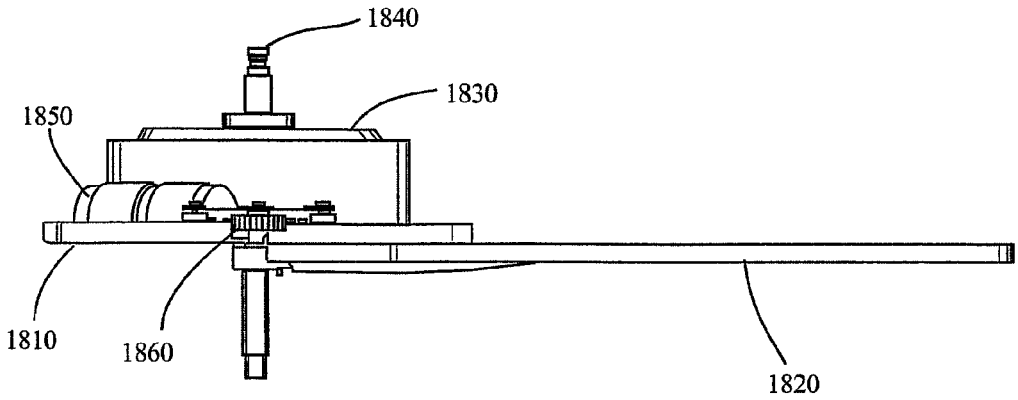
FIG. 27 is a side view of the deck assembly of FIG. 18 showing the deck, the blade, the main drive motor, the main drive shaft, the deployment motor, and the deployment mechanism, with the blade being in a further partially deployed position.

Referring to FIG. 27, a side view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in a further partially deployed position. Shown is the main drive shaft 1840, the main drive motor 1830, the deployment motor 1850, the deployment mechanism 1860 and the blade 1820.

These structures are described in further detail hereinabove in reference to FIG. 21. Of note, the blade 1820 of FIG. 27 is in a further partially deployed position, i.e., further deployed than as depicted in FIG. 26.

Figure 28:
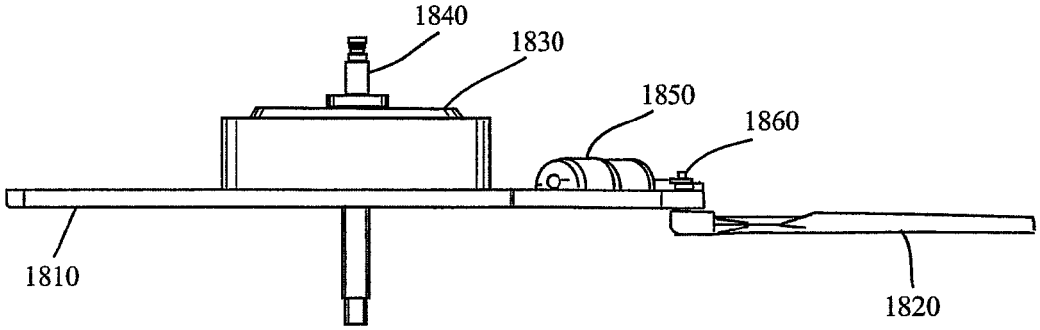
FIG. 28 is a side view of the deck assembly of FIG. 18 showing the deck, the blade, the main drive motor, the main drive shaft, the deployment motor, and the deployment mechanism, with the blade being in the deployed (or use) position.

Referring to FIG. 28, a side view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the deployed (or use) position. Shown is the main drive shaft 1840, the main drive motor 1830, the deployment motor 1850, the deployment mechanism 1860 and the blade 1820.

These structures are described in further detail hereinabove in reference to FIG. 21. Of note the blade 1820 of FIG. 28 is in a deployed position, i.e., in a fully deployed position.

Figure 29:
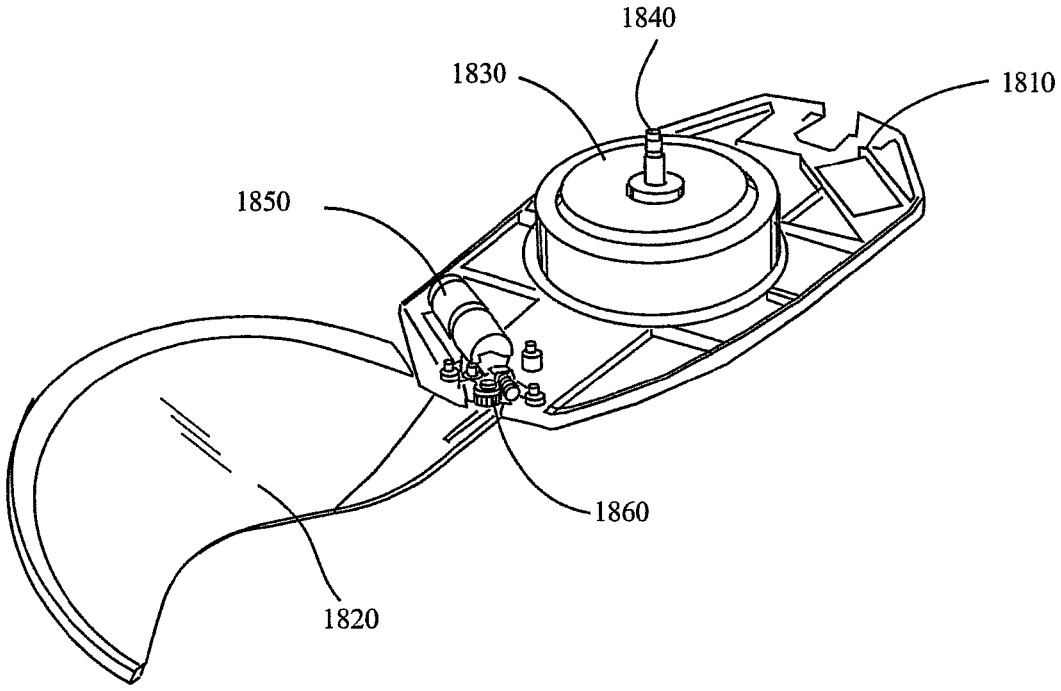
FIG. 29 is a top perspective view of the deck assembly of FIG. 18 showing the deck, the blade, the main drive motor, the main drive shaft, the deployment motor, and the deployment mechanism, with the blade being in the deployed (or use) position.

Referring to FIG. 29, a top perspective view is shown of the ceiling fan deck assembly of FIG. 18 showing the deck 1810, the blade 1820, the main drive motor 1830, the main drive shaft 1840, the deployment motor 1850, and the deployment mechanism 1860, with the blade 1820 being in the deployed (or use) position. Shown are the main drive shaft 1840, the main drive motor 1830, the deck 1810, the deployment mechanism 1860, the deployment motor 1850, and the blade 1820.

These structures are described in further detail hereinabove in reference to FIG. 21. Of note, the blade 1820 of FIG. 29 is in a deployed position. The blade 1820 is rotated to the deployed position relative to deck 1810 (deck 1810), under power from deployment motor 1850 via deployment mechanism 1860.

These structures are described in further detail hereinabove in reference to FIG. 21. Of note, the blade 1820 of FIG. 29 is in a deployed position, i.e., in a fully deployed position.

Figure 30:
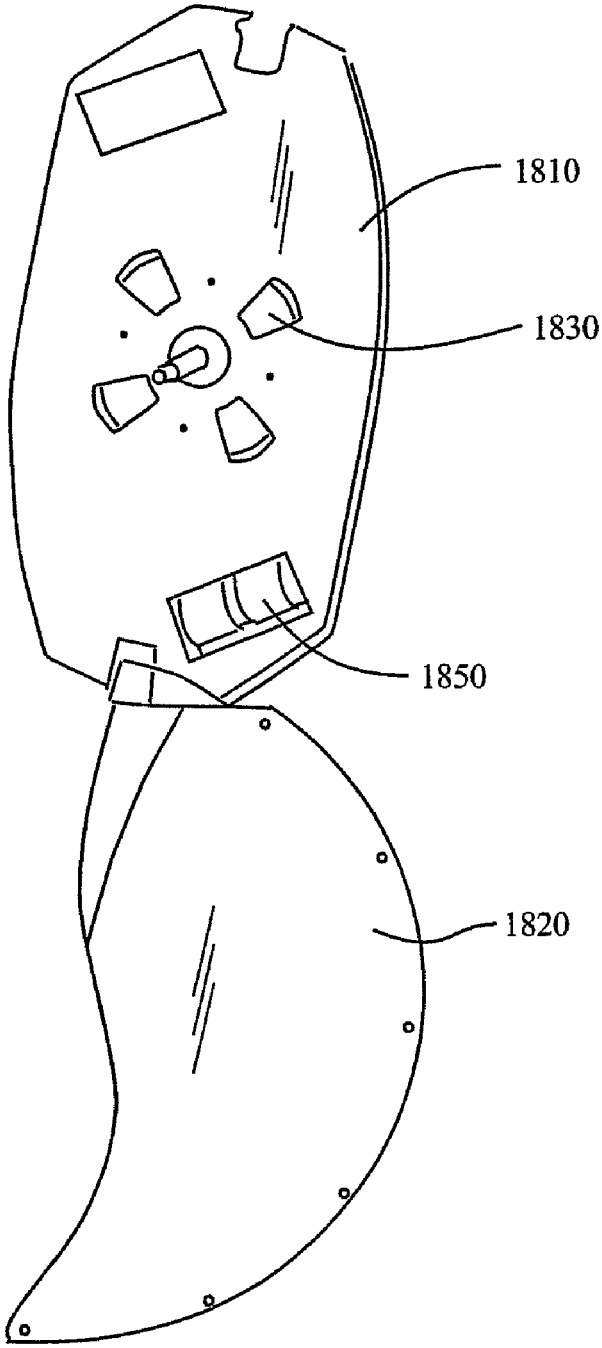
FIG. 30 is a bottom view of the deck assembly of FIG. 18 showing the deck, the blade, the main drive shaft, the deployment motor, and the deployment mechanism, with the blade being in the deployed (or use) position.

Referring to FIG. 30, a bottom view is shown of the ceiling fan deck assembly of FIG. 18 showing the deck 1810, the blade 1820, the main drive shaft 1840, the deployment motor 1850, and the deployment mechanism 1860, with the blade 1820 being in the deployed (or use) position. Shown are the main drive shaft 1840, the deck 1810, the deployment mechanism 1860, the deployment motor 1850, and the blade 1820.

These structures are described in further detail hereinabove in reference to FIG. 21. Of note, the blade 1820 of FIG. 30 is in a deployed position, i.e., in a fully deployed position.

Figure 31:
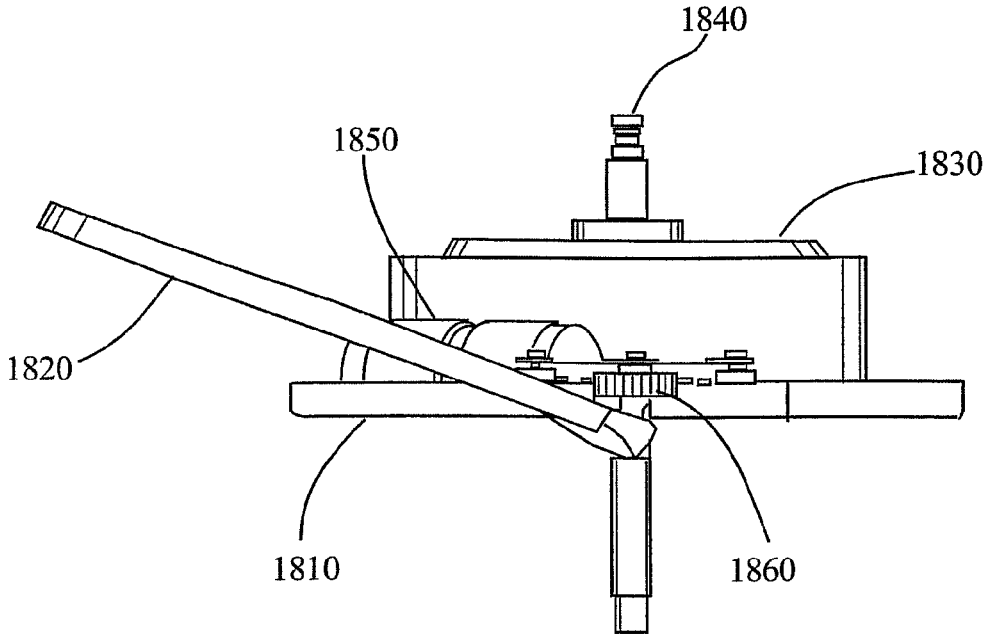
FIG. 31 is a side view of the deck assembly of FIG. 18 showing the deck, the blade, the main motor, the main drive shaft, the deployment motor, and the deployment mechanism, with the blade being in the deployed (or use) position, and having had its pitch altered for air movement.

Referring to FIG. 31, a side view is shown of the ceiling fan deck assembly of FIG. 18 showing the deck 1810, the blade 1820, the main motor, the main drive shaft 1840, the deployment motor 1850, and the deployment mechanism 1860, with the blade 1820 being in the deployed (or use) position, and having had its pitch altered for air movement. Shown are the main drive shaft 1840, the main drive motor 1830, the deck 1810, the deployment mechanism 1860, the deployment motor 1850, and the blade 1820.

As can be seen, the blade 1820 has been rotated about a pitching axis substantially normal to the main axis of the ceiling fan, as defined by the drive shaft, so as to place the blade 1820 in a position for air movement upon rotation of the deck 1810 about the main drive axis.

These structures and operations are described in further detail hereinabove in reference to FIG. 21, et al.

Figure 32:
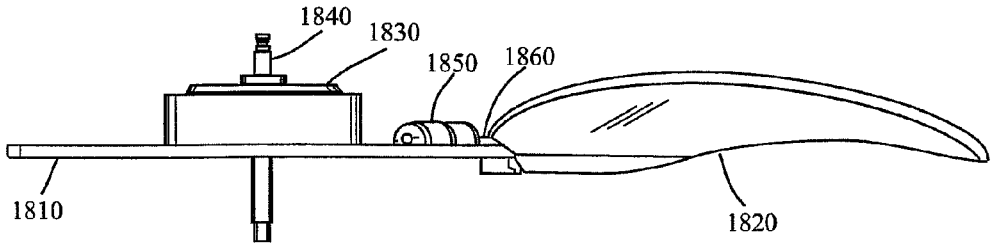
FIG. 32 is a side view, viewed from a position 90° from that of FIG. 31, about an axis of rotation of the ceiling fan, of the deck assembly of FIG. 18 showing the deck, the blade, the main motor, the main drive shaft, the deployment motor, and the deployment mechanism, with the blade being in the deployed (or use) position, and having had its pitch altered for air movement.

Referring to FIG. 32, a side view is shown, viewed from a position 90° from that of FIG. 31, about an axis of rotation of the ceiling fan, of the ceiling fan deck assembly of FIG. 18 showing the deck 1810, the blade 1820, the main motor, the main drive shaft 1840, the deployment motor 1850, and the deployment mechanism 1860, with the blade 1820 being in the deployed (or use) position, and having had its pitch altered for air movement. Shown are the main drive shaft 1840, the main drive motor 1830, the deck 1810, the deployment mechanism 1860, the deployment motor 1850, and the blade 1820.

The blade 1820 has been rotated to a fully deployed position and the deployment mechanism 1860 has pitched the blade 1820 up to a position where the ceiling fan is able to move air. In this configuration, main drive motor 1830 is activated to turn the entire chassis (deck 1810) assembly and operate the ceiling fan. The main drive motor 1830 and the deployment motor 1850 are independently powered and coordinated, as shown in this embodiment, sharing only a common electrical connection. This embodiment is perfectly balanced by design under all normal operating conditions.

Figure 33:
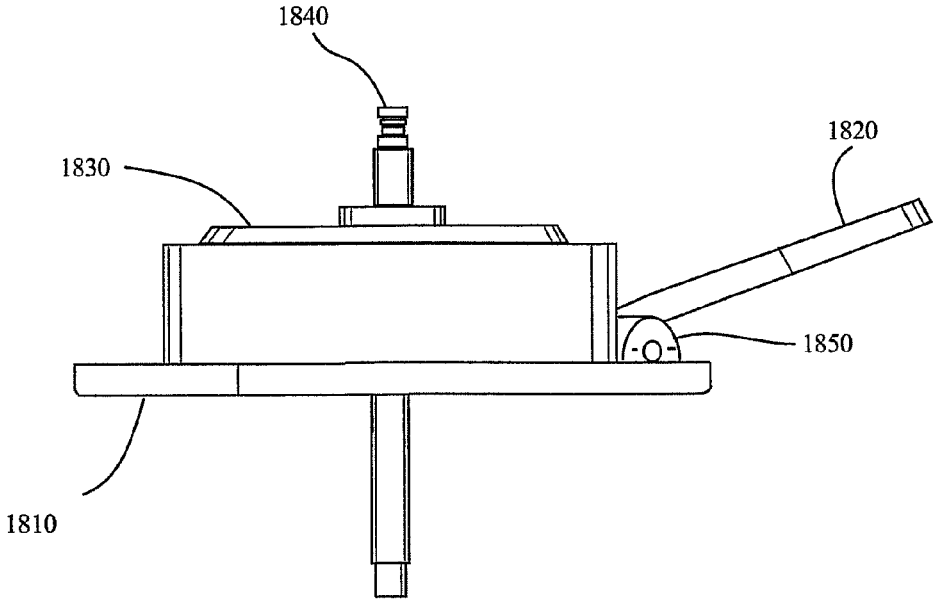
FIG. 33 is a side view, viewed from a position 180° from that of FIG. 31, about an axis of rotation of the ceiling fan, of the deck assembly of FIG. 18 showing the deck, the blade, the main motor, the main drive shaft, the deployment motor, and the deployment mechanism, with the blade being in the deployed (or use) position, and having had its pitch altered for air movement.

Referring to FIG. 33, a side view is shown, viewed from a position 180° from that of FIG. 31, about an axis of rotation of the ceiling fan, of the ceiling fan deck assembly of FIG. 18 showing the deck 1810, the blade 1820, the main motor, the main drive shaft 1840, the deployment motor 1850, and the deployment mechanism 1860, with the blade 1820 being in the deployed (or use) position, and having had its pitch altered for air movement. Shown is the main drive shaft 1840, the main drive motor 1830, the deck 1810, the deployment motor 1850 and the blade 1820. As depicted, the deployment mechanism 1860 is at security by the main drive motor 1830, and thus not visible in this figure.

These structures operate as described hereinabove in reference to FIG. 32, et al.

Figure 34:
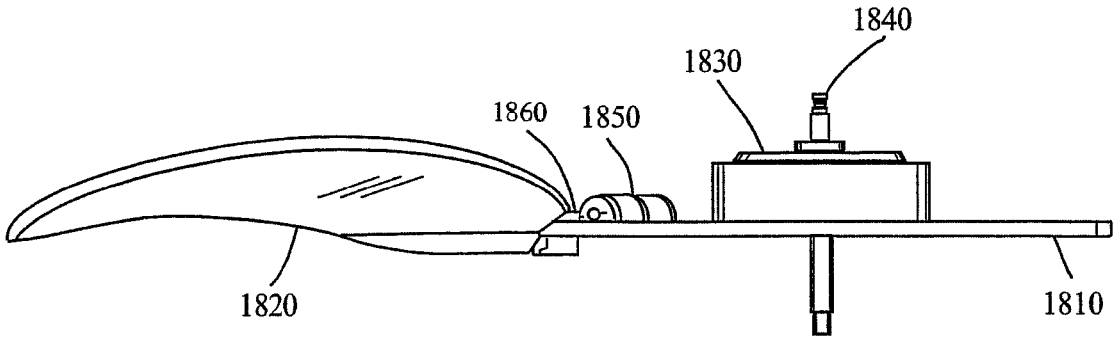
FIG. 34 is a side view, viewed from a position 180° from that of FIG. 32, about an axis of rotation of the ceiling fan, of the deck assembly of FIG. 18 showing the deck, the blade, the main motor, the main drive shaft, the deployment motor, and the deployment mechanism, with the blade being in the deployed (or use) position, and having had its pitch altered for air movement.

Referring to FIG. 34, a side view is shown, viewed from a position 180° from that of FIG. 32, about an axis of rotation of the ceiling fan, of the ceiling fan deck assembly of FIG. 18 showing the deck 1810, the blade 1820, the main motor, the main drive shaft 1840, the deployment motor 1850, and the deployment mechanism 1860, with the blade 1820 being in the deployed (or use) position, and having had its pitch altered for air movement. Shown is the main drive shaft 1840, the main drive motor 1830, the deck 1810, the deployment motor 1850, the deployment mechanism 1860, and the blade 1820.

The deployment motor 1850 is mounted to the deck 1810. The main drive motor 1830 is rigidly mounted to the deck 1810. Thus the deployment motor 1850 cannot rotate relative to deck 1810.

These structures operate as described hereinabove in reference to FIG. 32 et al.

Figure 35:
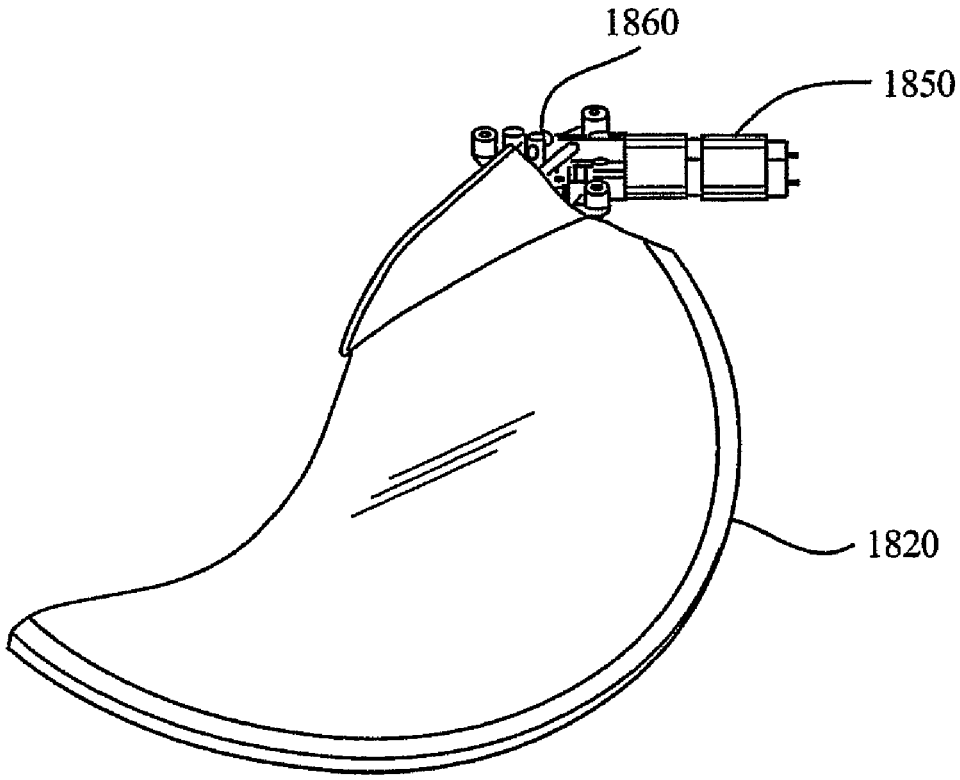
FIG. 35 is a top perspective view of the blade, the deployment motor, and the deployment mechanism of FIG. 18.

Referring to FIG. 35, a top perspective view is shown of the blade 1820, the deployment motor 1850, and the deployment mechanism 1860 of FIG. 18. Shown is the deployment motor 1850, the deployment mechanism 1860 and the blade 1820.

Also shown is more detail of the deployment mechanism 1860 and blade 1820. The deployment motor 1850 provides rotary power to turn blade 1820 via the deployment mechanism 1860. Advantageously, the deployment mechanism 1860 is structured such that the deployment motor 1850 is able to turn the blade 1820 along two axes of rotation, first the deployment axis, and second the pitching axis.

Details of the deployment mechanism 1860 are shown.

Figure 36:
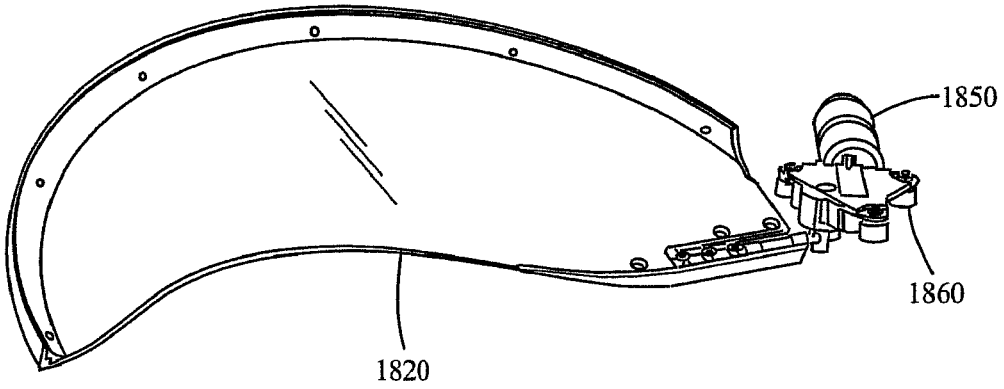
FIG. 36 is a bottom perspective view of the blade, the deployment motor, and the deployment mechanism of FIG. 18.

Referring to FIG. 36, a bottom perspective view is shown of the blade 1820, the deployment motor 1850, and the deployment mechanism 1860 of FIG. 18. Shown are the deployment motor 1850, the deployment mechanism 1860, and the blade 1820.

These structures operate substantially as described hereinabove with respect to FIG. 35.

Figure 37:
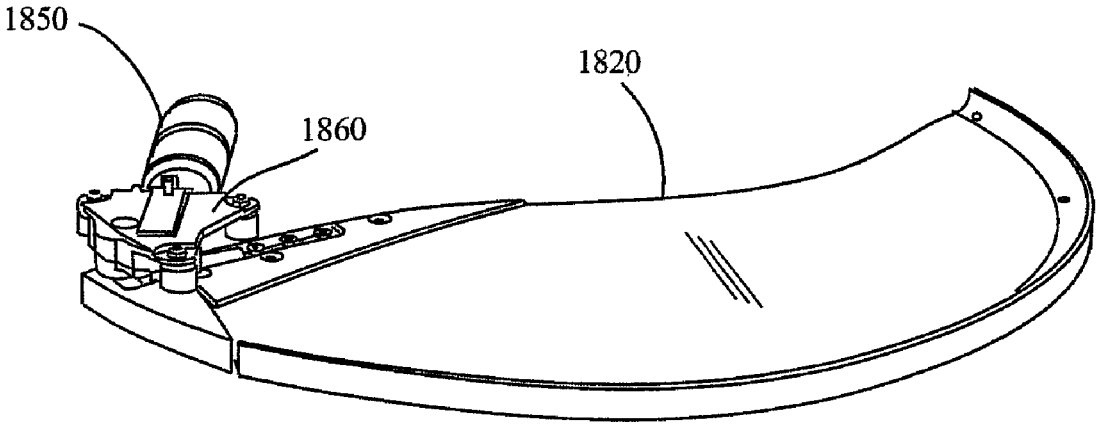
FIG. 37 is a bottom perspective view, viewed from a position 180° from that of FIG. 36, about an axis of rotation of the ceiling fan, of the blade, the deployment motor, and the deployment mechanism of FIG. 18.

Referring to FIG. 37, a bottom perspective view is shown, viewed from a position 180° from that of FIG. 36, about an axis of rotation of the ceiling fan, of the blade 1820, the deployment motor 1850, and the deployment mechanism 1860 of FIG. 18. Shown are the deployment motor 1850, the deployment mechanism 1860, and the blade 1820.

These structures operate substantially as described hereinabove with respect to FIG. 35.

Figure 38:
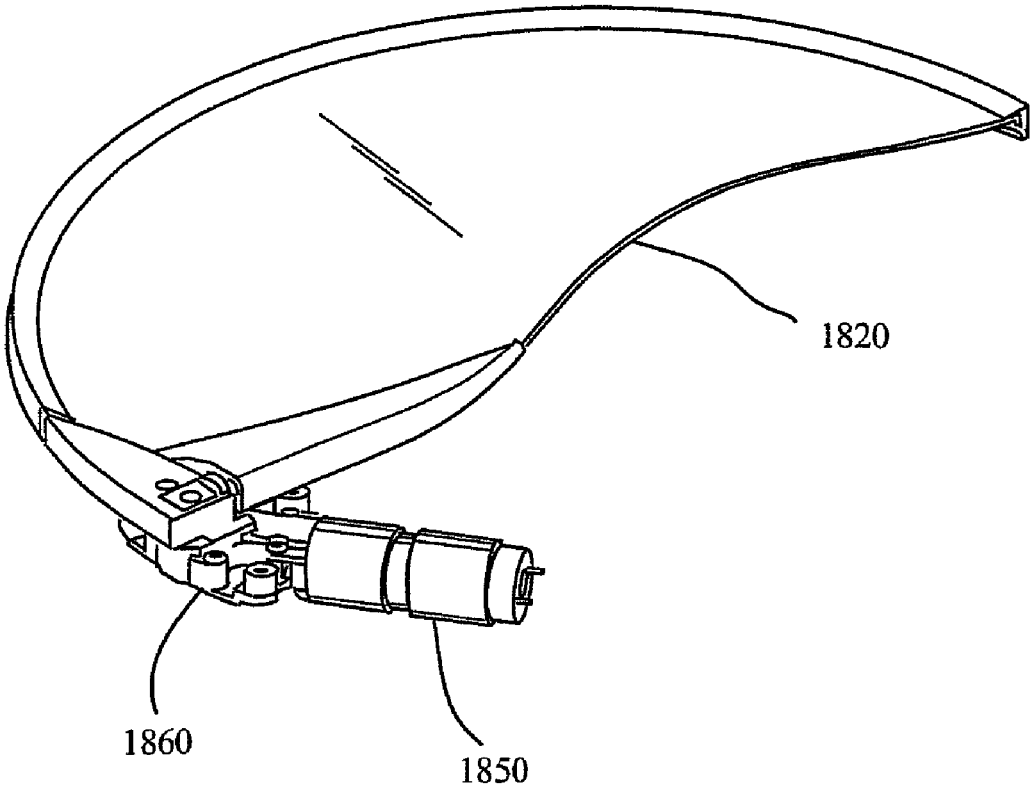
FIG. 38 is a bottom perspective view, viewed from a position 90° from that of FIG. 37, about an axis of rotation of the ceiling fan, of the blade, the deployment motor, and the deployment mechanism of FIG. 18.

Referring to FIG. 38, a bottom perspective view is shown, viewed from a position 90° from that of FIG. 37, about an axis of rotation of the ceiling fan, of the blade 1820, the deployment motor 1850, and the deployment mechanism 1860 of FIG. 18. Shown are the deployment motor 1850, the deployment mechanism 1860, and the blade 1820.

These structures operate substantially as described hereinabove with respect to FIG. 35.

Figure 39:
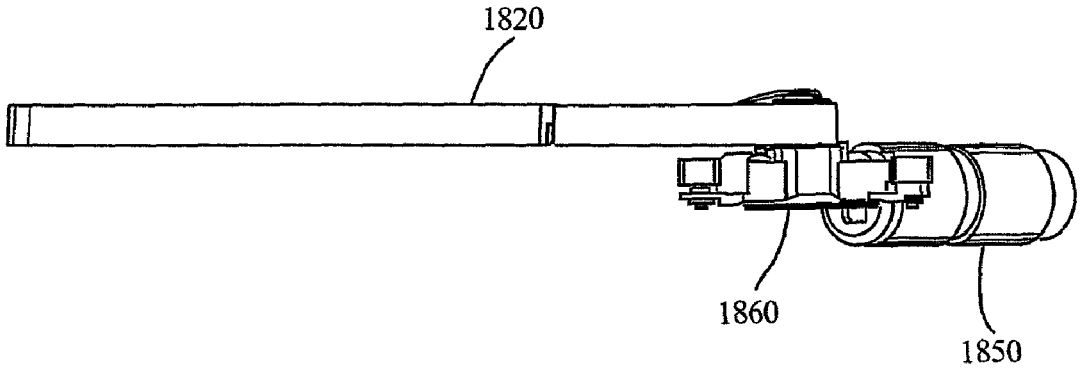
FIG. 39 is a side view of the blade, the deployment motor, and the deployment mechanism of FIG. 18.

Referring to FIG. 39 is a side view of the blade 1820, the deployment motor 1850, and the deployment mechanism 1860 of FIG. 18. Shown are the deployment motor 1850, the deployment mechanism 1860, and the blade 1820.

These structures operate substantially as described hereinabove with respect to FIG. 35.

Figure 40:
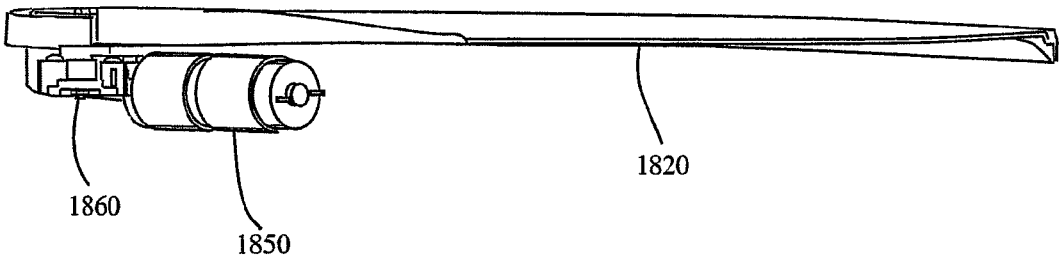
FIG. 40 is side view, viewed from a position 180° from that of FIG. 39, about an axis of rotation of the ceiling fan, of the blade, the deployment motor, and the deployment mechanism of FIG. 18.

Referring to FIG. 40 is side view, viewed from a position 180° from that of FIG. 39, about an axis of rotation of the ceiling fan, of the blade 1820, the deployment motor 1850, and the deployment mechanism 1860 of FIG. 18. Shown are the deployment motor 1850, the deployment mechanism 1860, and the blade 1820.

These structures operate substantially as described hereinabove with respect to FIG. 35.

Figure 41:
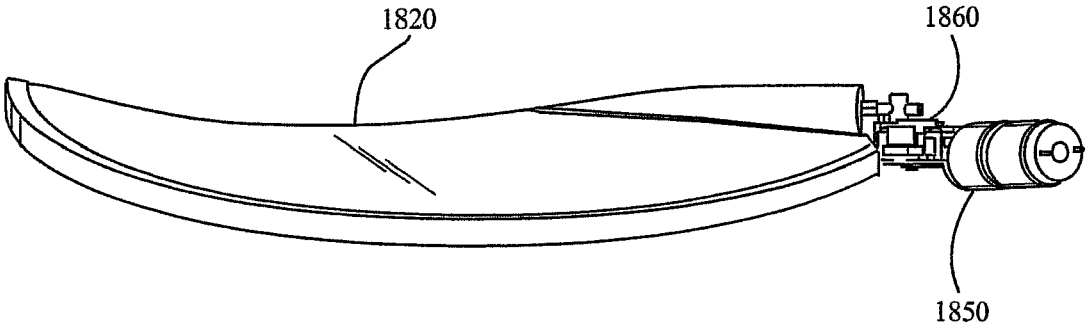
FIG. 41 is a side view of the blade, the deployment motor, and the deployment mechanism of FIG. 18, with the blade being in the deployed (or use) position, and having had its pitch altered for air movement.

Referring to FIG. 41, a side view is shown of the blade 1820, the deployment motor 1850, and the deployment mechanism 1860 of FIG. 18, with the blade 1820 being in the deployed (or use) position, and having had its pitch altered for air movement. Shown are the deployment motor 1850, the deployment mechanism 1860, and the blade 1820.

Of note, the blade 1820 is shown in a pitched position, i.e., a position in which the pitch of the blade 1820 has been altered from a plane parallel to the plane of the deck 1810. Advantageously, this positions the blade 1820 for the movement of air in response to the rotation of the blade 1820 about the main drive axis of the ceiling fan. These structures operate substantially as described hereinabove with respect to FIG. 35.

Figure 42:
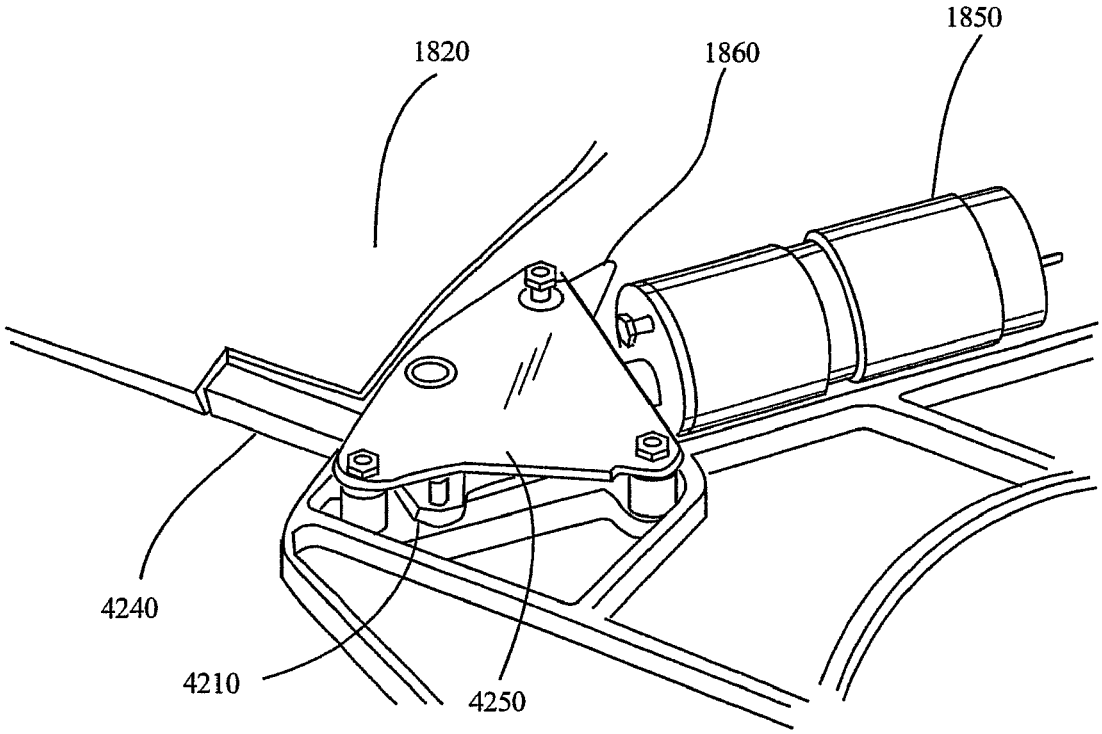
FIG. 42 is a top partial perspective view of the blade, the deployment motor, and the deployment mechanism of FIG. 18, with the deployment mechanism having an upper body member removed, so as to expose a deployment motor shaft, a worm gear, a deployment gear, and a deployment shaft.

Referring to FIG. 42, a top partial perspective view is shown of the blade 1820, the deployment motor 1850, and the deployment mechanism 1860 of FIG. 18, with the deployment mechanism 1860 having an upper body member removed, so as to expose a worm gear 4210, a deployment gear 4220, a blade shaft 4240, and a deployment motor shaft 4250.

The deployment motor 1850 is retractably coupled with the deployment motor shaft 4250, whereby upon actuation of the deployment motor 1850, a rotational motive force is applied to the deployment motor shaft 4250, causing the deployment motor 1850 to rotate the deployment shaft (not shown) about a deployment shaft axis. The deployment motor shaft 4250 is coupled to the worm gear 4210, and the worm gear 4210 is mated with the deployment gear 4220, which in turn is coupled with and rotates the deployment shaft. A blade shaft 4240 is coupled with the deployment shaft, and is substantially normal to the deployment shaft, such that when the deployment shaft is rotated, the blade shaft 4240 follows an arcuate path about the circumference of the deployment shaft.

Figure 43:
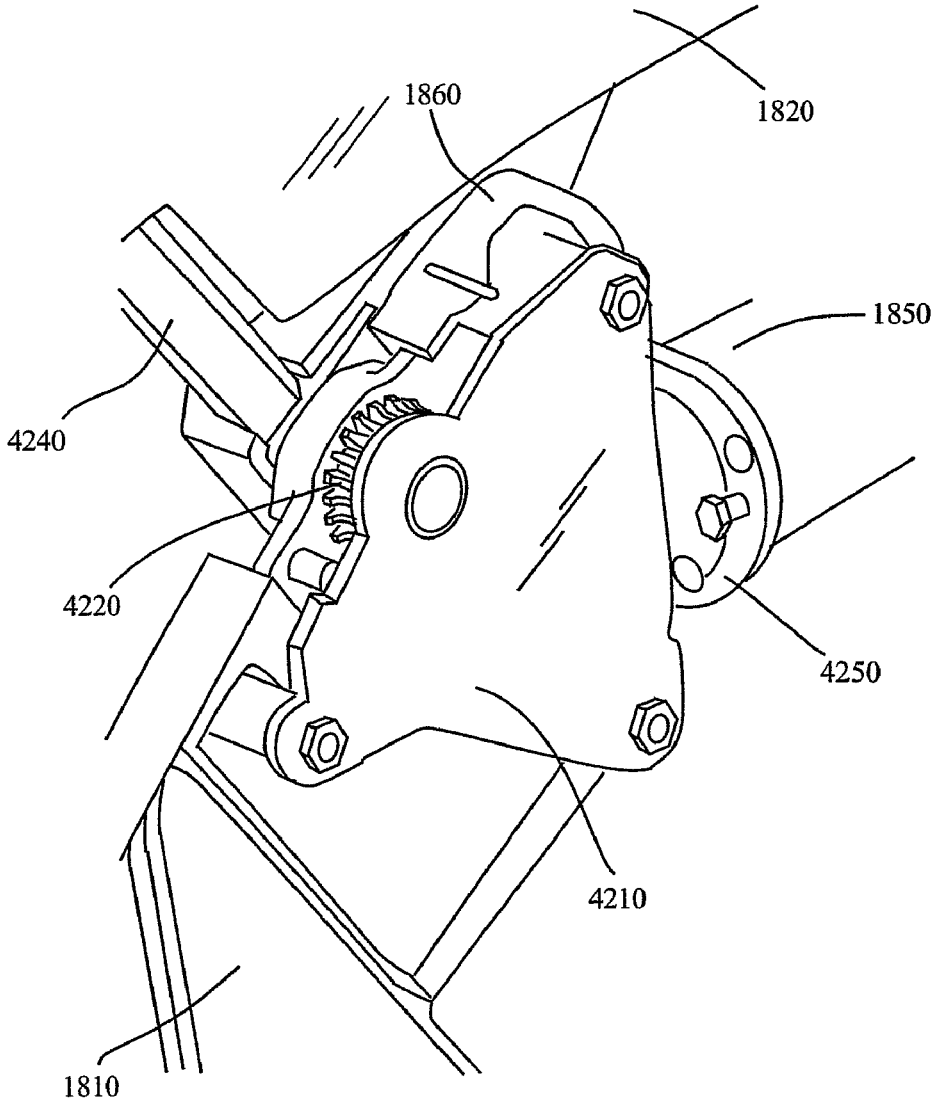
FIG. 43 is a top partial perspective view of a blade shaft, the deployment motor, and the deployment mechanism of FIG. 18, with the deployment mechanism having an upper body member removed, so as to expose a deployment motor shaft, and a worm gear, the deployment gear and a deployment shaft.

Referring to FIG. 43, a top partial perspective view is shown of a blade shaft 4240, the deployment motor 1850, and the deployment mechanism 1860 of FIG. 18, with the deployment mechanism 1860 having an upper body member removed, so as to expose a deployment motor shaft 4250, and a worm gear 4210, the deployment gear 4220, and a deployment shaft (not shown).

As shown, the deployment motor 1850 is mounted to the deck 1810, so as not to allow relative movement between the deployment motor 1850 and the deck 1810. Concentric with the deployment motor 1850 is a deployment shaft (not shown), which is rotatably coupled thereto. And the distal end of the deployment shaft is affixed a worm gear 4210 that rotates with the deployment shaft. The worm gear 4210 is mated with a deployment gear 4220, which is mounted to and in circles a deployment shaft which rotates about an axis substantially normal to an axis of rotation of the deployment motor shaft 4250. The deployment shaft passes through the deck 1810 to an underside of the deck 1810 where it is coupled with a blade shaft. The blade shaft is coupled to the deployment shaft in a substantially normal relationship such that when the deployment shaft is rotated the blade shaft as follows an arcuate path circumferential around the deployment shaft. The blade 1820 is affixed to the blade shaft 4240, such that the blade 1820 rotates about the axis of rotation of the deployment shaft upon rotation of the deployment shaft.

Figure 44:
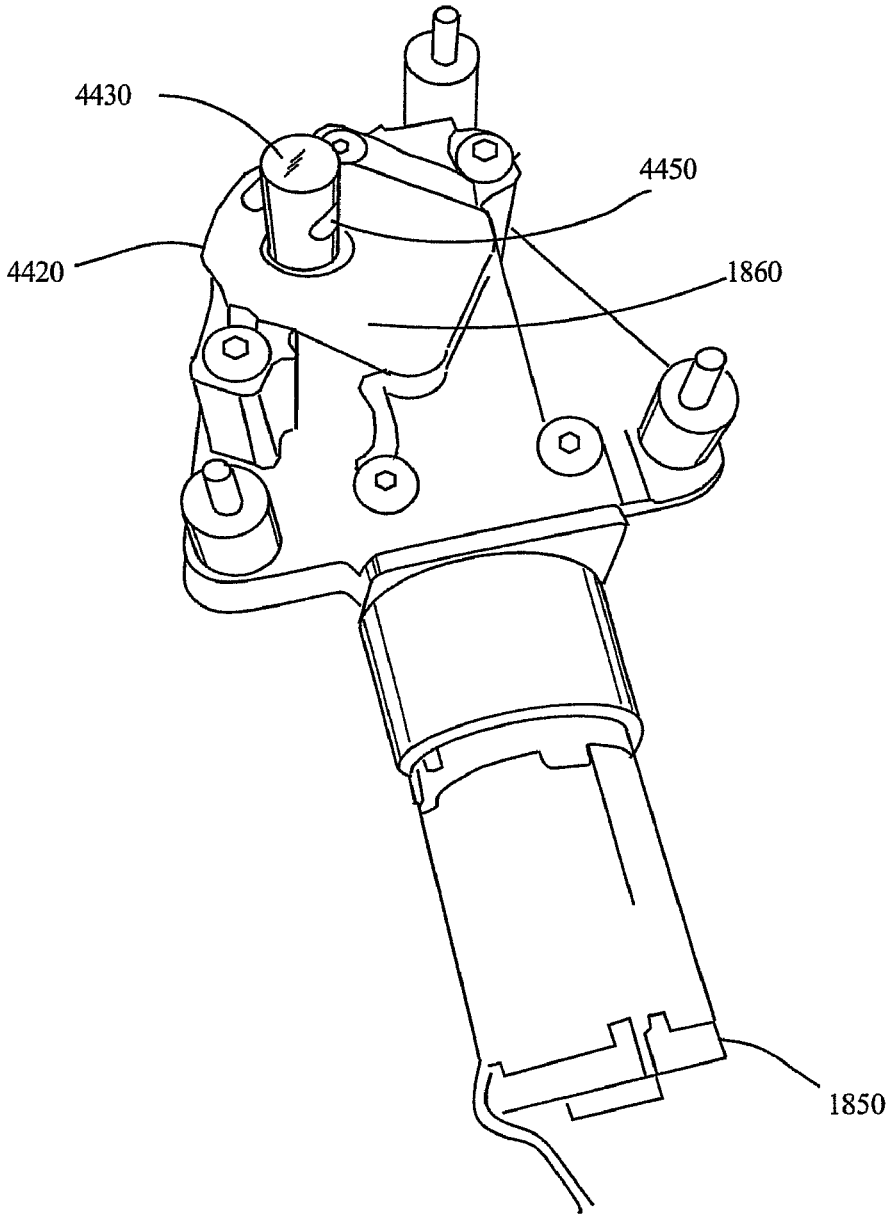
FIG. 44 is a bottom partial perspective view of the deployment motor, and the deployment mechanism of FIG. 18, with the deployment mechanism having a lower body member removed, so as to expose the deployment shaft.

Referring to FIG. 44, a bottom partial perspective view is shown of the deployment motor 1850, and the deployment mechanism 1860 of FIG. 18, with the deployment mechanism 1860 having a lower body member removed, so as to expose the deployment shaft 4430. Shown is the deployment motor 1850, the deployment mechanism 1860 having a lower body removed, a body 4420, and the deployment shaft 4430.

When the deployment motor 1850 is actuated, it imparts a rotational motion to the deployment shaft 4430 through the worm gear (not shown) and the deployment gear (not shown), as described hereinabove. A distal end of the deployment shaft 4430 protrudes through an underside of the body 4420, passing through the body 4420, and through the deck 1810 to the underside of the deck (not shown). As can be seen, a hole 4450 in the distal end of the deployment shaft 4430 has a central axis that passes through the axis of rotation of the deployment shaft 4430, and is normal thereto. It is through the hole 4450 that the blade shaft (not shown) is situated, such that the blade shaft rotates in an arcuate path about the deployment shaft 4430 in response to the turning of the deployment shaft 4430. Advantageously, the blade shaft is able to freely rotate around its central longitudinal axis, as the blade shaft is able to rotate in the hole 4450.

Figure 45:
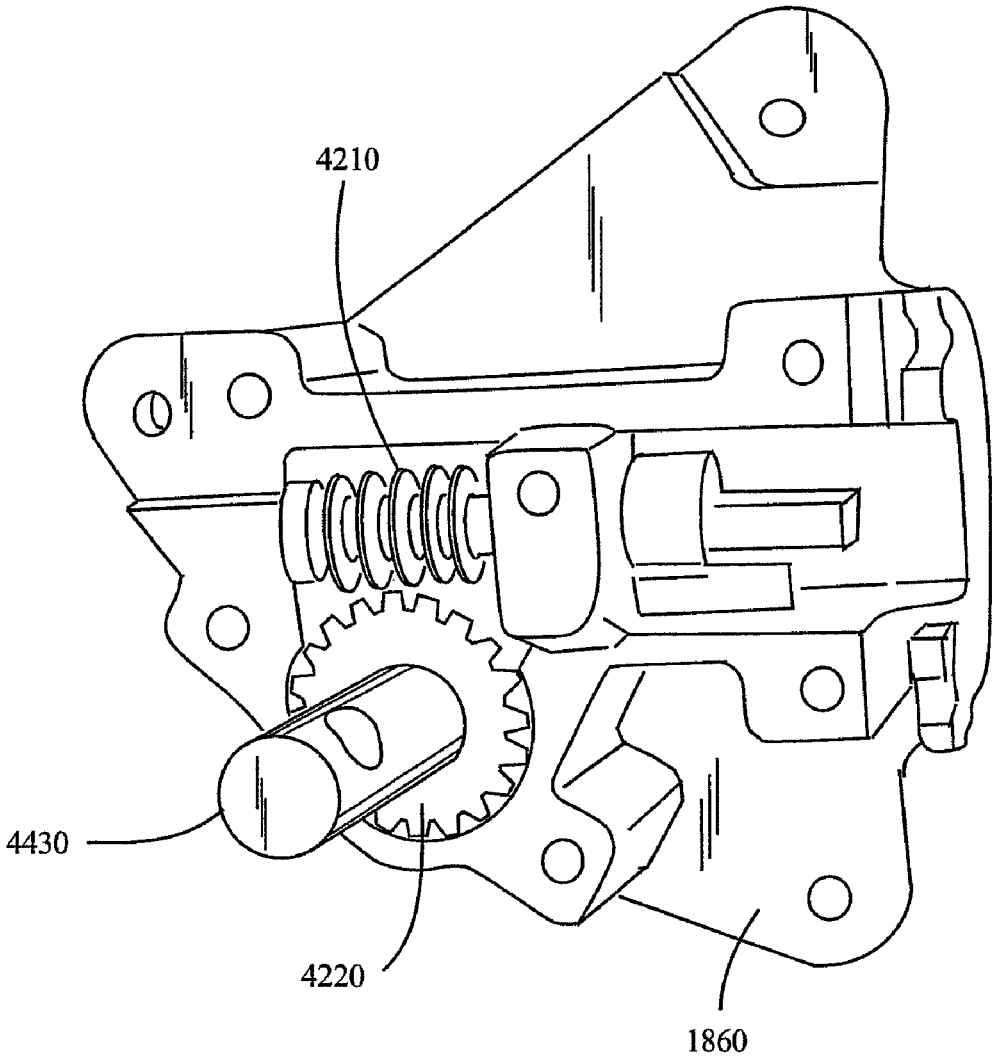
FIG. 45 is a top perspective view of the deployment mechanism of FIG. 18, with the deployment mechanism having an upper body member removed, so as to expose the worm gear, the deployment gear, and a deployment shaft.

Referring to FIG. 45, a bottom perspective view is shown of the deployment mechanism 1860 of FIG. 18, with the deployment mechanism 1860 having a lower body member removed, so as to expose the worm gear 4210 and the deployment gear 4220. As can be seen, the worm gear 4210 is mated with the deployment gear 4220 such that when the worm gear 4210 is rotated, the deployment gear 4220 is likewise rotated, with the axis of rotation of the deployment gear 4220 being normal to the axis of rotation of the worm gear 4210. The worm gear 4210 is affixed to the deployment shaft 4430, such that a motive force imparted to the deployment shaft 4430 by the deployment motor 1850 is imparted to the worm gear 4210 upon actuation of the deployment motor 1850.

Figure 46:
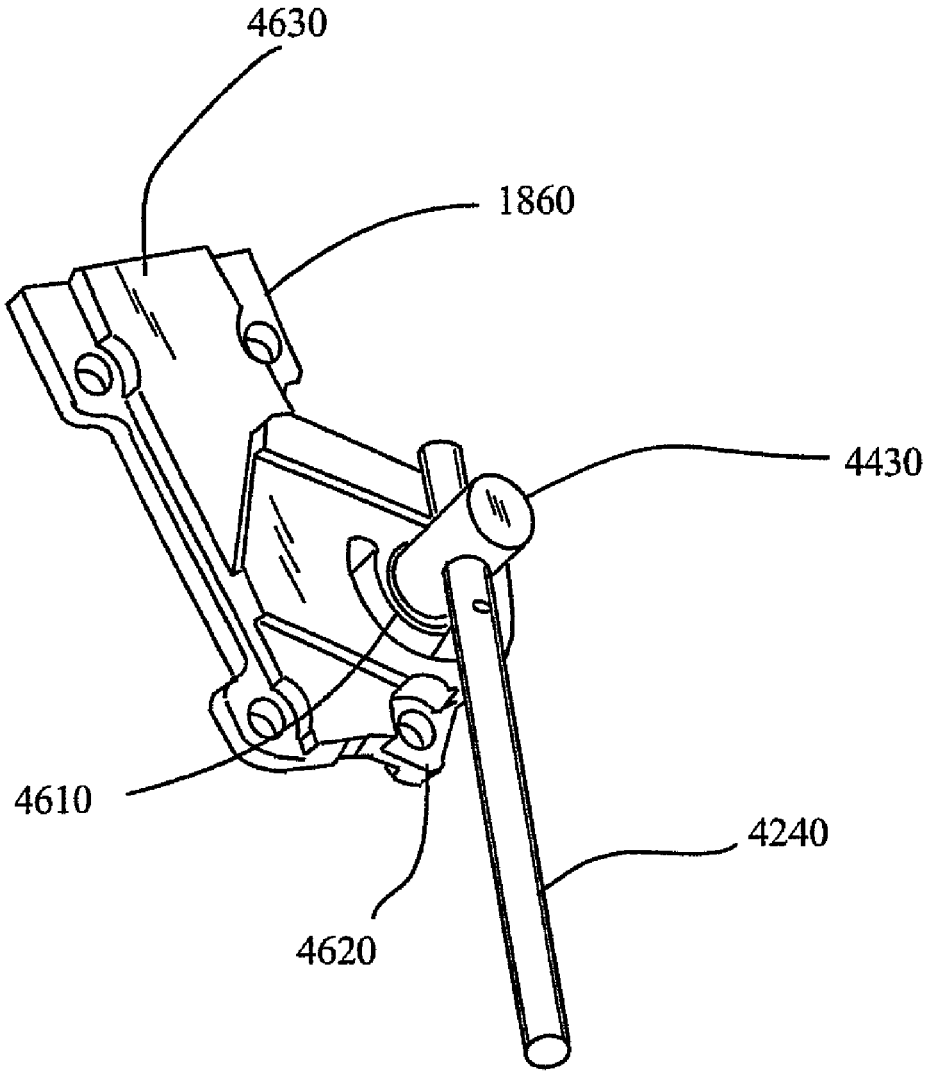
FIG. 46 is a bottom perspective view of the deployment mechanism of FIG. 18, with the deployment mechanism having a lower body member removed, so as to expose the deployment shaft and the blade shaft.

Referring to FIG. 46, a bottom perspective view is shown of the deployment mechanism of FIG. 18, with the deployment mechanism 1860 having a lower body member removed, so as to expose the deployment shaft 4450 and the blade shaft 4240. Shown are a lower body 4630, deployment shaft 4430, the blade shaft 4240, an arcuate slot 4610, and a pin 4620. In practice when a rotational force is applied to the deployment shaft 4430, the blade shaft 4240 assumes an arcuate, circumferential path around the perimeter of the deployment gear (not shown). Of significance, the blade shaft 4240 is free to rotate within the hole in which it is situated in the deployment shaft 4430. This allows the blade shaft 4240 (and the blade) to rotate about a central longitudinal axis of the blade shaft 4240. The pin 4620 travels within the arcuate slot 4610 as the blade shaft 4240 rotates about the deployment shaft 4430. As can be seen, the arcuate slot 4610 as a first end and the second end. The blade is held in a substantially coplanar relationship with the deck as it rotates about the deployment shaft 4430. However, when the pin 4620 reaches a second end of the arcuate slot 4610, continued rotation of the deployment shaft 4430 causes the pin 4620 to rotate the blade shaft 4240, and thus to impart a pitch to the blade (not shown), thereby positioning the blade for the movement of air in response to the rotation of the main drive motor about the main drive shaft (not shown).

Figure 47:
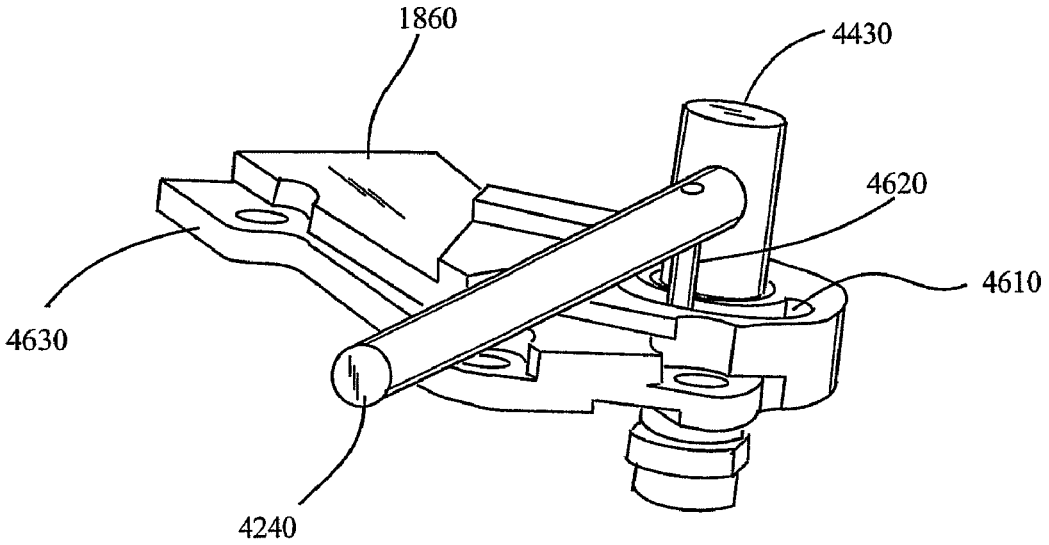
FIG. 47 is another bottom perspective view of the deployment mechanism of FIG. 18, with the deployment mechanism having a lower body member removed, so as to expose the deployment shaft and the blade shaft.

Referring to FIG. 47, another bottom perspective view is shown of the deployment mechanism of FIG. 18, with the deployment mechanism having a lower body member removed, so as to expose the deployment shaft 4430 and the blade shaft 4240. Shown are the lower body 4630, the deployment shaft 4430, the blade shaft 4240, the pin 4620, and this arcuate slot 4610. At a proximal end of the deployment shaft 4430, the deployment gear is mounted (not shown). Also shown are the first end and the second end of the arcuate slot 4610, the second end engaging a pin 4620 in response to rotation of the deployment shaft 4430, and thereby imparting a rotational force to the blade shaft 4240.

Figure 48:
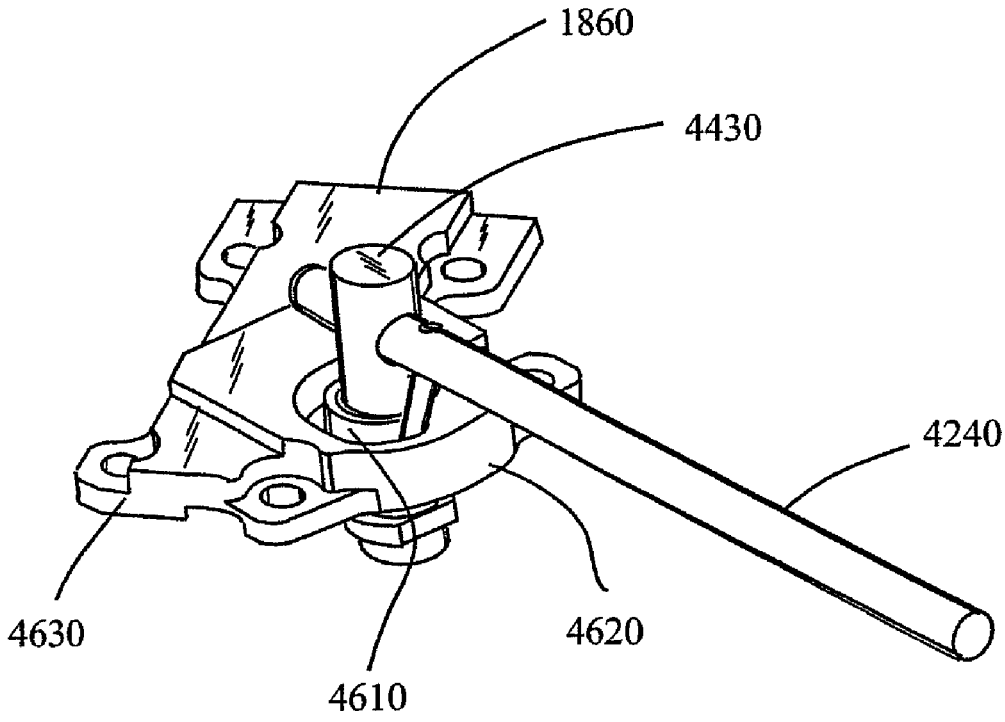
FIG. 48 is yet a further bottom perspective view of the deployment mechanism of FIG. 18, with the deployment mechanism having a lower body member removed, so as to expose the deployment shaft and the blade shaft.

Referring to FIG. 48, yet a further bottom perspective view is shown of the deployment mechanism of FIG. 18, with the deployment mechanism having a lower body member removed, so as to expose the deployment shaft 4450 and the blade shaft 4240. Shown are the lower body, the deployment shaft 4430, the blade shaft 4240, the pin 4620, and the arcuate slot 4610. Operation of the structures is described hereinabove with references to FIGS. 42 through 47.

Figure 49:
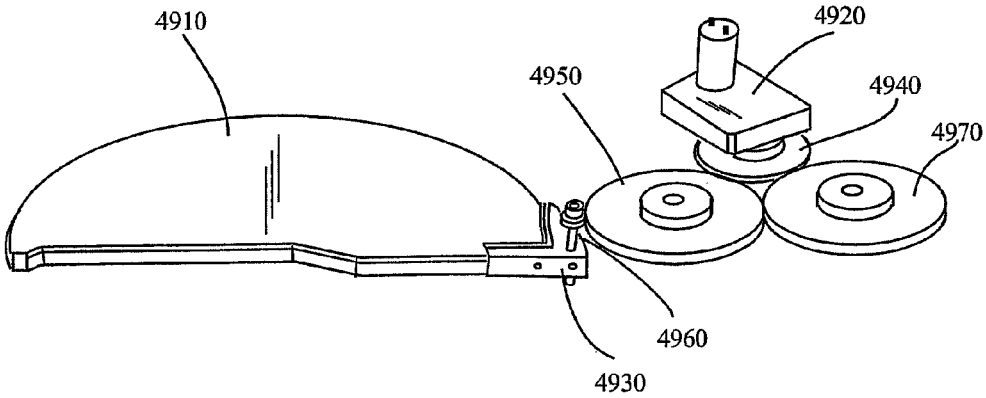
FIG. 49 is a top perspective view of an alternative deployment mechanism, such as may be used in the deck assembly of FIG. 18, showing the blade, a deployment motor, and a deployment mechanism, including a gear train, a deployment gear, and a deployment shaft.

Referring to FIG. 49, a top perspective view is shown of an alternative deployment mechanism, such as may be used in the deck assembly of FIG. 18, showing a blade 4910, a deployment motor 4920, and a deployment mechanism 4930 that includes a deployment gear 4950, and a deployment shaft 4960. Shown are the deployment motor 4920, a drive gear 4940, a transfer gear 4970, and a deployment gear 4950. Also shown are a deployment shaft 4960, and the blade 4910. Upon actuation, the deployment motor 4920 turns the drive gear 4940, which turns the transfer gear 4970, thereby imparting a rotational force to the deployment gear 4950. The deployment gear 4950 imparts a rotational force to the deployment shaft 4960, which in turn imparts a rotational force to the blade 4910. Advantageously, the use of multiple gears allows for a single deployment motor to be used in the deployment of multiple blades. Disadvantageously, this may create complexities with regard to the balancing of the ceiling fan, which can be an important design consideration.

Figure 50:
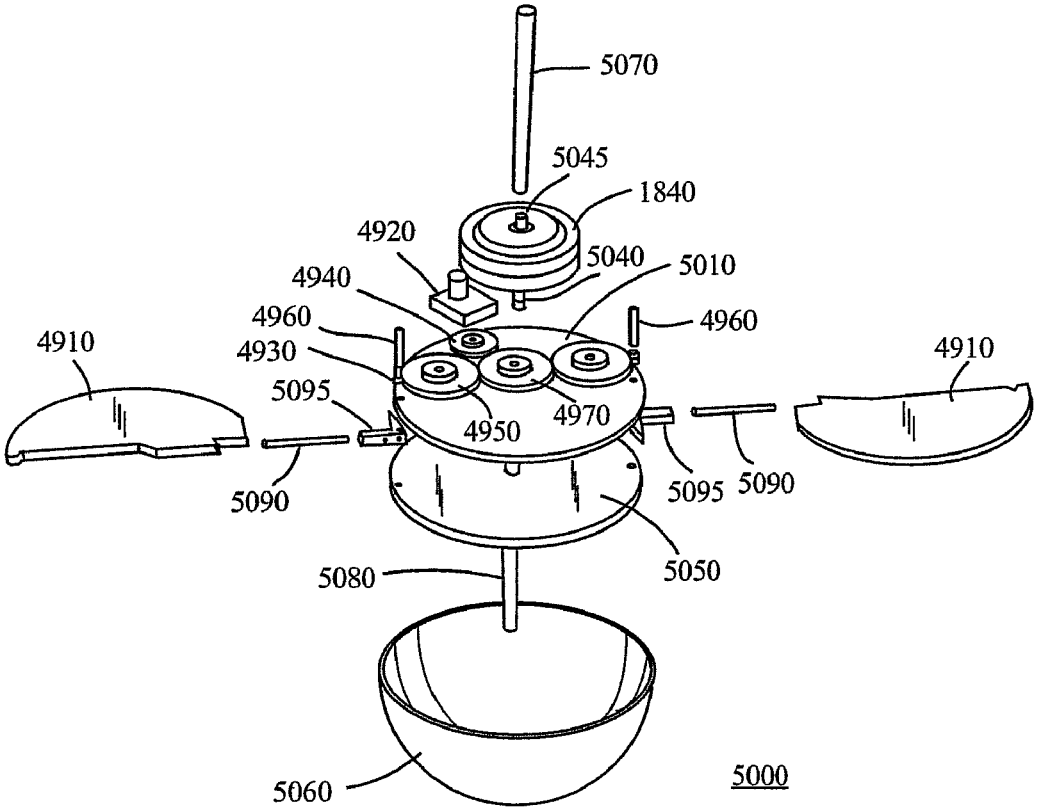
FIG. 50 is an exploded perspective view of the alternative deployment mechanism of FIG. 49, such as may be used in the deck assembly of FIG. 18, in a further variation of the ceiling fan of FIGS. 1-2, showing the deck, the blade, the main drive motor, the main drive shaft, the deployment motor, the deployment mechanism, a lower plate, and a light cover, wherein the deployment mechanism includes a gear train, a deployment gear, and a deployment shaft.

Referring to FIG. 50, an exploded perspective view is shown of the alternative deployment mechanism, such as may be used in the deck assembly of FIG. 18, in a further variation of the ceiling fan of FIGS. 1-2, showing an upper deck 5010, a plurality of blades 4910, the main drive motor 1840, the main drive shaft 5040, the deployment motor 4920, a lower plate 5050, a light cover 5060, the drive gear 4940, the transfer gear 4970, the deployment gear 4950, and a deployment shaft 4960.

The ceiling fan assembly 5000 is suspended from a support rod 5070. The main drive motor 1840 rotates the ceiling fan assembly to move air during normal operation. The support rod 5070 is rigidly mounted to a non-rotatable element 5045 of the main fan motor 1840. A rotatable element 5040 of main fan motor 1840 is rigidly mounted to upper deck 5010. The upper deck 5010 is rigidly connected to a lower deck 5050, with the two decks 5010 and 5050 providing structural support for the blades 4910. Thus the main fan motor 1840 is able to rotate the lower deck 5050, the upper deck 5010, and the blades 4910 when the ceiling fan is in operation. The light cover 5060 is rigidly mounted to a lower rod 5080, which passes through the center of the lower deck 5050 and upper deck 5010, and attaches to a non-rotatable element 5040 of the main fan motor 1840. (A bearing means would typically be provided that allows support plates to rotate relative to rod during fan operation.) Thus the lower light cover 5060 does not rotate during ceiling fan operation, when the lower deck 5050, upper deck 5010, and the blades 4910 are rotating. The upper housing (not shown) is fixed to a non-rotatable element 5045 of the main fan motor 1840 so that the upper housing does not rotate while the fan is in operation. The deployment motor 4920 and the entire blade deployment mechanism 4930 rotate with the blades 4910 when the ceiling fan is in operation in this embodiment.

In this embodiment, deployment and retraction of blades 4910 between the stored position and the deployed position is accomplished by moving the blades 4910 relative to the upper deck 5010 and lower deck 5050. The deployment motor 4920 is rigidly mounted to the upper deck 5010. The output shaft (not shown) of the deployment motor 4920 is attached to the drive gear 4940. The drive gear 4940 is meshed to the transfer gear 4970 which is meshed with the deployment gear 4950, all of which are rotatably mounted to the upper deck 5010. Thus, actuation of deployment motor 4920 will cause deployment gear 4950 to rotate relative to the upper deck 5010. The last element of the deployment mechanism is the blade pinion 4960, which is located normal to the upper deck plane and rotatably mounted to the upper deck 5010. Thus actuation of the deployment motor 4920 will cause the pin 4960 to rotate relative to upper deck 5010.

For each blade 4910 of the ceiling fan 5000, pin 4960 is rigidly attached to blade mount shaft 5090. Blade mount shaft 5090 is rotatably mounted to upper deck 5010 and lower deck 5050. Blade holder 5095 is rigidly mounted to blade mount shaft 5090 and resides in the space between upper deck 5010 and lower deck 5050. Thus rotation of blade pinion 4930 will cause blade holder 5095 to rotate in the space between upper deck 5010 and lower deck 5050.

The blade 4910 is mounted to blade holder 5095 via blade holder shaft 5090. Thus rotation of blade holder 5095 causes blade 4910 to rotate into and out of the space between upper deck 5010 and lower deck 5050. In this embodiment the space between upper deck 5010 and the lower deck 5050 is storage space for the blades when the ceiling fan 5000 is not in use. Note that in typical fan operation, it will be desirable to adjust the pitch angle of blades 4910. The preferred embodiment of the invention would provide a means of adjusting the pitch angle of blade 4910 relative to blade holder 5095 (for example by rotating blade shaft 5090).

Figure 51:
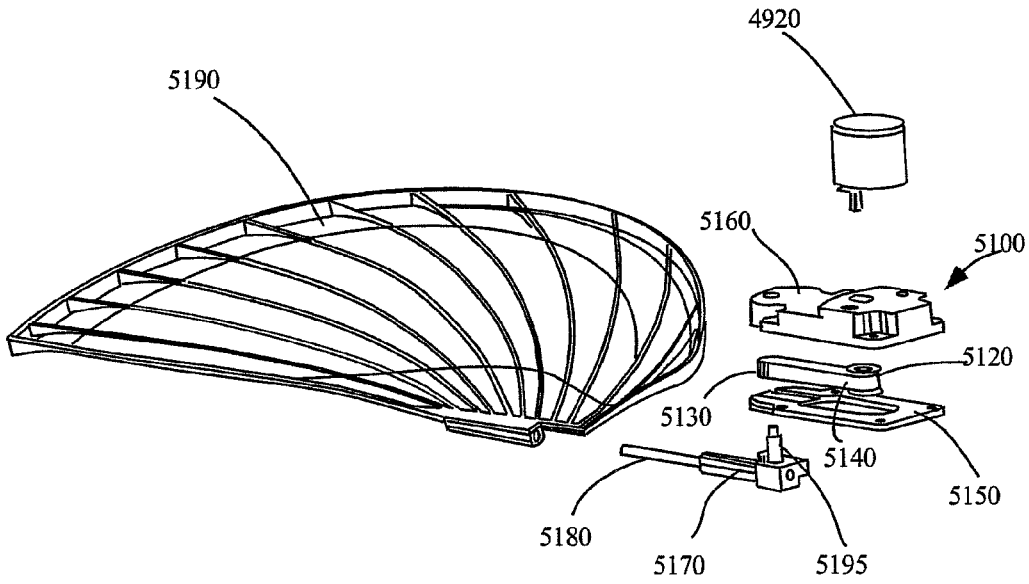
FIG. 51 is an exploded perspective view of an alternative deployment mechanism, such as may be used in the deck assembly of FIG. 18, showing the deployment motor, an upper body member of the deployment mechanism, a first spindle, a second spindle, a belt, a lower body member of the deployment mechanism, the deployment shaft, the blade shaft, and the blade.

Referring to FIG. 51, an exploded perspective view is shown of an alternative deployment mechanism 5100, such as may be used in the deck assembly of FIG. 18, showing the deployment motor 4920, an upper body member of the deployment mechanism 5160, a first spindle 5120, a second spindle 5130, a belt 5140, a lower body member 5150 of the deployment mechanism 5100, a deployment shaft 5195, the blade shaft 5180, and the blade 5190.

The deployment motor shaft (not shown) connects to spindle 5130 to transmit rotary motion to belt 5140. Belt 5140 in this embodiment would preferably be a toothed-type timing belt. Belt 5140 transmits the rotary motion from motor 4920 ultimately to blade 5190.

Figure 52:
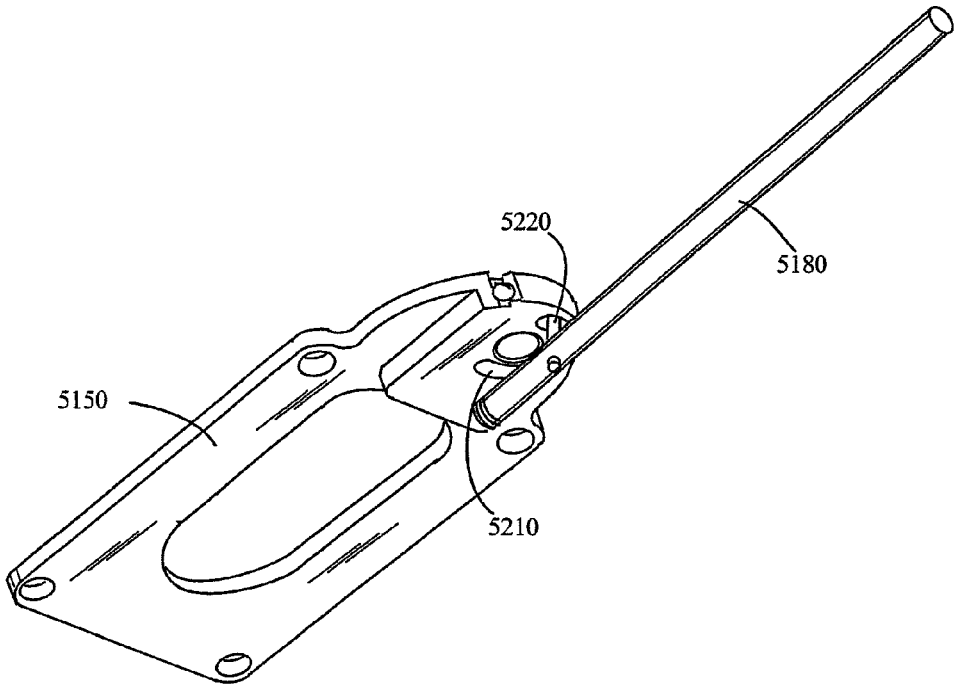
FIG. 52 is a partial perspective view of the lower body member of the deployment mechanism of FIG. 51, the blade shaft, a lever arm, and a slot.

Referring to FIG. 52, a partial perspective view is shown of a lower body member 5150 of the deployment mechanism 5100 of FIG. 51, the blade shaft 5180, a pin 5220, and a slot 5210.

The structure of FIG. 52, are described hereinbefore with reference to FIG. 51.

Figure 53:
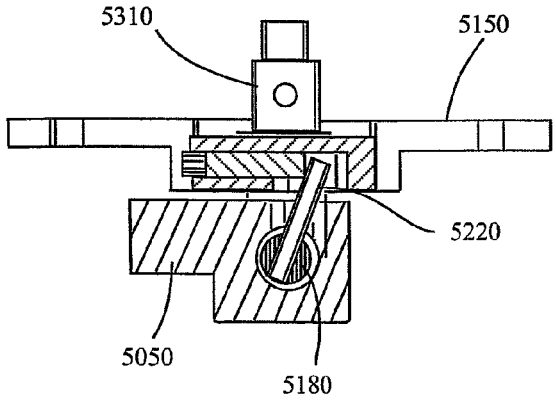
FIG. 53 is a partial cross-sectional view of the lower body member, the deployment shaft, the lever arm, the slot, and the blade of FIG. 51.

Referring to FIG. 53, a partial cross-sectional view is shown of the lower body member 5150, the deployment mechanism of FIG. 52. Shown are a blade shaft 5180, a deployment shaft 5310, and the pin 5220, in cross-section.

The structures of FIG. 53, are described hereinbefore with reference to FIG. 51 and FIG. 52.

Figure 54:
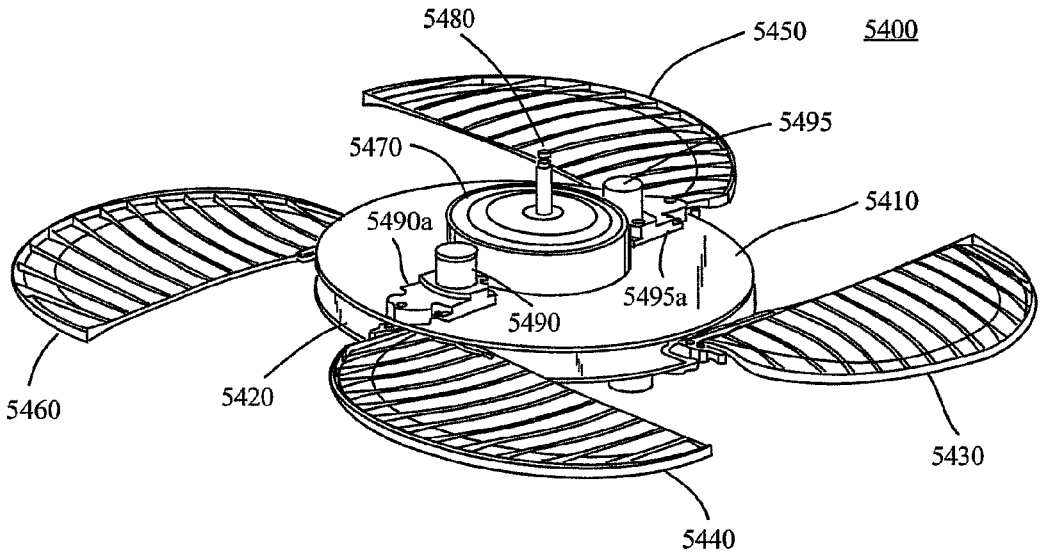
FIG. 54 is a top perspective view of a stacked deck assembly, such as may be used in the variation of the ceiling fan of FIGS. 12-17, showing a first deck, a second deck, a first blade, a second blade, a third blade, a fourth blade, a main drive motor, a main drive shaft, a first deployment motor, a second deployment motor, a first deployment mechanism, a second deployment mechanism (with a third deployment motor, a fourth deployment motor, a third deployment mechanism, and a fourth deployment mechanism not being visible in this top perspective view), with the blades being in the partially deployed position.

Referring to FIG. 54, a top perspective view is shown of a stacked deck assembly 5400, such as may be used in the variation of the ceiling fan of FIGS. 12-17, showing a first deck 5410, a second deck 5420, a first blade 5430, a second blade 5440, a third blade 5460, a fourth blade 5450, a main drive motor 5470, a main drive shaft 5480, a first deployment motor 5490, a second deployment motor 5495, a first deployment mechanism 5490A, a second deployment mechanism 5495A (with a third deployment motor, a fourth deployment motor, a third deployment mechanism, and a fourth deployment mechanism not being visible in this top perspective view), with the blades 5430, 5440, 5450, and 5460 being in the partially deployed position.

The lower two-blade module is clocked 90 degrees from the upper two-blade module. This puts the four blades at an optimum spacing for air movement, balance, and appearance. Note that in this embodiment the upper and lower modules are fixed in angular orientation relative to each other and they occupy essentially different planes. This allows for a minimum blade storage configuration.

In one variation of the present embodiment, one pair of blades may be deployed, while the other pair remain stowed, and vice versa. Advantageously, this allows, for example one decorative style of blades to be deployed or another decorative style of blades to be deployed, e.g., to match décor, bedding, table linens or the like, or to deploy one blade design that is more "formal" in character, and another blade design that is more "casual" in character. The color, shape, design, pattern, and/or material, etc. of the respective pairs of blades may be different. And, the present variation is not limited to two pairs of blades, e.g., two pairs of blades (four blades) may be deployed together and two other pairs (four blades) may be deployed. Selection of the blades to be deployed may be effected by a variation of the controller described herein.

In a further variation of the present embodiment, one pair of blades may be deployed, while the other pair remain stowed, and then the other pair be deployed while the one pair remains deployed, so that either two deployed blades, or four deployed blades may be selected. (As will be appreciated, any number of blades may be selectively deployed, so long as proper fan balance is taken into account. In this way, a greater of a lesser amount of air movement may be effected by selecting more or fewer blades deployed, respectively. Section of two blades or four blades, for example, for deployment may be effected by a variation of the controller described herein.

Figure 55:
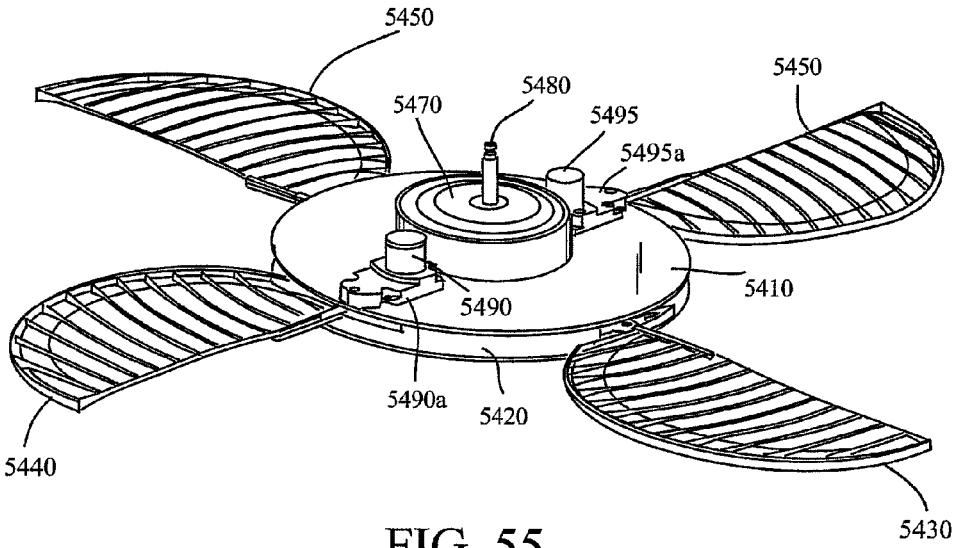
FIG. 55 is a top perspective view of a stacked deck assembly, such as may be used in the variation of the ceiling fan of FIGS. 12-17, showing a first deck, a second deck, a first blade, a second blade, a third blade, a fourth blade, a main drive motor, a main drive shaft, a first deployment motor, a second deployment motor, a first deployment mechanism, a second deployment mechanism (with a third deployment motor, a fourth deployment motor, a third deployment mechanism, and a fourth deployment mechanism not being visible in this top perspective view), with the blades being in the deployed (or use) position.

Referring to FIG. 55, a top perspective view is shown of a stacked deck assembly 5400, such as may be used in the variation of the ceiling fan of FIGS. 12-17, showing a first deck 5410, a second deck 5420, a first blade 5430, a second blade 5440, a third blade 5460, a fourth blade 5450, a main drive motor 5470, a main drive shaft 5480, a first deployment motor 5490, a second deployment motor 5495, a first deployment mechanism 5490A, a second deployment mechanism 5495A (with a third deployment motor, a fourth deployment motor, a third deployment mechanism, and a fourth deployment mechanism not being visible in this top perspective view), with the blades 5430, 5440, 5450, and 5460 in their fully deployed position but have not yet been pitched up to move air.

The embodiment shows two blades per module. Other embodiments could have three or more embodiments per planar module. The two-blade configuration shown has certain advantages of maximum diameter for a given size of base plate 11 and overall blade area for moving air. Other embodiments with different numbers of blades per module could provide advantages for certain aesthetic designs or for operation in limited spaces.

Figure 56:
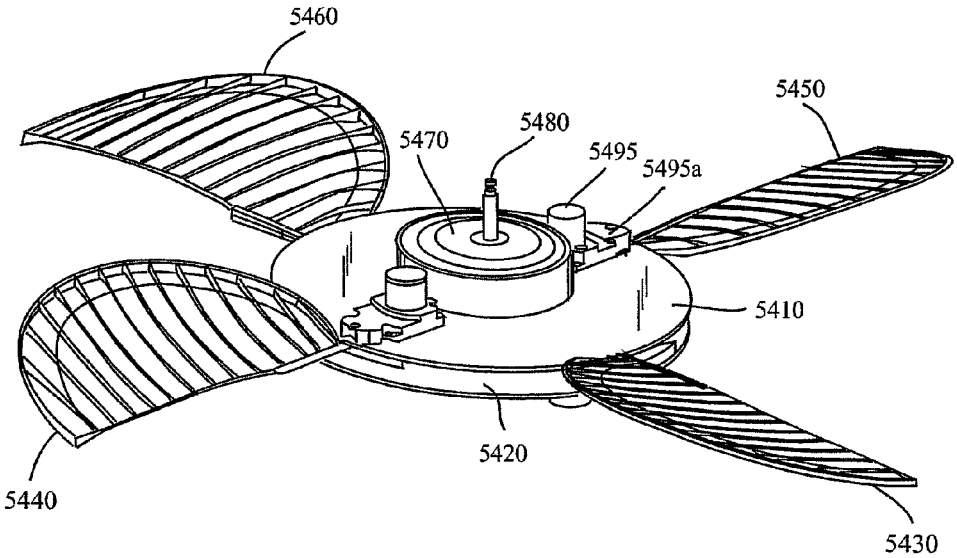
FIG. 56 is a top perspective view of a stacked deck assembly, such as may be used in the variation of the ceiling fan of FIGS. 12-17, showing a first deck, a second deck, a first blade, a second blade, a third blade, a fourth blade, a man drive motor, a main drive shaft, a first deployment motor, a second deployment motor, a first deployment mechanism, a second deployment mechanism (with a third deployment motor, a fourth deployment motor, a third deployment mechanism, and a fourth deployment mechanism not being visible in this top perspective view), with the blades being in the deployed (or use) position, and having had their pitch altered for air movement.

Referring to FIG. 56, a top perspective view is shown of a stacked deck assembly 5400, such as may be used in the variation of the ceiling fan of FIGS. 12-17, showing a first deck 5410, a second deck 5420, a first blade 5430, a second blade 5440, a third blade 5460, a fourth blade 5450, a main drive motor 5470, a main drive shaft 5480, a first deployment motor 5490, a second deployment motor 5495, a first deployment mechanism 5490A, a second deployment mechanism 5495A (with a third deployment motor, a fourth deployment motor, a third deployment mechanism, and a fourth deployment mechanism not being visible in this top perspective view), with the blades 5430, 5440, 5450, and 5460 in their fully deployed position and pitched up to move air.

The embodiment shows two blades per module. Other embodiments could have three or more embodiments per planar module. The two-blade configuration shown has certain advantages of maximum diameter for a given size of base plate 11 and overall blade area for moving air. Other embodiments with different numbers of blades per module could provide advantages for certain aesthetic designs or for operation in limited spaces.

Figure 57:
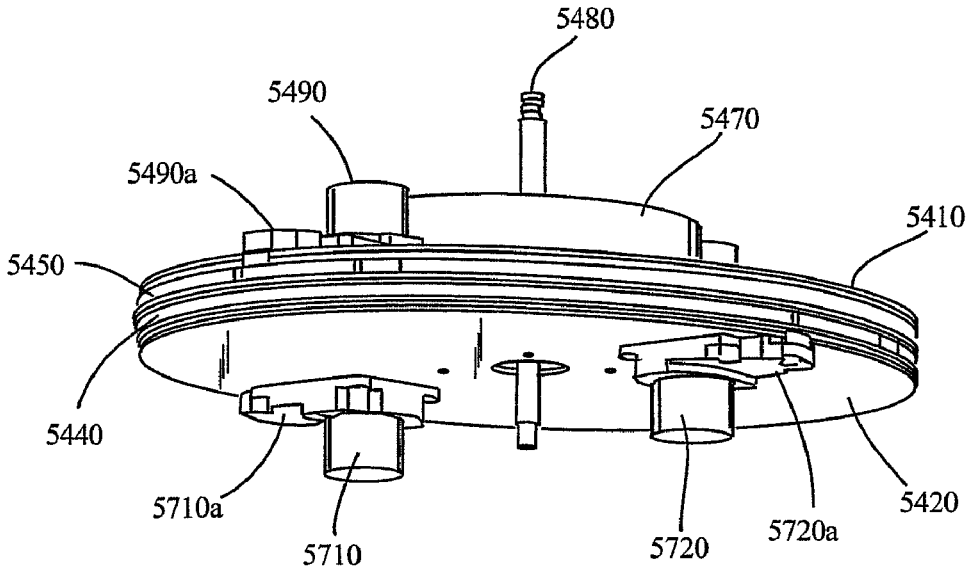
FIG. 57 is a bottom perspective view of a stacked deck assembly, such as may be used in the variation of the ceiling fan of FIGS. 12-17, showing a first deck, a second deck, a main drive motor, a main drive shaft, a first deployment motor, a second deployment motor, a third deployment motor, a fourth deployment motor, a second deployment mechanism, a third deployment mechanism, and a fourth deployment mechanism (a first deployment mechanism not being visible in this bottom perspective).

Referring to FIG. 57, shown is a bottom perspective view, showing a stacked deck assembly, such as may be used in the variation of the ceiling fan, showing a first deck, a second deck, a main drive motor, a main drive shaft, a first deployment motor, a second deployment motor, a third deployment motor, a fourth deployment motor, a second deployment mechanism, a third deployment mechanism, and a fourth deployment mechanism (a first deployment mechanism not being visible in this bottom perspective).

The structure of FIG. 57, are described hereinbefore with reference to FIG. 54-56.

Figure 58:
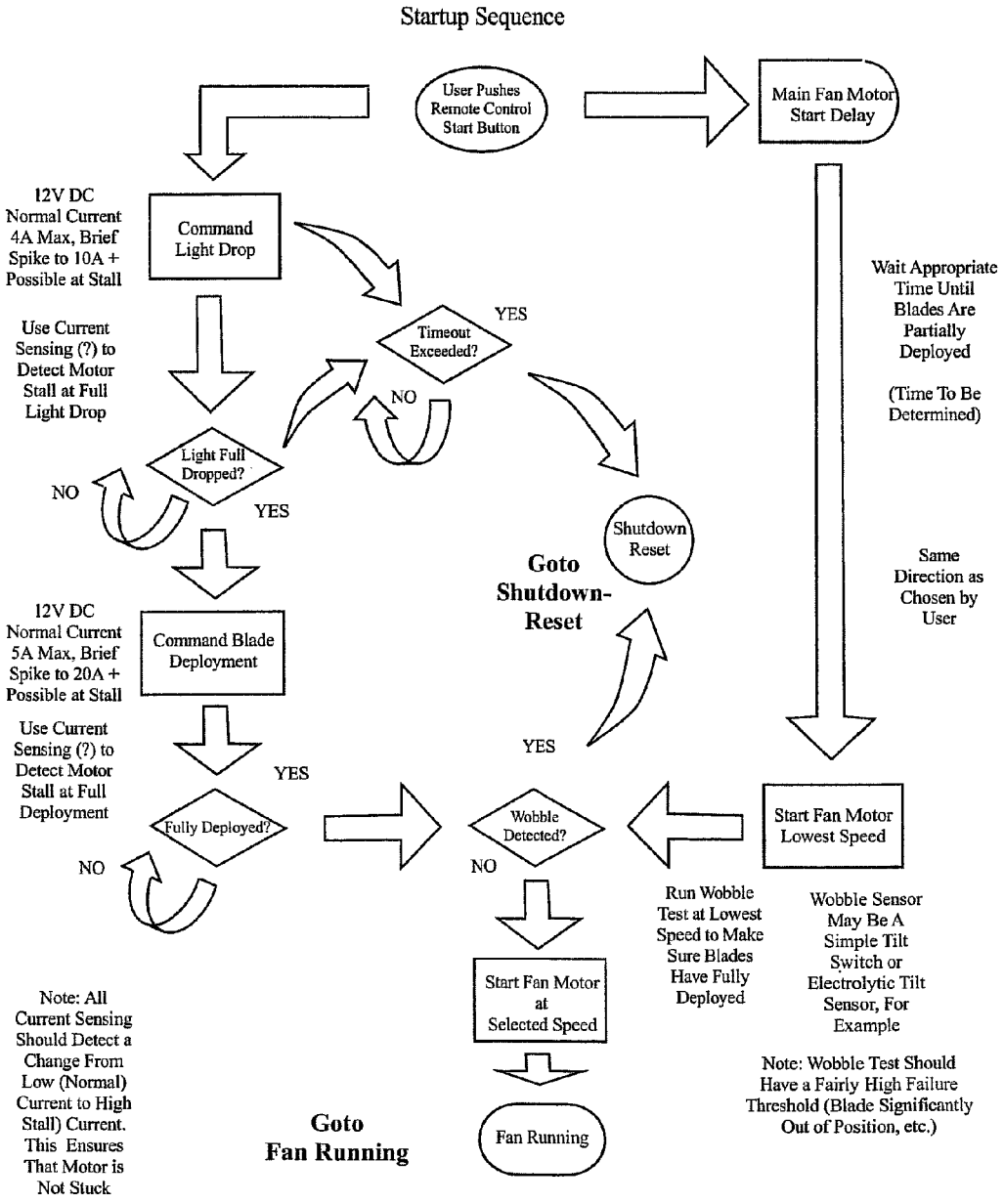
FIG. 58 is a flow diagram illustrating a "startup" sequence employed by a control system for controlling the ceiling fan described of the various embodiments described hereinabove in reference to FIGS. 1 through 57.

Referring to FIG. 58, a flow diagram is shown illustrating a "startup" sequence employed by a control system for controlling the ceiling fan described of the various embodiments described hereinabove in reference to FIGS. 1 through 57.

At the outset, a signal is sent (such as by the activation of a wall switch, a switch accessible from the housing of the ceiling fan, or a wired or wireless remote control) to a control device (such as a microcontroller or a microprocessor, modified with control software that controls one or more electromechanical or solid state switches that control the application of power to the main drive motor, the deployment motor(s), the light cover deployment motor, one or more mechanical or electrical switches or shifting mechanisms) initiating the startup sequence.

In response thereto, in accordance with one embodiment, a main drive motor and the deployment motor(s) are activated. The main drive motor is activated after a time delay (i.e. a time period sufficient to allow the blades to at least partially deploy, which may include time needed for a light cover to lower).

After the time delay, the main drive motor starts to turn the deck (in a direction selected by a user) at a low speed allowing the control device to run a wobble test to ensure that the blades have fully deployed (using wobble sensors such as a simple tilt switch or an electrolytic tilt sensor). If a wobble is detected (i.e. blades have not fully deployed and are significantly out of position), the control will go to "shutdown" sequence, as described herein below, and the control will stop the main drive motor from rotating. However, if a wobble is not detected, the control will start the fan at a speed selected by the user.

The "startup" sequence may also involve the controller commanding a lowering of a light cover (or housing). After detecting (via sensors, such as a current sensor) that the light cover has lowered, the control activates the blade deployment motor(s) and the main drive motor (provided that a wobble is not detected). However, if the control detects that the light cover has not fully lowered after a specified time, the control will go to "shutdown" mode as described herein below.

Figure 59:
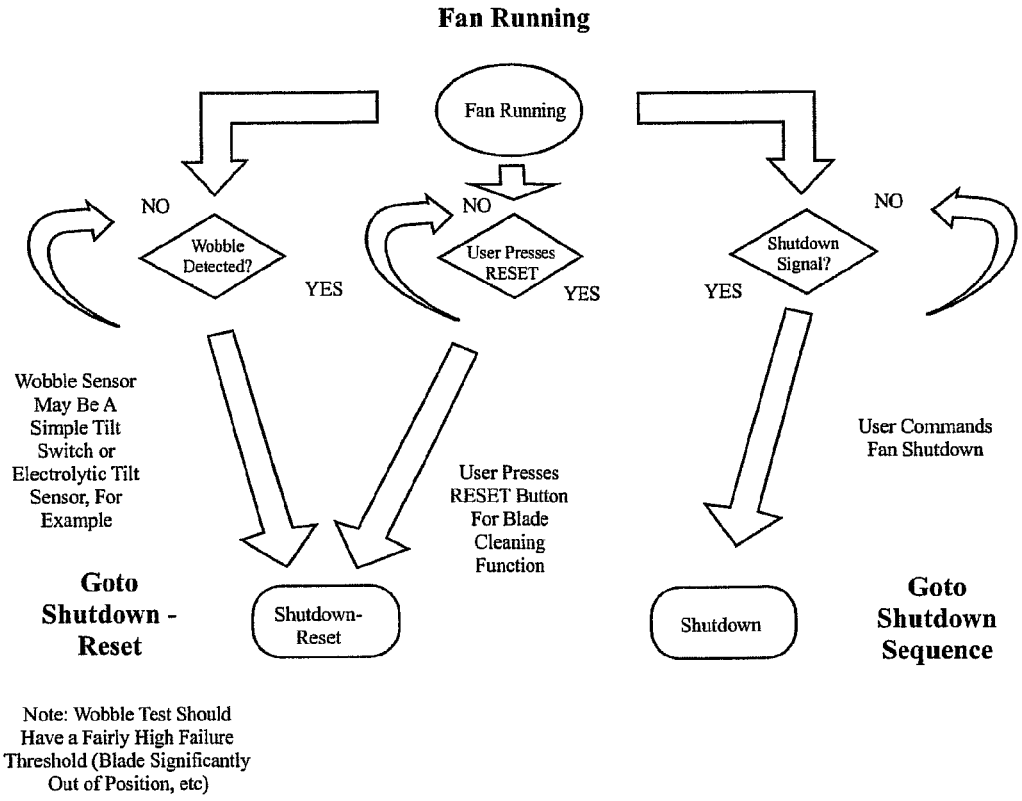
FIG. 59 is a flow diagram illustrating a "run" sequence employed by a control system for controlling the ceiling fan described of the various embodiments described hereinabove in reference to FIGS. 1 through 57.

Referring to FIG. 59, a flow diagram is shown illustrating a "running" sequence employed by a control system for controlling the ceiling fan described of the various embodiments described hereinabove in reference to FIGS. 1 through 57.

At the outset, the control device (such as a microcontroller or microprocessor modified with control software that controls one or more electromechanical or solid state switches that control the application of power to the main drive motor, the deployment motor(s), the light cover deployment motor, one or more mechanical or electrical switches or shifting mechanisms) continuously operates the fan at a desired speed and direction until a signal is received, either from a user controlled device, indicating a "shutdown" or a "reset" of the fan, or via a wobble sensor (such as a simple tilt switch or an electrolytic tilt sensor) indicating an imbalance in the fan blades relative to the entire fan.

In response thereto, in accordance with one embodiment, the controller will go to a "shutdown" sequence as described herein below.

Figure 60:
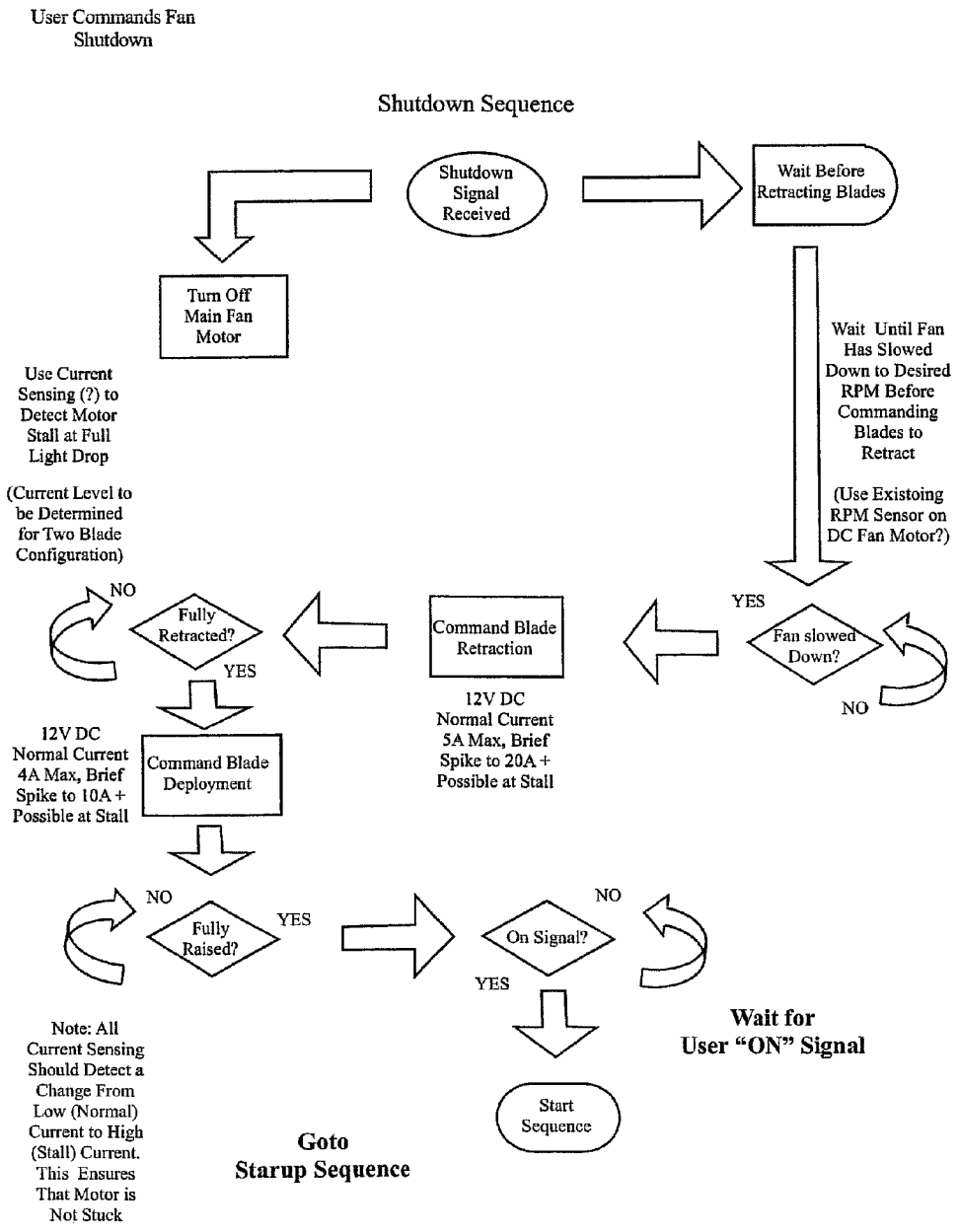
FIG. 60 is a flow diagram illustrating a "shutdown" sequence employed by a control system for controlling the ceiling fan described of the various embodiments described hereinabove in reference to FIGS. 1 through 57.

Referring to FIG. 60, a flow diagram is shown illustrating a "shutdown" sequence employed by a control system for controlling the ceiling fan described of the various embodiments described hereinabove in reference to FIGS. 1 through 57.

At the outset, the control device (such as a microcontroller or microprocessor modified with control software that controls one or more electromechanical or solid state switches that control the application of power to the main drive motor, the deployment motor(s), the light cover deployment motor, one or more mechanical or electrical switches or shifting mechanisms) continuously operates the fan at a desired speed and direction until a "shutdown" signal is received, either from a user controlled device indicating a "shutdown" of or a "reset" of the fan, or via a wobble sensor (such as a simple tilt switch or an electrolytic tilt sensor) indicating an imbalance in the fan blades relative to the entire fan.

In response thereto, in accordance with one embodiment, the controller will go to the "shutdown" sequence, whereby a main drive motor termination signal is activated and power to the main drive motor is cutoff. After the fan blades have slowed down (to a preset low RPM as detected by a sensor, such as a RPM sensor), the controller will activate the deployment motor to retract the fan blades.

After the fan blades are fully retracted (as detected by a sensor, such as a current sensor) the controller will command a raising of the lowered light cover (or housing). After the controller receives a signal detecting that the light cover has fully raised (i.e. the housing has closed) the controller will wait for a "start up" signal.

Figure 61:
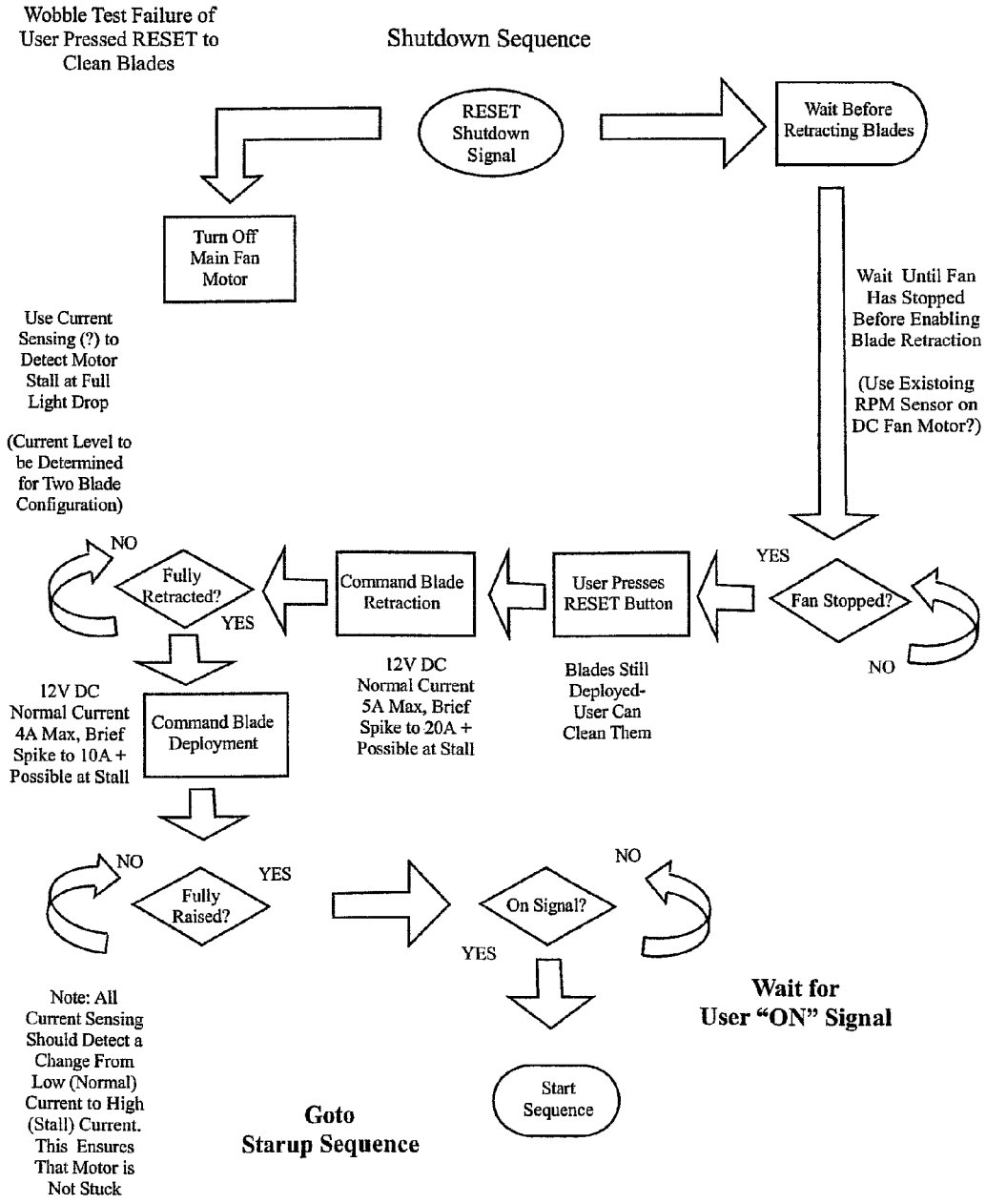
FIG. 61 is a flow diagram illustrating a "shutdown-reset" sequence employed by a control system for controlling the ceiling fan described of the various embodiments described hereinabove in reference to FIGS. 1 through 57.

Referring to FIG. 61, a flow diagram is shown illustrating a "shutdown-reset" sequence employed by a control system for controlling the ceiling fan described of the various embodiments described hereinabove in reference to FIGS. 1 through 57.

At the outset, a "reset" signal is sent (such as by the wobble sensor, or by a user activation of a wall switch, a switch accessible from the housing of the ceiling fan, or a wired or wireless remote control) to a control device (such as a microcontroller or microprocessor modified with control software that controls one or more electromechanical or solid state switches that control the application of power to the main drive motor, the deployment motor(s), the light cover deployment motor, one or more mechanical or electrical switches or shifting mechanism) initiating the "reset" sequence (or a cleaning mode).

In response thereto, in accordance with one embodiment, the controller will go to the "reset" sequence, whereby a main drive motor termination signal is activated and power to a main drive motor is cutoff, and the blades will remain in its existing deployed position. After the fan blades have stopped due to the activation of the "reset" sequence (as detected by a sensor, such as a RPM sensor), if the user activates "reset" sequence, the blades will then retract (and if applicable the housing unit will close). The controller will then wait for a start up signal.

What is claimed is:

1. A fan comprising:

a housing unit;

a retractable fan blade deployable from the housing unit;

a motive unit operably coupled to the retractable fan blade, wherein the motive unit is configured to drive the retractable fan blade from a retracted position within the housing unit to an extended position exterior to the housing unit, the motive unit comprising a deployment motor connected to a worm gear, the worm gear being operatively connected to a deployment gear, the deployment gear being a spur gear connected to a deployment shaft concentric to the deployment gear, the deployment shaft being connected to a blade shaft and at a substantially perpendicular angle, the blade shaft being connected to the retractable fan blade.

2. The fan of claim 1 further comprising:

the motive unit further configured to drive the retractable fan blade from the extended position exterior to the housing unit to the retracted position within the housing unit.

3. A method for adjusting a position of a fan blade, comprising the steps of:

providing a signal to a motive unit, wherein the motive unit is operably coupled to a retractable fan blade, the motive unit comprising a deployment motor connected to a worm gear, the worm gear being operatively connected to a deployment gear, the deployment gear being a spur gear connected to a deployment shaft concentric to the deployment gear, the deployment shaft being connected to a blade shaft and at a substantially perpendicular angle, the blade shaft being connected to the retractable fan blade;

driving the retractable fan blade from a position within a housing unit to a position exterior to the housing unit; and fixating the retractable fan blade in the position exterior to the housing unit.

4. The method of claim 3, further comprising the steps of:

providing a second signal to the motive unit;

driving the retractable fan blade from the position exterior to the housing unit to the position within the housing unit; and fixating the retractable fan blade in the position within the housing unit.

5. A fan comprising:

a housing unit;

a retractable fan blade deployable from the housing unit;

a motive unit operably coupled to the retractable fan blade, wherein the motive unit is configured to drive the retractable fan blade from a retracted position within the housing unit to an extended position exterior to the housing unit, the motive unit further configured to drive the retractable fan blade from the extended position exterior to the housing unit to the retracted position within the housing unit, the motive unit comprising a deployment motor connected to a transfer gear, the transfer gear being rotatively connected to a deployment gear, the transfer gear and the deployment gear each being a spur gear, the deployment gear being rotatively connected to a deployment shaft, the deployment shaft being connected to a blade shaft and at a substantially perpendicular angle, the blade shaft being connected to the retractable fan blade.

6. A fan comprising:

a housing unit;

a retractable fan blade deployable from the housing unit;

a motive unit operably coupled to the retractable fan blade, wherein the motive unit is configured to drive the retractable fan blade from a retracted position within the housing unit to an extended position exterior to the housing unit, the motive unit further configured to drive the retractable fan blade from the extended position exterior to the housing unit to the retracted position within the housing unit, the motive unit comprising a deployment motor connected to a spindle, the spindle being rotatively connected to a pin via a belt, the pin being connected to a deployment shaft, the deployment shaft being connected to a blade shaft and at a substantially perpendicular angle, the blade shaft being connected to the retractable fan blade.

7. A method for adjusting a position of a fan blade, comprising the steps of:

providing a signal to a motive unit, wherein the motive unit is operably coupled to a retractable fan blade, the motive unit comprising a deployment motor connected to a transfer gear, the transfer gear being rotatively connected to a deployment gear, the transfer gear and the deployment gear each being a spur gear, the deployment gear being rotatively connected to a deployment shaft, the deployment shaft being connected to a blade shaft and at a substantially perpendicular angle, the blade shaft being connected to the retractable fan blade;

driving the retractable fan blade from a position within a housing unit to a position exterior to the housing unit;

fixating the retractable fan blade in the position exterior to the housing unit;

providing a second signal to the motive unit;

driving the retractable fan blade from the position exterior to the housing unit to the position within the housing unit; and fixating the retractable fan blade in the position within the housing unit.

8. A method for adjusting a position of a fan blade, comprising the steps of:

providing a signal to a motive unit, wherein the motive unit is operably coupled to a retractable fan blade, the motive unit comprising a deployment motor connected to a spindle, the spindle being rotatively connected to a pin via a belt, the pin being connected to a deployment shaft, the deployment shaft being connected to a blade shaft and at a substantially perpendicular angle, the blade shaft being connected to the retractable fan blade;

driving the retractable fan blade from a position within a housing unit to a position exterior to the housing unit;

fixating the retractable fan blade in the position exterior to the housing unit;

providing a second signal to the motive unit;

driving the retractable fan blade from the position exterior to the housing unit to the position within the housing unit; and fixating the retractable fan blade in the position within the housing unit.

* * * * *